US008283096B2

(12) United States Patent
Yamada et al.

(10) Patent No.: US 8,283,096 B2
(45) Date of Patent: Oct. 9, 2012

(54) ELECTROPHOTOGRAPHIC PHOTORECEPTOR, PROCESS CARTRIDGE AND IMAGE FORMING APPARATUS

(75) Inventors: Wataru Yamada, Kanagawa (JP); Katsumi Nukada, Kanagawa (JP); Masahiro Iwasaki, Kanagawa (JP); Akira Hirano, Kanagawa (JP); Takatsugu Doi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 530 days.

(21) Appl. No.: 12/550,913

(22) Filed: Aug. 31, 2009

(65) Prior Publication Data

US 2010/0248101 A1 Sep. 30, 2010

(30) Foreign Application Priority Data

Mar. 27, 2009 (JP) ..... 2009-080049

(51) Int. Cl.
*G03G 5/047* (2006.01)

(52) U.S. Cl. ..... 430/58.7; 430/58.35; 430/66; 399/159; 399/111

(58) Field of Classification Search ..... 430/58.7, 430/66, 58.35, 58.75; 399/111, 159
See application file for complete search history.

(56) References Cited

U.S. PATENT DOCUMENTS

| | | | |
|---|---|---|---|
| 5,283,145 | A | 2/1994 | Nukada et al. |
| 5,290,928 | A | 3/1994 | Nukada et al. |
| 5,298,617 | A | 3/1994 | Nukada et al. |
| 5,302,479 | A | 4/1994 | Daimon et al. |
| 5,308,728 | A | 5/1994 | Imai et al. |
| 5,338,636 | A | 8/1994 | Nukada et al. |
| 5,358,813 | A | 10/1994 | Iijima et al. |
| 5,378,569 | A | 1/1995 | Nukada et al. |
| 5,393,629 | A | 2/1995 | Nukada et al. |
| 5,411,827 | A | 5/1995 | Tamura et al. |
| 5,416,207 | A | 5/1995 | Imai et al. |
| 5,459,004 | A | 10/1995 | Katsumi et al. |
| 5,463,043 | A | 10/1995 | Nukada et al. |
| 5,496,671 | A | 3/1996 | Tamura et al. |
| 5,639,581 | A | 6/1997 | Iwasaki et al. |
| 5,654,119 | A | 8/1997 | Ishii et al. |
| 5,695,898 | A | 12/1997 | Go et al. |

(Continued)

FOREIGN PATENT DOCUMENTS

JP 03055558 A * 3/1991

(Continued)

*Primary Examiner* — Christopher Rodee
(74) *Attorney, Agent, or Firm* — Oliff & Berridge, PLC

(57) ABSTRACT

An electrophotographic photoreceptor comprising:
a conductive substrate;
a photosensitive layer formed on the conductive substrate; and
an outermost surface layer that is a layer made of a cured material of a composition including at least one compound represented by the following formula (I) and at least one compound having charge transportability and an azo group:

(I)

wherein in formula (I), F represents an n-valent organic group having a hole transporting property, R represents a hydrogen atom or an alkyl group, L represents a divalent organic group, n represents an integer of 1 or more, and j represents 0 or 1.

14 Claims, 6 Drawing Sheets

U.S. PATENT DOCUMENTS

| | | | | |
|---|---|---|---|---|
| 5,734,003 | A | 3/1998 | Iwasaki et al. | |
| 6,180,303 | B1 | 1/2001 | Uematsu et al. | |
| 2005/0266325 | A1* | 12/2005 | Yanagawa et al. | 430/58.7 |
| 2007/0231720 | A1* | 10/2007 | Mori et al. | 430/58.7 |

FOREIGN PATENT DOCUMENTS

| | | | |
|---|---|---|---|
| JP | 04022967 | A * | 1/1992 |
| JP | A-4-189873 | | 7/1992 |
| JP | A-5-98181 | | 4/1993 |
| JP | A-5-140472 | | 6/1993 |
| JP | A-5-140473 | | 6/1993 |
| JP | A-5-216249 | | 8/1993 |
| JP | A-5-263007 | | 10/1993 |
| JP | A-5-279591 | | 10/1993 |
| JP | A-8-176293 | | 7/1996 |
| JP | A-8-208820 | | 8/1996 |
| JP | A-2000-19749 | | 1/2000 |
| JP | A-2000-66424 | | 3/2000 |
| JP | B2-3287678 | | 6/2002 |
| JP | 2003076046 | A * | 3/2003 |
| JP | A-2004-12986 | | 1/2004 |
| JP | A-2004-240079 | | 8/2004 |
| JP | A-2005-234546 | | 9/2005 |

* cited by examiner

ELECTROPHOTOGRAPHIC PHOTORECEPTOR, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2009-080049 filed on Mar. 27, 2009.

BACKGROUND

1. Technical Field

The present invention relates to an electrophotographic photoreceptor, a process cartridge and an image forming apparatus.

2. Related Art

Generally, an electrophotographic image forming apparatus has the following structure and processes. Specifically, an image-formed material is obtained by charging the surface of an electrophotographic photoreceptor by a charging unit in order to impart a desired polarity and a potential to the surface; forming an electrostatic latent image on the charged surface of the electrophotographic photoreceptor by exposing the surface to light in an image-wise manner to selectively discharging the surface; developing the latent image by attaching a toner thereto by a developing unit to form a toner image; and transferring the toner image onto an image-receiving medium by a transfer unit.

In recent years, the electrophotographic photoreceptor has become used more often in the fields of copy machines, laser beam printers and the like, because it has an advantage of providing high speed and high quality printing.

As the electrophotographic photoreceptor used in these image forming apparatuses, an electrophotographic photoreceptor (inorganic photoreceptor) using conventional inorganic photoconductive materials such as selenium, a selenium and tellurium alloy, a selenium and arsenic alloy, and cadmium sulfide has been known. In recent years, an electrophotographic photoreceptor (organic photoreceptor) using an organic photoconductive material, that exhibits excellent advantages in the low-cost productivity and disposability thereof, has become dominating a main stream.

A corona charging method utilizing a corona charging device has been conventionally used as a charging method. In recent years, however, a contact charging method, having such advantages as suppressed amounts of ozone production and power consumption, has been put to practical application and actively used. In the contact charging method, the surface of an electrophotographic photoreceptor is charged by bringing a conductive member serving as a charging member into contact with the surface of the electrophotographic photoreceptor, or by bringing the conductive member close to the surface of the electrophotographic photoreceptor, and then applying voltage to the charging member. As the methods of applying voltage to the charging member, there are a direct current method in which only a direct current voltage is applied, and an alternating current superposition method in which a direct current voltage is applied while superposing an alternating current voltage thereto. The contact charging method has such advantages as downsizing of the apparatus and suppressed generation of harmful gases such as ozone.

As a transfer method, a method of transferring a toner image onto a recording paper via an intermediate transfer medium, which is applicable to a wide variety of recording paper, has been in wide use in place of a conventionally employed method in which a toner image is directly transferred onto a recording paper.

SUMMARY

According to an aspect of the invention, an electrophotographic photoreceptor comprising:

a conductive substrate;

a photosensitive layer formed on the conductive substrate; and an outermost surface layer that is a layer made of a cured material of a composition including at least one compound represented by the following formula (I) and at least one compound having charge transportability and an azo group:

(I)

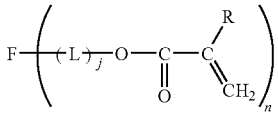

wherein in formula (I), F represents an n-valent organic group having a hole transporting property, R represents a hydrogen atom or an alkyl group, L represents a divalent organic group, n represents an integer of 1 or more, and j represents 0 or 1.

BRIEF DESCRIPTION OF THE DRAWINGS

Exemplary embodiments of the present invention will be described in detail based on the following figures, wherein.

DETAILED DESCRIPTION

[Electrophotographic Photoreceptor]

Figure 1:
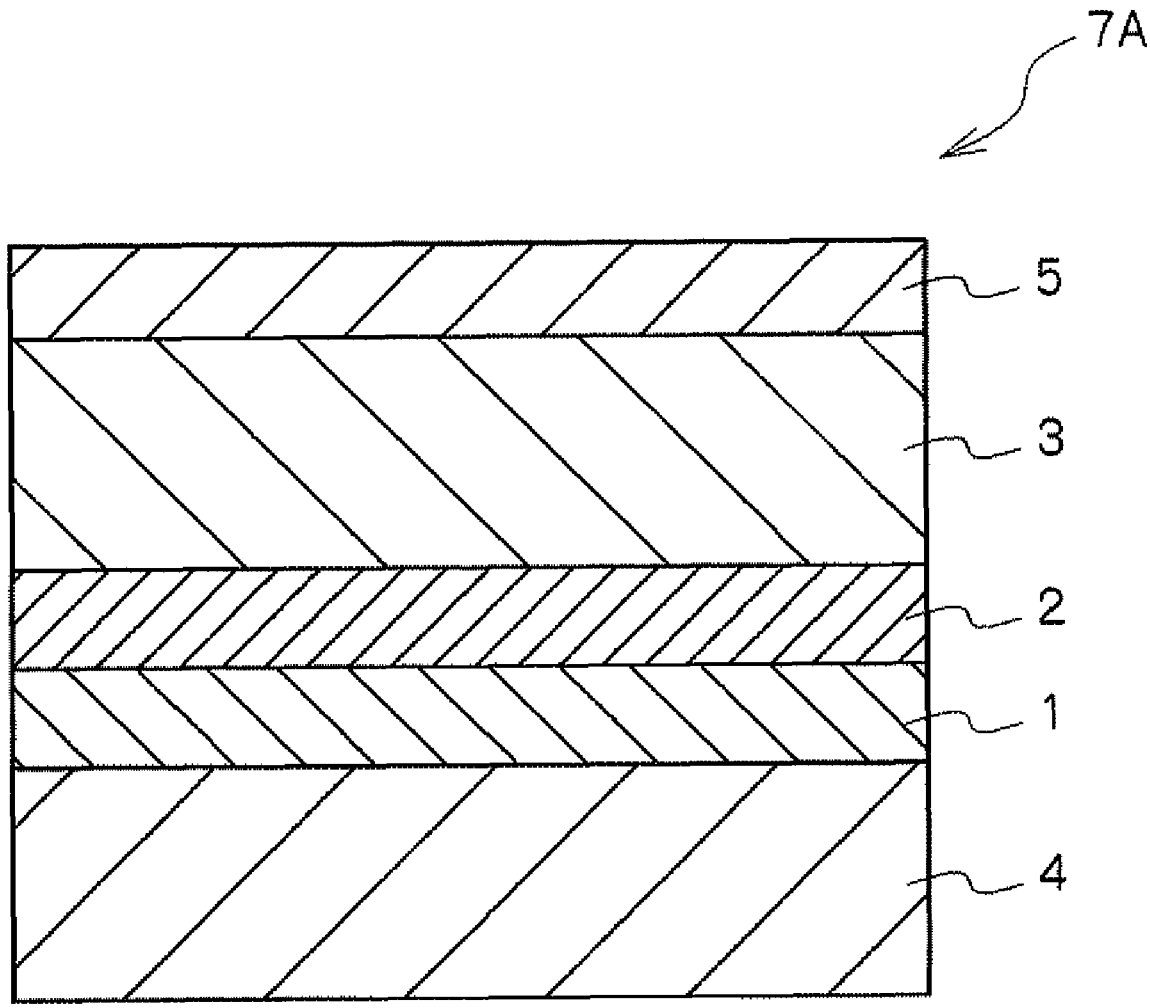
FIG. 1 is a schematic partial cross sectional view showing an electrophotographic photoreceptor according to an exemplary embodiment of the invention.

An electrophotographic photoreceptor involving the exemplary embodiment of the invention is an electrophotographic photoreceptor that includes at least a conductive substrate and a photosensitive layer formed on the conductive substrate, wherein an outermost surface layer is a layer made of a cured material of a composition containing at least one of compounds represented by formula (I) shown above and at least one of compounds having charge transportability and an azo group.

In an electrophotographic photoreceptor involving the exemplary embodiment, when configured as mentioned above, the mechanical strength of an outermost surface layer is made higher and density unevenness and ghosting are inhibited from occurring over a long period of time; accordingly, a stable image is obtained over a long period of time.

The reason for this is not clear but inferred as shown below.

That is, when an outermost surface layer of a photoreceptor is formed of a cured material obtained by curing a charge transporting material having a (meth)acryloyl group, the charge transporting material is preferably cured by low energy such as heat from the viewpoint of reducing damage to the photosensitive layer. However, even in the cured material cured at such low energy, charge traps are formed, and thereby image defects called as density unevenness and ghosting may result in some cases.

In the exemplary embodiment, a composition including a combination of a compound represented by formula (I) that is a charge transporting material having a (meth)acryloyl group, and a compound that functions as a polymerization initiator and has charge transportability and an azo group is used. Thus, both compounds have the charge transportability and excellent in compatibility because of their similar performance; accordingly, it is thought that, in a cured material, a region the charge transportability is locally deteriorated is less likely to form. Accordingly, it is further thought that a charge trap is inhibited from forming in the cured material; as a result, when the outermost surface layer is formed from such a cured material, a photoreceptor capable of inhibiting density unevenness and ghosting from occurring over a long period of time is obtained.

The electrophotographic photoreceptor involving the exemplary embodiment, as mentioned above, has an outermost surface layer made of a cured material of a composition containing a compound represented by formula (I) and a compound that has the charge transportability and an azo group. The outermost surface layer preferably forms an uppermost surface of the electrophotographic photoreceptor itself and is particularly preferably formed as a layer that functions as a,protective layer or a layer that functions as a charge transport layer.

When the outermost surface layer functions as a protective layer, a form where a photosensitive layer and a protective layer as the outermost surface layer are formed on a conductive substrate, and the protective layer is constituted of a cured material of a composition containing a compound represented by formula (I) and a compound having charge transportability and an azo group is cited.

On the other hand, when the outermost surface layer is a layer that functions as a charge transport layer, a form where a charge generating layer and a charge transport layer as the outermost surface layer are formed on a conductive substrate, and the charge transport layer is constituted of a cured material of a composition containing a compound represented by formula (I) and a compound having charge transportability and an azo group is cited.

Hereinafter, an electrophotographic photoreceptor involving the exemplary embodiment when an outermost surface layer is a layer that functions as a protective layer will be detailed with reference to the drawings. In the drawings, same or corresponding portions are provided with same reference marks and omitted from duplicating descriptions.

Figure 2:
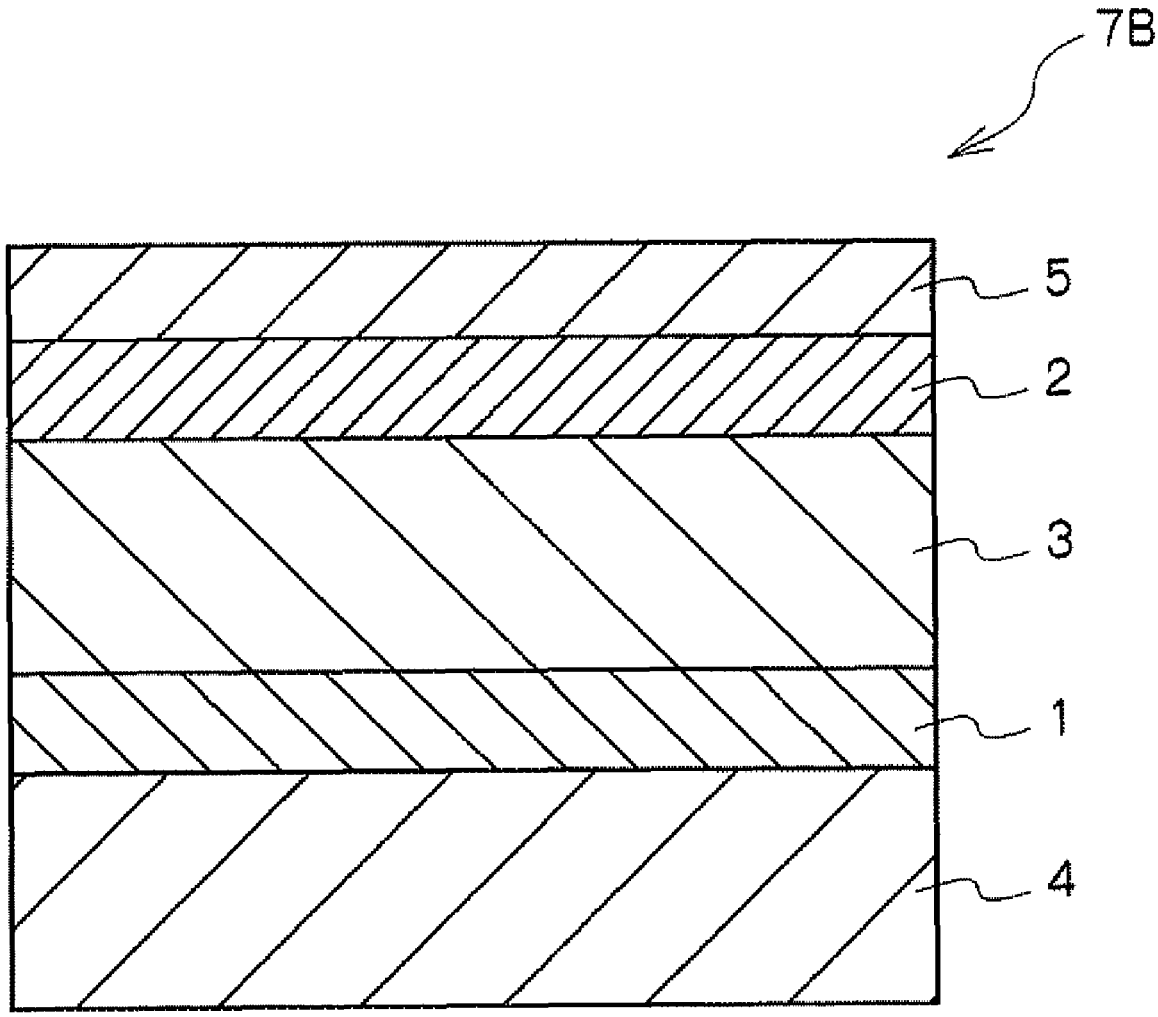
FIG. 2 is a schematic partial cross sectional view showing an electrophotographic photoreceptor according to an exemplary embodiment of the invention.
Figure 3:
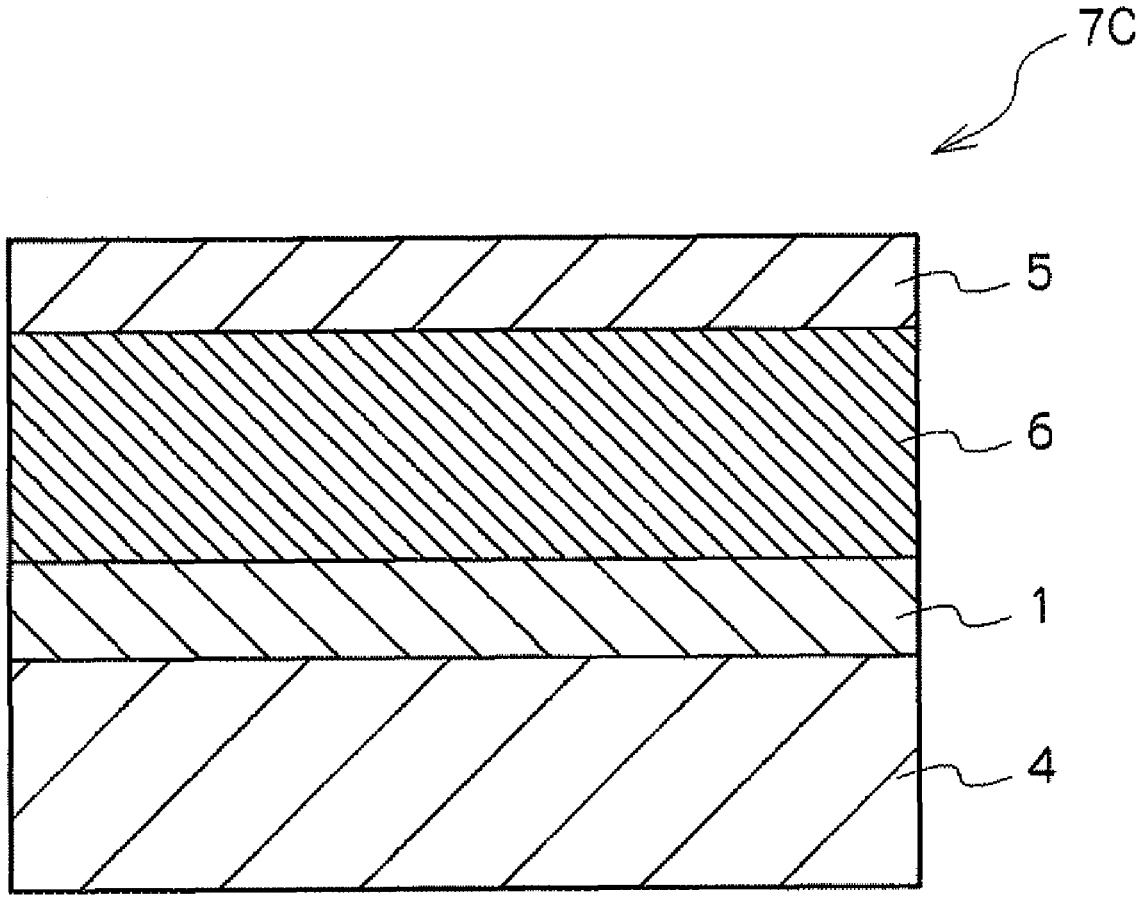
FIG. 3 is a schematic partial cross sectional view showing an electrophotographic photoreceptor according to an exemplary embodiment of the invention.

FIG. 1 is a schematic sectional view showing a preferable exemplary embodiment of an electrophotographic photoreceptor involving an exemplary embodiment. FIG. 2 and FIG. 3 each are a schematic sectional view showing an electrophotographic photoreceptor involving another exemplary embodiment.

An electrophotographic photoreceptor 7A shown in FIG. 1 is a so-called function separation type photoreceptor (or a laminate type photoreceptor) and has a structure where an undercoat layer 1 is formed on a conductive substrate 4, and further thereon, a charge generating layer 2, a charge transport layer 3 and a protective layer 5 are sequentially formed. In the electrophotographic photoreceptor 7A, a photosensitive layer is constituted of the charge generating layer 2 and the charge transport layer 3.

An electrophotographic photoreceptor 7B shown in FIG. 2 is a function separation type photoreceptor where, similar to the electrophotographic photoreceptor 7A shown in FIG. 1, a function is divided into a charge generating layer 2 and a charge transport layer 3. An electrophotographic photoreceptor 7C shown in FIG. 3 contains a charge generating material and a charge transporting material in the same layer (monolayer type photosensitive layer 6 (charge generating/charge transport layer)).

The electrophotographic photoreceptor 7B shown in FIG. 2 has a structure where an undercoat layer 1 is formed on a conductive substrate 4, and, further thereon, a charge transport layer 3, a charge generating layer 2 and a protective layer 5 are sequentially formed. In the electrophotographic photoreceptor 7B, a photosensitive layer is formed of the charge transport layer 3 and the charge generating layer 2.

Furthermore, an electrophotographic photoreceptor 7C shown in FIG. 3 has a structure where an undercoat layer 1 is formed on a conductive substrate 4 and further thereon a monolayer type photosensitive layer 6 and a protective layer 5 are sequentially formed.

In the electrophotographic photoreceptors 7A to 7C shown in FIGS. 1 to 3, the protective layer 5 is an outermost surface layer formed on a side farthest from the conductive substrate 4, and the outermost surface layer has the foregoing predetermined configuration.

In the electrophotographic photoreceptors shown in FIGS. 1 to 3, an undercoat layer 1 may or may not be formed.

Hereinafter, based on the electrophotographic photoreceptor 7A shown in FIG. 1 as a representative example, the respective constituents will be described.

<Conductive Substrate>

Examples of the conductive substrate 4 include a metal plate, a metal drum and a metal belt, which are constituted using metal or alloy of such as aluminum, copper, zinc, stainless steal, chromium, nickel, molybdenum, vanadium, indium, gold or platinum. Examples of the conductive substrate 4 further include a paper sheet, a plastic film and a belt, on which a conductive polymer, a conductive compound such as indium oxide or metal or alloy of such as aluminum, palladium, or gold is coated, deposited or laminated.

Herein, "conductive property" means that volume resistivity is less than $10^3$ Ωcm.

When the electrophotographic photoreceptor 7A is used in a laser printer, a surface of the conductive substrate 4 is preferably roughened so as to be from 0.04 μm to 0.5 μm in the center line average roughness Ra, from the viewpoint of inhibiting an interference pattern from generating when laser beam is irradiated. When Ra is less than 0.04 μm, the conductive substrate has a near mirror surface and thereby tends to be insufficient in the interference inhibiting effect. On the other hand, when Ra exceeds 0.5 μm, even when a film is formed, image quality tends to be roughened. When non-interfering light is used as a light source, roughening for inhibiting the interference pattern from occurring is not particularly required. Defects caused by irregularity on a surface of the conductive substrate 4 may be inhibited from occurring to result in good in durability.

As a method for roughening a surface, a wet horning method where a suspension obtained by suspending a polishing agent in water is sprayed on a substrate, a centerless grinding method where a substrate is pressed against a rotating grinding stone to continuously grind, or an anodic oxidation treatment is preferable.

As another method for roughening a surface, a method where, without roughening a surface of the conductive substrate 4, a dispersion obtained by dispersing a conductive or semiconductive powder in a resin is applied to form a layer on a surface of a substrate, and particles dispersed in the layer roughen a surface is preferably used as well.

In a surface roughening process by anodic oxidation, anodic oxidation is conducted in an electrolytic solution with aluminum as an anode to form an oxide film on a surface of aluminum. As the electrolytic solution, a solution of sulfuric acid and a solution of oxalic acid are cited. However, a porous anodic oxide film formed by anodic oxidation per se is chemically active, tends to be contaminated and is large in variation of resistance depending on an environment. In this connection, it is preferable to apply a sealing process where micropores of the anodic oxide film are sealed by volume expansion caused by hydration in pressurized vapor or boiling water (a metal salt of nickel may be added) to change into a stable hydrated oxide.

A film thickness of the anodic oxide film is preferably from 0.3 μm to 15 μM. When the film thickness is less than 0.3 μm, a barrier property against injection is less to tend to be insufficient in the advantage. On the other hand, when the film thickness exceeds 15 μm, a residual potential tends to rise by repeating usage.

The conductive substrate 4 may be treated with an acidic aqueous solution or boehmite. The treatment with an acidic treatment solution containing phosphoric acid, chromic acid and hydrofluoric acid is conducted as shown below. In the beginning, an acidic treatment solution is prepared. A blending ratio of each of phosphoric acid, chromic acid and hydrofluoric acid in the acidic treatment solution is from 10% by weight to 11% by weight for phosphoric acid, from 3% by weight to 5% by weight for chromic acid and from 0.5% by weight to 2% by weight for hydrofluoric acid. A concentration of acids as a whole is preferably from 13.5% by weight to 18% by weight. A treatment temperature is preferably from 42° C. to 48° C. However, when a treatment temperature is maintained high, a coated film may be formed at a higher speed and thicker compared with a case where a treatment temperature is maintained lower than the range of the treatment temperature. A film thickness of the coated film is preferably from 0.3 μm to 15 μm. When the film thickness is less than 0.3 μm, the barrier property against injection is less to tend to be insufficient in the advantage. On the other hand, when the film thickness exceeds 15 μm, a residual potential tends to rise owing to repeating usage.

The boehmite treatment is conducted by dipping in pure water heated at from 90° C. to 100° C. and for from 5 min to 60 min, or by bringing into contact with steam heated at from 90° C. to 120° C. for from 5 min to 60 min. A film thickness of the coated film is preferably from 0.1 μm to 5 μm. Thereto, an anodic oxidation treatment may be further applied with an electrolytic solution of an acid such as adipic acid, boric acid, borate, phosphate, phthalate, maleate, benzoate, tartrate or citrate, which is lower in a dissolving property of the coated film than other species.

<Undercoat Layer>

The undercoat layer 1 includes, for example, inorganic particles in a binder resin.

As the inorganic particle, the inorganic particle having powder resistance (volume resistivity) of from $10^2$ Ω·cm to $10^{11}$ Ω·cm is preferably used. This is because the undercoat layer 1 is necessary to obtain appropriate resistance to obtain leakage resistance and carrier blocking resistance. When a resistance value of the inorganic particle is lower than the lower limit of the range, sufficient leakage resistance is not obtained, and, when the resistance value is higher than the upper limit value of the range, increase in residual potential may be caused.

Among these, preferable examples of the inorganic particle having the above resistance value include inorganic particle (conductive metal oxide) of tin oxide, titanium oxide, zinc oxide, or zirconium oxide. Zinc oxide is particularly preferred.

Furthermore, the inorganic particle may be surface treated or at least two of differently surface-treated particles or particles having different particle diameter may be mixed and used.

A volume average particle diameter of the inorganic particles is preferably in the range of from 50 nm 2000 nm (more preferably from 60 nm to 1000 nm).

The inorganic particles preferably have a specific surface area, by a BET method of 10 $m^2$/g or more. When the specific surface area value is less than 10 $m^2$/g, chargeability tends to be deteriorated to result in difficulty in obtaining excellent electrophotographic characteristics.

When an acceptor compound is contained together with the inorganic particles, an undercoat layer excellent in the long term stability of the electric characteristics and in the carrier blocking resistance is obtained.

As the acceptor compound, any one may be used as long as it gives desired characteristics. Preferable examples of the acceptor compound include electron transporting materials including a quinone compound such as chloranyl or bromanyl, a tetracyanoquinodimethane compound, a fluorenone compound such as 2,4,7-trinitrofluorenone or 2,4,5,7-tetranitro-9-fluorenone, an oxadiazole compound such as 2-(4biphenyl)-5-(4-t-butylphenyl)-1,3,4-oxadiazole, 2,5-bis(4-naphtyl)-1,3,4-oxadiazole, or 2,5-bis(4-diethylaminophenyl)-1,3,4-oxadiazole, a xanthone compound, a thiophene compound, and a diphenoquinone compound such as 3,3',5,5'-tetra-t-butyldiphenoquinone. A compound having an anthraquinone structure is particularly preferred. Furthermore, an acceptor compound having an anthraquinone structure such as a hydroxyanthraquinone compound, an aminoanthraquinone compound, or an aminohydroxyanthraquinone compound is preferably used. Specific examples thereof include anthraquinone, alizarin, quinizarin, anthrarufin and purprin.

The content of the acceptor compound may be arbitrarily set as long as it is in the range where desired characteristics are obtained. However, the content is set preferably in the range of from 0.01% by weight to 20% by weight relative to inorganic particles. The content is more preferably set in the range of from 0.05% by weight to 10% by weight with respect to the inorganic particles from the viewpoint of inhibiting charges from storing and inorganic particles from flocculating. When the inorganic particles flocculate, fluctuation in the formation of a conductive path tends to be generated; accordingly, during repeating usage, not only a residual potential goes up to deteriorate the maintainability but also image defects such as black spots tend to be generated.

The acceptor compound has only to be added to a coating solution for forming the undercoat layer forming coating solution or may be attached in advance to a surface of inorganic particles.

As a method for imparting an acceptor compound to a surface of inorganic particles, a dry process or a wet process is cited.

When a dry process is used to apply surface treatment, under stirring inorganic particles by a mixer large in the shearing force, an acceptor compound is added dropwise directly or by dissolving in an organic solvent or sprayed together with dry air or nitrogen gas to be able to apply without fluctuation. When the acceptor compound is added or sprayed, it is preferable to apply at a temperature equal to or lower than a boiling temperature of the solvent. When the acceptor compound is sprayed at a temperature equal to or higher than a boiling temperature of the solvent, there is a disadvantage in that, before stirring without fluctuation, the solvent vaporizes, and thereby the acceptor compound is locally flocculated to be difficult to apply without fluctuation. The acceptor compound, after addition or spraying, may be further baked at a temperature of 100° C. or higher. The baking may be applied in an arbitrary range of temperature and time as long as the temperature and time may impart desired electrophotographic characteristics.

As a wet process, when inorganic particles are stirred in a solvent, followed by dispersing by use of ultrasonic, a sand mill, an attritor or a ball mill, further followed by adding an acceptor compound, followed by stirring and dispersing, further followed by removing the solvent, the wet process is conducted without fluctuation. As a process for removing the solvent, a filtering or distilling process is adopted. After the solvent is removed, baking at 100° C. or higher may be further applied. The baking may be conducted in an arbitrary range as long as the temperature and a time may impart desired electrophotographic characteristics. In a wet process, before a surface treatment agent is added, moisture contained in inorganic particles may be removed. As an example thereof, a method of removing moisture under stirring and heating in a solvent used in the surface treatment or a method of performing azeotropic removal with the solvent may be used.

Furthermore, inorganic particles may be surface treated before adding an acceptor compound. A surface treatment agent may be selected from known materials as long as desired characteristics are obtained. Examples thereof include silane coupling agents, titanate coupling agents, aluminum coupling agents and surfactants. The silane coupling agent is particularly preferred because it imparts excellent electrophotographic characteristics. Furthermore, a silane coupling agent having an amino group is preferably used because it imparts excellent blocking resistance to the undercoat layer 1.

As the silane coupling agent having an amino group, any one of them may be used as long as desired electrophotographic photoreceptor characteristics are obtained. Specific examples thereof include γ-aminopropyltriethoxysilane, N-β-(aminoethyl)-γ-aminopropylmethoxysilane, N-β-(aminoethyl)-γ-aminopropylmethyldimethoxysilane, and N,N-bis(β-hydroxyethyl)-γ-aminopropyltriethoxysilane without restricting thereto.

The silane coupling agents may be used in a mixture of at least two of them. Examples of the silane coupling agent that may be used together with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane and γ-chloropropyltrimethoxysilane without restricting thereto.

As a surface treatment process that uses the surface treatment agent, any one of known processes may be used. However, a dry process or a wet process is preferably used. Furthermore, addition of the acceptor compound may be performed simultaneously using the surface treatment with a surface treatment agent such as a coupling agent.

An amount of the silane coupling agent relative to the inorganic particles in the undercoat layer 1 may be arbitrarily set as long as desired electrophotographic characteristics are obtained. However, the amount of the silane coupling agent is preferably from 5% by weight to 10% by weight relative to the inorganic particles from the viewpoint of improvement in the dispersibility.

The undercoat layer 1 may contain a binder resin.

As the binder resin contained in the undercoat layer 1, any one of known binder resins may be used as long as it may form an excellent film and may impart desired characteristics. Examples thereof include known polymer resin compounds such as acetal resins such as polyvinyl butyral resins, polyvinyl alcohol resins, casein, polyamide resins, cellulose resins, gelatin, polyurethane resins, polyester resins, methacryl resin, acryl resins, polyvinyl chloride resins, polyvinyl acetate resins, vinyl chloride-vinyl acetate-maleic anhydride resins, silicone resins, silicone-alkyd resins, phenol resins, phenol-formaldehyde resins, a melamine resins, or urethane resins; charge transporting resins having a charge transporting group; and conductive resins such as polyaniline resins. Among these, a resin insoluble in a coating solvent for an upper layer is preferably used. Particularly preferable examples thereof include a phenol resins, a phenol-formaldehyde resins, a melamine resins, a urethane resins and an epoxy resins. When these are used in a combination of two or more of them, a mixing ratio is set as required.

In a coating solution for forming the undercoat layer, a ratio of the amount of inorganic particles on a surface of which an acceptor compound is imparted (acceptor property-imparted metal oxide) to the amount of a binder resin or a ratio of the amount of inorganic particles to the amount of a binder resin is arbitrarily set in a range that may impart desired electrophotographic photoreceptor characteristics.

In the undercoat layer 1, a variety of additives may be added to improve electric characteristics, environmental stability and image quality.

As the additive, known materials such as a polycondensed or azo electron transporting pigment, a zirconium chelate compound, a titanium chelate compound, an aluminum chelate compound, a titanium alkoxide compound, an organic titanium compound or a silane coupling agent may be used. The silane coupling agent may be further added to a coating solution for forming the undercoat layer, in addition to usage in the surface treatment of the inorganic particles as mentioned above.

Specific examples of the silane coupling agent as an additive include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane and γ-chloropropyltrimethoxysilane.

Furthermore, examples of the zirconium chelate compound include zirconium butoxide, ethyl zirconium acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the titanium chelate compound include tetraisopropyl titanate, tetra-n-butyl titanate, butyl titanate dimer, tetra(2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the aluminum chelate compound include aluminum isopropylate, monobutoxyaluminum diisopropylate, aluminum butylate, ethyl acetoacetate aluminum diisopropylate, and aluminum tris(ethylacetoacetate).

The compounds may be used alone or as a mixture or a polycondensate of plural compounds.

A solvent used to prepare the coating solution for forming the undercoat layer is arbitrarily selected from known organic solvents, for example, alcohol solvents, aromatic solvents, halogenated hydrocarbon solvents, ketone solvents, ketone-alcohol solvents, ether solvents and ester solvents.

Specific examples of the solvent include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene or toluene.

The solvents may be used alone or in a mixture of two or more of them. When the solvents are mixed, solvents used may be any one as long as the mixed solvent may dissolve a binder resin.

As a method for dispersing inorganic particles when a coating solution for forming the undercoat layer is prepared, a known method using such as a roll mill, a ball mill, a vibration ball mill, an attritor, a sand mill, a colloid mill or a paint shaker may be used.

As a coating method for disposing an undercoat layer 1, an ordinary method such as a blade coating method, a wire bar coating method, a spray coating method, a dip coating method, a bead coating method, an air knife coating method or a curtain coating method may be used.

With thus obtained coating solution for forming the undercoat layer, an undercoat layer 1 is formed on a conductive substrate.

The undercoat layer 1 preferably has Vickers hardness of 35 or more.

Furthermore, the undercoat layer 1 may be set at any thickness as long as desired characteristics may be obtained. However, the thickness of the undercoat layer 1 is preferably set at 15 μm or more and more preferably at from 15 μm to 50 μm.

When the thickness of the undercoat layer 1 is less than 15 μm, sufficient leakage resistance may not be obtained. On the other hand, when the thickness thereof is more than 50 μm, a residual potential tends to remain after usage over a long period of time, and thereby image density abnormality tends to be caused.

The surface roughness (10 point-average surface roughness) of the undercoat layer 1 is adjusted to be from $\frac{1}{4}\times n\times\lambda$ (n: refractive index of an upper layer) to $\frac{1}{2}\times n\times\lambda$ relative to a laser wavelength λ used to exposure, from the viewpoint of inhibiting a moire image from occurring.

Particles of a resin may be added to the undercoat layer 1 to control the surface roughness. As the resin particles, particles of a silicone resin or particles of crosslinked methyl polymethacrylate resin may be used.

The undercoat layer 1 preferably contains a binder resin and a conductive metal oxide that is inorganic particle, and has light transmittance to light having a wavelength of 950 nm at a thickness of 20 μm of 40% or less (preferably from 10% to 35%, more preferably from 15% to 30%).

The light transmittance of the undercoat layer 1 is measured as shown below. The coating solution for forming the undercoat layer is coated on a glass plate so that a dry thickness may be 20 μm, followed by drying, further followed by measuring the light transmittance of the resulting a film at a wavelength of 950 nm with a spectrophotometer. When the light transmittance is measured with a photometer, SPECTROPHOTOMETER (U-2000) (trade name, manufactured by Hitachi Ltd.,) is used as a spectrophotometer.

The light transmittance of the undercoat layer is controlled by adjusting a dispersion time when inorganic particles are dispersed by means of a roll mill, a ball mill, a vibration ball mill, an attritor, a sand mill, a colloid mill or a paint shaker, which is used to prepare the coating solution for forming the undercoat layer. The dispersion time is set at an arbitrary time preferably from 5 min to 1000 hr and more preferably from 30 min to 10 hr without particularly restricting. As the dispersion time is set longer, the light transmittance tends to be lowered.

A surface of the undercoat layer may be polished to adjust the surface roughness.

Examples of the polishing method include a buff polishing method, a sand blast method, a wet horning method and a grinding method.

The undercoat layer 1 is obtained by drying the coating solution for forming the undercoat layer coated on the conductive substrate 4. The coating solution for forming the undercoat layer is usually dried at a temperature capable of evaporating the solvent and of forming a film.

<Charge Generating Layer>

A charge generating layer 2 is a layer containing a charge generating material and a binder resin.

Examples of the charge generating material include an azo pigment such as a bisazo pigment or a trisazo pigment, a condensed aromatic pigment such as dibromoanthoanthrone, a perylene pigment, a pyrrolopyrole pigment, a phthalocyanine pigment, zinc oxide, and trigonal selenium. Among these, in order to respond to near-infrared laser exposure, a metal phthalocyanine pigment and a metal-free phthalocyanine pigment are preferably used as a charge generating material. In particular, hydroxygallium phthalocyanine disclosed in JP-A Nos. 05-263007 and 05-279591, chlorogallium phthalocyanine disclosed in JP-A No. 05-98181, dichlorotin phthalocyanine disclosed in JP-A Nos. 05-140472 and 05-140473, and titanyl phthalocyanine disclosed in JP-A No. 04-189873 are preferred. Furthermore, in order to respond to near-ultraviolet laser exposure, as a charge generating material, a condensed aromatic pigment such as dibromoanthoanthrone, a thioindigo pigment, a porphyrazine compound, zinc oxide or trigonal selenium is preferably used.

As the charge generating material, an inorganic pigment is preferable to correspond to a case where a light source having an exposure wavelength of from 380 nm to 500 nm is used, and, a metal phthalocyanine pigment and a metal-free phthalocyanine pigment are preferable to correspond to a case where a light source having an exposure wavelength of from 700 nm to 800 nm is used.

As the charge generating material, a hydroxygallium phthalocyanine pigment having a maximum peak wavelength in the range of from 810 nm to 839 nm in a spectral absorption spectrum in a wavelength region of from 600 nm 900 nm is preferably used. The hydroxygallium phthalocyanine pigment is different from the conventional V-type hydroxygallium phthalocyanine pigment and is preferable because it has more excellent dispersibility. Thus, when a maximum peak wavelength of the spectral absorption spectrum is shifted to a shorter wavelength side than the conventional V-type hydroxygallium phthalocyanine pigment, a fine hydroxygallium phthalocyanine pigment in which a crystal alignment of pigment particle is suitably controlled is obtained. When the hydroxygallium phthalocyanine pigment is used as a material for an electrophotographic photoreceptor, excellent dispersibility, and sufficient sensitivity, chargeability and dark attenuation characteristics are obtained.

The hydroxygallium phthalocyanine pigment having a maximum peak wavelength in the range from 810 nm to 839 nm preferably has an average particle diameter in a specific range and a BET specific surface area in a specific range. Specifically, the average particle diameter is preferably 0.20 μm or less and more preferably from 0.01 μm to 0.15 μm. The BET specific surface area is preferably 45 $m^2/g$ or more, more preferably 50 $m^2/g$ or more and particularly preferably from 55 $m^2/g$ to 120 $m^2/g$. An average particle diameter is a volume average particle diameter (d50 average particle diameter) and a value measured by a laser diffraction scattering particle size distribution analyzer (LA-700: trade name, manufactured by Horiba Ltd.,). The BET specific surface area is a value measured by a nitrogen substitution method using a BET specific surface area analyzer (trade name: FLOWSORB 112300, manufactured by Shimadzu Corporation).

When the average particle diameter is larger than 0.20 μm, or when the specific surface area is less than 45 $m^2/g$, pigment particles are coarsened or aggregates of pigment particles are formed. The characteristics such as dispersibility, sensitivity, chargeability or dark attenuation characteristics when used as a material for an electrophotographic photoreceptor tend to be deteriorated to result in image defect.

A maximum particle diameter (a maximum value of a primary particle diameter) of the hydroxygallium phthalocyanine pigment is preferably 1.2 μm or less, more preferably 1.0 μm or less and still more preferably 0.3 μm or less. When the maximum particle diameter exceeds the foregoing range, minute black spots tend to be generated.

From the viewpoint of more unfailingly inhibiting the density unevenness caused by exposing an electrophotographic photoreceptor to a fluorescent lamp from occurring, the hydroxygallium phthalocyanine pigment preferably has an average particle diameter of 0.2 μm or less, the maximum particle diameter of 1.2 μm or less and the specific surface area of 45 $m^2/g$ or more.

The hydroxygallium phthalocyanine pigment preferably has diffraction peaks at 7.5°, 9.9°, 12.5°, 16.3°, 18.6°, 25.1° and 28.3° by a Bragg angle (2θ±0.2°) in an X-ray diffraction spectrum obtained using CuKα characteristic X-ray.

The hydroxygallium phthalocyanine pigment preferably has a thermal weight reduction rate, when heated from 25° C. to 400° C. preferably of from 2.0% to 4.0% and more preferably of from 2.5% to 3.8%. The thermal weight reduction rate is measured with a thermal balance. When the thermal weight reduction rate exceeds 4.0%, an impurity contained in the hydroxygallium phthalocyanine pigment adversely affects on an electrophotographic photoreceptor to be likely to deteriorate the sensitivity characteristics, stability of a potential during repeating usage and image quality. On the other hand, when the thermal weight reduction rate is less than 2.0%, the sensitivity tends to decrease. It is thought that this is because a hydroxygallium phthalocyanine pigment interacts with solvent molecules slightly contained in a crystal to exhibit a sensitization action.

When the hydroxygallium phthalocyanine pigment is used as a charge generating material of an electrophotographic photoreceptor, it is particularly advantageous in that optimum sensitivity and excellent photoelectric characteristics of a photoreceptor are obtained and the dispersibility in a binder resin contained in a photosensitive layer is excellent to be excellent in image quality characteristics.

A binder resin used in the charge generating layer 2 is selected from a wide range of insulating resins and may be selected from organic photoconductive polymers such as poly-N-vinyl carbazole resins, polyvinyl anthracene resins, polyvinyl pyrene resins, or poly-silane. Examples of preferable binder resin include a polyvinyl butyral resins, a polyarylate resins (a polycondensate of bisphenols and aromatic divalent carboxylic acid), a polycarbonate resins, a polyester resins, a phenoxy resins, a vinyl chloride-vinyl acetate copolymer resins, a polyamide resins, an acryl resins, a polyacrylamide resins, a polyvinyl pyridine resins, a cellulose resins, a urethane resins, an epoxy resins, casein, a polyvinyl alcohol resins, and a polyvinyl pyrrolidone resins. The binder resins may be used alone or in a mixture of at least two of them. A blending ratio of the charge generating material and the binder resin is, by weight ratio, preferably in the range of 10/1 to 1/10. Herein, the term "insulating" means the volume resistivity of $10^{13}$ Ωcm or more.

The charge generating layer 2 is formed by use of a coating solution for forming the charge generating layer in which the charge generating material and the binder resin are dissolved in a predetermined solvent.

Examples of solvent used in dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These may be used alone or in a mixture at least two of them.

As a method for dispersing a charge generating material and a binder resin in a solvent, a standard dispersion method such as a ball mill dispersion method, an attritor dispersion method, or a sand mill dispersion method is used. By use of the dispersion method, a crystal structure of a charge generating material is inhibited from varying caused by dispersion.

At dispersing, it is effective that an average particle diameter of the charge generating material is set at 0.5 μm or less, preferably at 0.3 μm or less and more preferably 0.15 μm or less.

When the charge generating layer 2 is formed, a standard coating method such as a blade coating method, a Meyer bar coating method, a spray coating method, a dip coating method, a bead coating method, an air knife coating method, or a curtain coating method is used.

A film thickness of thus obtained charge generating layer 2 is preferably from 0.1 μm to 5.0 μm and more preferably from 0.2 μm to 2.0 μm.

<Charge Transport Layer>

The charge transport layer 3 is formed by containing a charge transporting material and a binder resin, or by containing a polymer charge transporting material.

Examples of the charge transporting material include electron transporting compounds such as a quinone compound such as p-benzoquinone, chloranyl, bromanyl, or anthraquinone, a tetracyanoquinodimethane compound, a fluorenone compound such as 2,4,7-trinitrofluorenone, a xanthone compound, a benzophenone compound, a cyanovinyl compound, and an ethylene compound; and hole transporting compounds such as a triarylamine compound, a benzidine compound, an arylalkane compound, an aryl-substituted ethylene compound, a stilbene compound, an anthracene compound and a hydrazone compound. The charge transporting materials may be used alone or in a mixture of at least two of them without restricting thereto.

As the charge transporting material, a triarylamine derivative represented by a structural formula (a-1) shown below and a benzidine derivative represented by structural formula (a-2) shown below are preferable from the viewpoint of charge mobility.

(a-1)

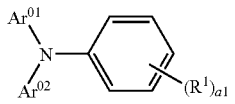

In structural formula (a-1), $R^1$ represents a hydrogen atom or a methyl group. a1 represents 1 or 2. $Ar^{01}$ and $Ar^{02}$ each independently represent a substituted or unsubstituted aryl group, $—C_6H_4—C(R^2)=C(R^3)(R^4)$ or $—C_6H_4—CH=CH—CH=C(R^5)(R^6)$, and $R^2$ to $R^6$ each independently represent a hydrogen atom, a substituted or unsubstituted alkyl group, or a substituted or unsubstituted aryl group.

Wherein, examples of substituent of the respective groups include a halogen atom, an alkyl group having from 1 to 5 carbon atoms, an alkoxy group having from 1 to 5 carbon atoms, or a substituted amino group substituted by an alkyl group having from 1 to 3 carbon atoms.

(a-2)

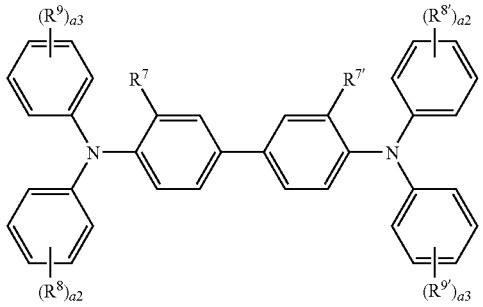

In structural formula (a-2), $R^7$ and $R^{7'}$ each independently represent a hydrogen atom, a halogen atom, an alkyl group having from 1 to 5 carbon atoms, or an alkoxy group having from 1 to 5 carbon atoms. $R^8$, $R^{8'}$, $R^9$ and $R^{9'}$ each independently represent a hydrogen atom, a halogen atom, an alkyl group having from 1 to 5 carbon atoms, an alkoxy group having from 1 to 5 carbon atom, an amino group substituted by an alkyl group having 1 or 2 carbon atoms, a substituted or unsubstituted aryl group, $—C(R^{10})=C(R^{11})(R^{12})$, or $—CH=CH—CH=C(R^{13})(R^{14})$, and $R^{10}$ to $R^{14}$ each independently represent a hydrogen atom, a substituted or unsubstituted alkyl group, or a substituted or unsubstituted aryl group. a2 and a3 each independently represent an integer of from 0 to 2.

Wherein, among triarylamine derivatives represented by structural formula (a-1) and benzidine derivatives represented by structural formula (a-2), in particular, a triarylamine derivative having "$—C_6H_4—CH=CH—CH=C(R^5)(R^6)$" and a benzidine derivative having "$—CH=CH—CH=C(R^{13})(R^{14})$" are excellent and preferable from the viewpoints of charge mobility, adhesive property to a protective layer, and an afterimage generated when hysteresis of a previous image remains (hereinafter, in some cases, referred to as "ghosting").

Examples of the binder resin used in the charge transport layer 3 include polycarbonate resins, polyester resins, polyarylate resins, methacryl resins, acryl resins, polyvinyl chloride resins, polyvinylidene chloride resins, polystyrene resins, polyvinyl acetate resins, styrene-butadiene copolymer resins, vinylidene chloride-acrylonitrile copolymer resins, vinyl chloride-vinyl acetate copolymer resins, vinyl chloride-vinyl acetate-maleic anhydride copolymer resins, silicone resins, silicone-alkyd resins, phenol-formaldehyde resins, styrene-alkyd resins, poly-N-vinyl carbazole resins and polysilane. The binder resins may be used alone or in a mixture of at least two of them. A blending ratio of the charge transporting material and the binder resin is preferably from 10/1 to 1/5 by weight ratio.

The binder resin is not particularly restricted. However, at least one of a polycarbonate resin having a viscosity average molecular weight of from 50000 to 80000 and a polyallylate resin having a viscosity average molecular weight of from 50000 to 80000 is preferable because an excellent film is readily obtained.

A polymer charge transporting material may be used as a charge transporting material. As the polymer charge transporting material, a known charge transporting material having the charge transporting property such as poly-N-vinylcarbazole or polysilane may be used. In particular, polyester charge transporting materials disclosed in JP-A Nos. 08-176293 and 08-208820 are particularly preferable because these have high charge transporting property as compared with other species. The polymer charge transporting material may be formed into a film by itself or may be formed into a film by mixing with the binder resin described above.

The charge transport layer 3 is formed using a coating solution for forming the charge transfer layer containing the above constituent materials.

Examples of a solvent used in the coating solution for forming the charge transfer layer include ordinary organic solvents such as aromatic hydrocarbons such as benzene, toluene, xylene, or chlorobenzene, ketones such as acetone or 2-butanone, halogenated aliphatic hydrocarbons such as methylene chloride, chloroform, or ethylene chloride, cyclic or straight chain ethers such as tetrahydrofuran or ethyl ether. These may be used alone or in a mixture of at least two of them. As a method for dispersing the respective constituent materials, a known method may be used:

As a coating method when the coating solution for forming the charge transfer layer is coated on the charge generating layer 2, an ordinary method such as a blade coating method, a Meyer bar coating method, a spray coating method, a dip coating method, a bead coating method, an air knife coating method or a curtain coating method may be used.

A film thickness of the charge transporting layer 3 is preferably from 5 μm to 50 μm and more preferably from 10 μm to 30 μm.

<Protective Layer>

A protective layer 5 is a layer that is an outermost surface layer of an electrophotographic photoreceptor 7A and formed to impart resistance to wear or scratch of an outermost surface and to improve a transfer efficiency of a toner.

Since the protective layer 5 is the outermost surface layer, it is a layer made of a cured material of a composition containing at least one of compounds represented by formula (I) shown below and at least one of compounds having charge transportability and an azo group.

(I)

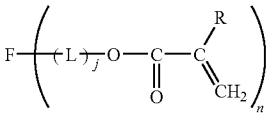

In formula (I), F represents an organic group having a valency of n and having a hole transporting property, R represents a hydrogen atom or an alkyl group, L represents a divalent organic group, n represents an integer of 1 or more, and j represents 0 or 1.

(Compounds Represented by Formula (I))

At first, compounds represented by formula (I) will de described.

F in formula (I) represents an organic group having a valency of n and n-valent organic group having a hole transporting property. As the organic group, an organic group derived from an arylamine derivative, that is, an organic group obtained by removing n hydrogen atoms from an arylamine derivative is cited. Among arylamine derivatives, an organic group having a valency of n, which is derived from an arylamine derivative such as a triphenylamine derivative or a tetraphenylbenzidine derivative is preferable.

Then, n in formula (I) represents an integer of 1 or more. However, n is preferably 2 or more and more preferably 4 or more from the viewpoint of improving a crosslinking density and thereby obtaining a stronger crosslinked film (cured material). An upper limit value of n is preferably 20 and more preferably 10 from the viewpoints of stability of a coating solution and electric characteristics.

When n is set in the preferable range, rotating torque of an electrophotographic photoreceptor is reduced in particular when a blade cleaner is used; accordingly, damage to a blade and wear of the electrophotographic photoreceptor are inhibited from occurring. The details thereof are not elucidated. However, it is assumed that when a number of reactive functional groups increases, a cured film high in the crosslinking density is obtained, and thereby a molecular motion of a very surface of the electrophotographic photoreceptor is suppressed to weaken an interaction with molecules on a surface of a blade member.

Furthermore, R in formula (I) represents a hydrogen atom or an alkyl group. As the alkyl group, straight chain or branched alkyl groups having from 1 to 5 carbon atoms are preferable.

Among these, R is preferably a methyl group. That is, in a compound represented by formula (I), a terminal of a substituent in a parenthesis is preferably a methacryloyl group. Although a reason for this is not elucidated, inventors consider as shown below.

Usually, an acryl group high in the reactivity is used in a curing reaction. However, it is thought that, when an acryl group high in the reactivity is used as a substituent of a bulky charge transporting material like a compound represented by formula (I), an inhomogeneous curing reaction tends to occur to result into a micro (or macro)-sea-island structure. The sea-island structure like this is not particularly problematic in a field other than an electronic field. However, when the sea-island structure is used for an electrophotographic photoreceptor, problems such as unevenness or crimp in the outmost surface layer or density unevenness are caused. Accordingly, R is preferable to be a methyl group.

It is thought that formation of such sea-island structure is particularly noticeable when plural functional groups attaches to one charge transporting structure (F in formula (I)).

Furthermore, L in formula (I) represents a divalent organic group. As the divalent organic group, an organic group containing an alkylene group having 2 or more carbon atoms is preferable. Still furthermore, j is preferably 1 from the viewpoints of electric characteristics and mechanical strength. A reason why such a structure is preferable is not necessarily elucidated. However, the inventors consider as shown below.

That is, it is thought that, in the case where, like a compound represented by formula (I), a radically polymerizable substituent is polymerized, when a radical generated during polymerization has a structure readily moving to F in a charge transporting structure (F in formula (I)), the generated radical deteriorates a charge transporting function to result in deterioration of electric characteristics. Furthermore, concerning the mechanical strength, it is thought that, when a bulky charge transporting structure and a polymerizable site are positioned near to each other and rigid, polymerizable sites are difficult to move each other to result in remarkably deteriorating reacting probability. From these reasons, it is thought that it is preferable for L to contain an alkylene group having two or more carbon atoms and for j to be 1.

Herein, when L is an organic group containing an alkylene group having two or more carbon atoms, the organic group may be constituted of only an alkylene group having two or more carbon atoms or a combination of an alkylene group having two or more carbon atoms and a divalent group such as alkenylene, alkynylene, ether, thioether, ester or arylene (for example, phenylene). An upper limit value of a number of carbon atoms of an alkylene group is preferably 20 and more preferably 10 from the viewpoint of mechanical strength.

The compound represented by formula (I) is preferably a compound represented by formula (II) shown below.

The compound represented by formula (II) is excellent in particular in the stability to charge mobility and oxidation.

(II)

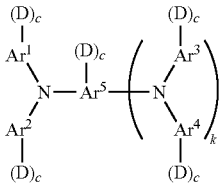

In formula (II), $Ar^1$ to $Ar^4$ each independently represent a substituted or unsubstituted aryl group, $Ar^5$ represents a substituted or unsubstituted aryl group or a substituted or unsubstituted arylene group, D represents $-(L)_j-O-CO-C(R)=CH_2$, L represents a divalent organic group, j represents 0 or 1, five cs each independently represent 0 or 1, k represents 0 or 1, and the total number of Ds is 1 or more. Furthermore, R represents a hydrogen atom or a straight chain or branched alkyl group having from 1 to 5 carbon atoms.

The total number of Ds in formula (II) corresponds to n in formula (I) and is preferably 2 or more and more preferably 4 or more from the viewpoint of improving the crosslinking density and being able to obtain a crosslinked film (cured material) higher in the mechanical strength as mentioned above.

R is, as mentioned above, preferably a methyl group.

In formula (II), $Ar^1$ to $Ar^4$ each independently represent a substituted or unsubstituted aryl group. $Ar^1$ to $Ar^4$ may be the same as each other or may be different from each other.

Herein, as a substituent in the substituted aryl group, other than D: $-(L)_j-O-CO-C(R)=CH_2$, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom are cited.

$Ar^1$ to $Ar^4$ each are preferably any one of structural formulas (1) to (7) shown below. The structural formulas (1 ) to (7) shown below are shown together with "-(D)c" that is linkable with each of $Ar^1$ to $Ar^4$. Herein, "-(D)c" has the same meaning as "-(D)c" in formula (II), and preferable examples as well are similar to those in formula (II).

(1)

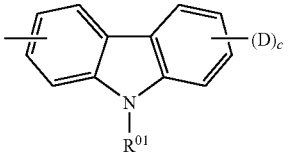

(2)

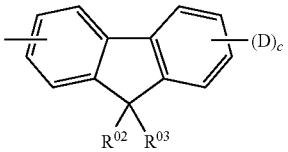

(3)

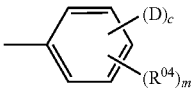

(4)

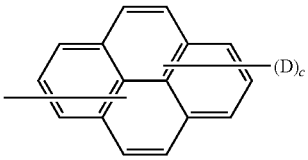

(5)

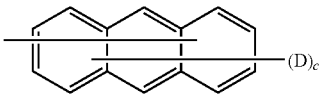

(6)

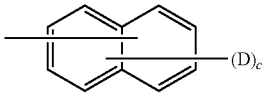

(7)

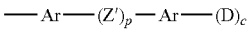

In structural formula (1), $R^{01}$ represents one selected from the group consisting of a hydrogen atom, an alkyl group having from 1 to 4 carbon atoms, a phenyl group substituted by an alkyl group having from 1 to 4 carbon atoms or an alkoxy group having from 1 to 4 carbon atoms, an unsubstituted phenyl group, and an aralkyl group having from 7 to 10 carbon atoms.

In structural formulas (2) and (3), $R^{02}$ to $R^{04}$ each independently represent one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom. Furthermore, m represents an integer of from 1 to 3.

In structural formula (7), Ar represents a substituted or unsubstituted arylene group.

Herein, Ar in formula (7) is preferably represented by structural formula (8) or (9) shown below.

(8)

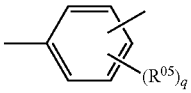

(9)

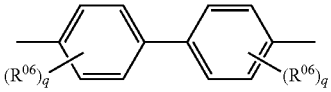

In structural formulas (8) and (9), $R^{05}$ and $R^{06}$ each independently represent one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom. Furthermore, qs each represent an integer of from 1 to 3.

In structural formula (7), Z' represents a divalent organic linking group and is preferably represented by any one of structural formulas (10) to (17) shown below. Furthermore, p represents 0 or 1.

(10)

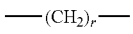

(11)

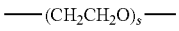

(12)

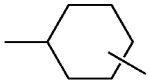

(13)

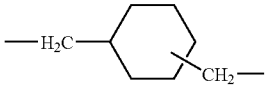

(14)

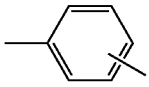

(15)

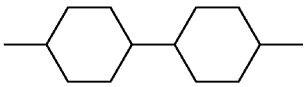

(16)

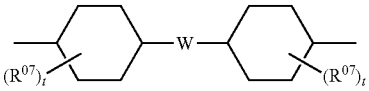

(17)

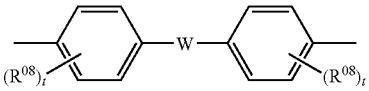

In structural formulas (10) to (17), $R^{07}$ and $R^{08}$ each independently represent one selected from a group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom, W represents a divalent group, r and s each independently represent an integer of from 1 to 10 , and ts each represent an integer of from 1 to 3.

Furthermore, W in structural formulas (16) to (17) is preferably any one of divalent groups represented by (18) to (26). However, in formula (25), u represents an integer of from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

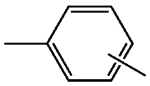

(25)

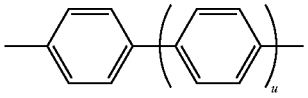

(26)

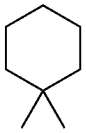

In formula (II), $Ar^5$ is a substituted or unsubstituted aryl group when k is 0, and, as the aryl group, aryl groups similar to those exemplified in the description of $Ar^1$ to $Ar^4$ are cited. $Ar^5$ is a substituted or unsubstituted arylene group when k is 1, and, as the arylene group, an arylene group obtained by removing one hydrogen atom at a predetermined site from an aryl group exemplified in the description of $Ar^1$ to $Ar^4$ is cited.

Hereinafter, specific examples of the compound represented by formula (I) will be shown. Compounds represented by formula (I) are not at all restricted thereto.

In the beginning, specific examples (compounds i-1 to i-13) when n in formula (I) is 1 are shown without restricting thereto.

| No. | |
|---|---|
| i-1 | 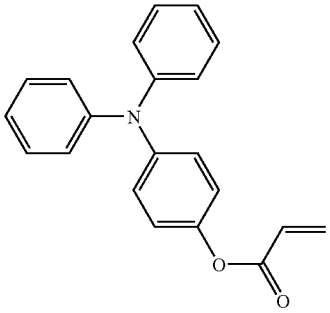 |

-continued

| No. | |
|---|---|
| i-2 | 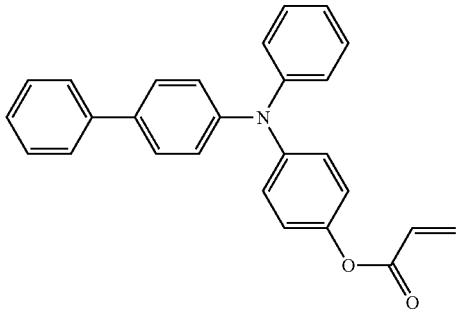 |
| i-3 | 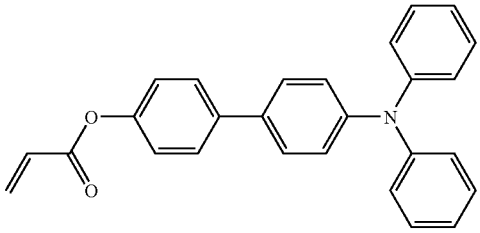 |
| i-4 | 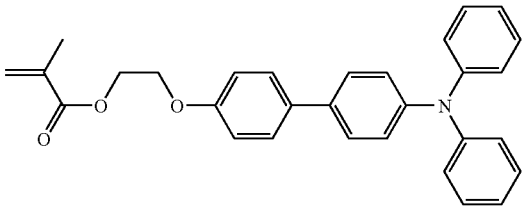 |
| i-5 | 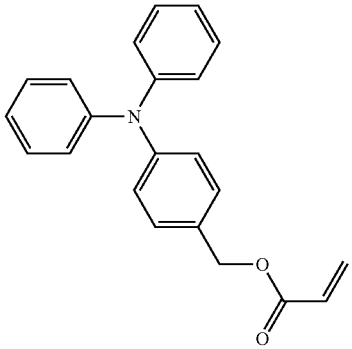 |
| i-6 | 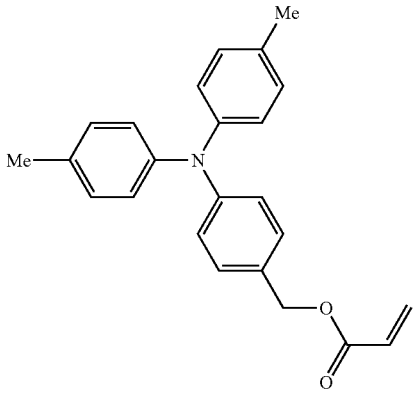 |

-continued
No.
i-7
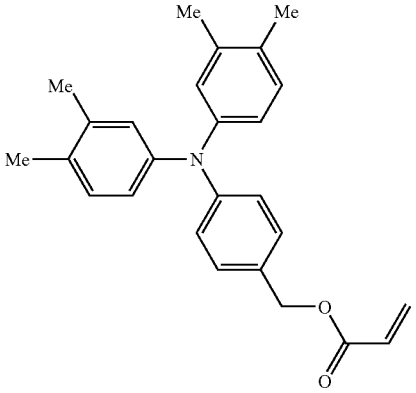
i-8
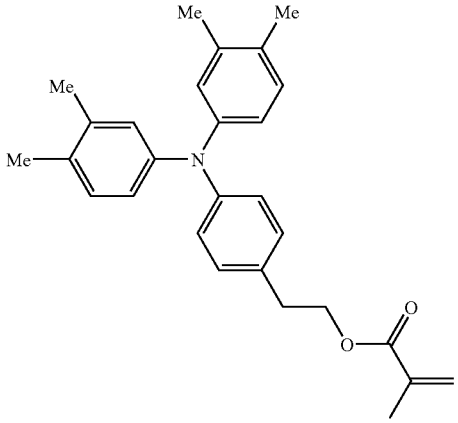
i-9
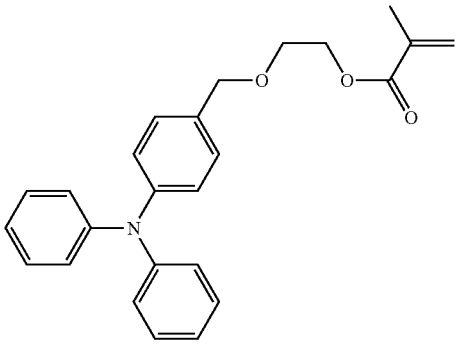
i-10
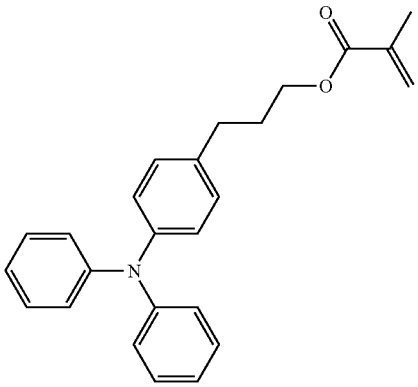
-continued
No.
i-11
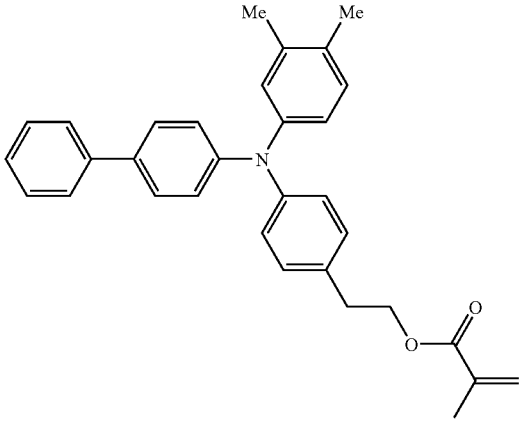
i-12
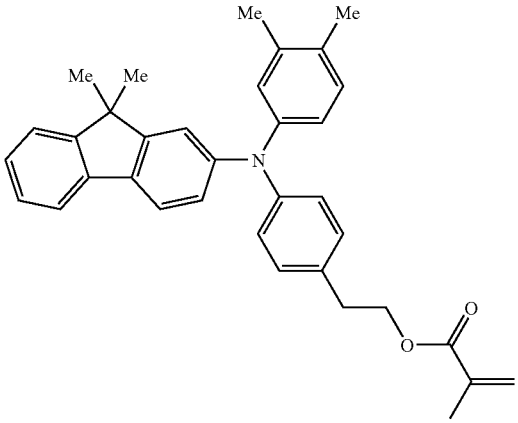
i-13
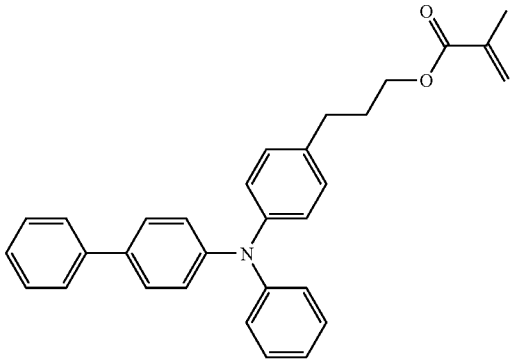
Hereinafter, specific examples (compounds ii-1 to ii-23) when n in formula (I) is 2 are shown without restricting thereto.

| No. | |
|---|---|
| ii-1 | 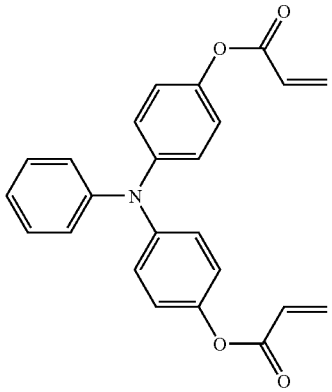 |
| ii-2 | 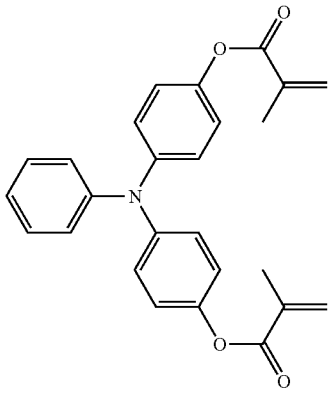 |
| ii-3 | 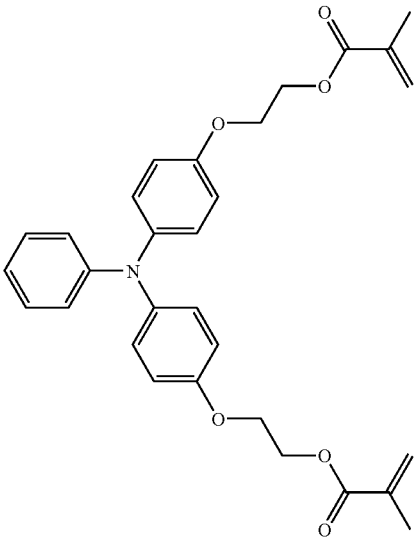 |

-continued
| No. | |
|---|---|
| ii-4 | 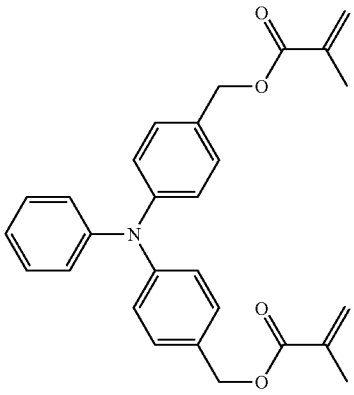 |
| ii-5 | 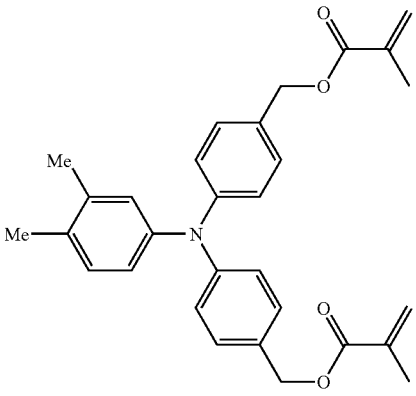 |
| ii-6 | 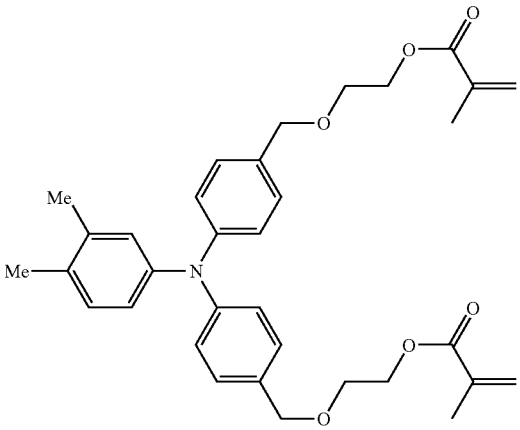 |

-continued
| No. | |
|---|---|
| ii-7 | 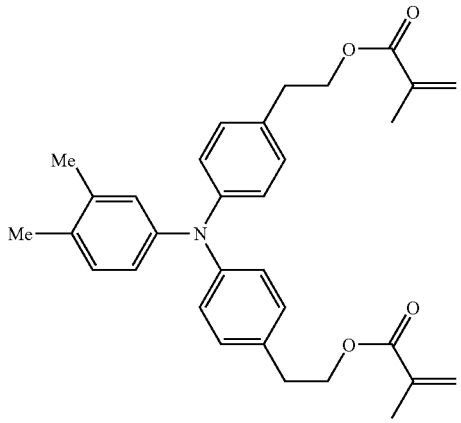 |
| ii-8 | 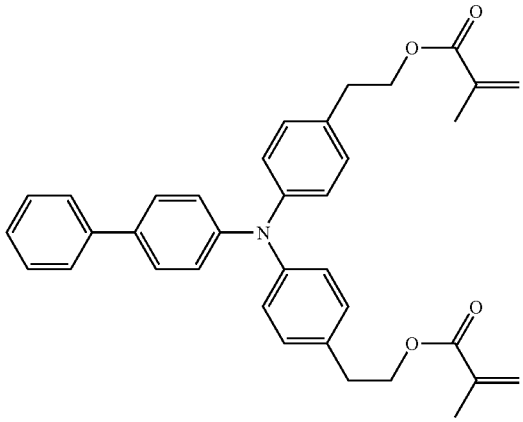 |
| ii-9 | 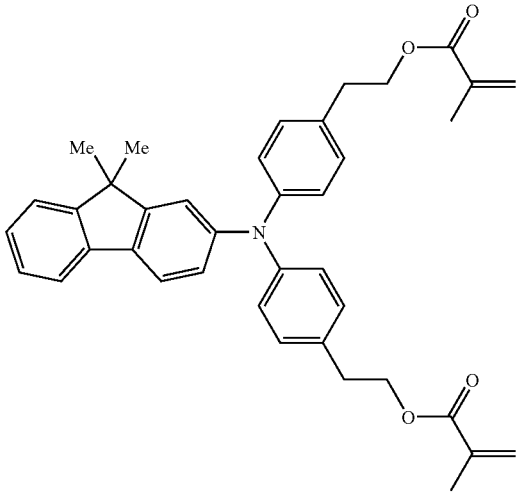 |

-continued
| No. | |
|---|---|
| ii-10 | 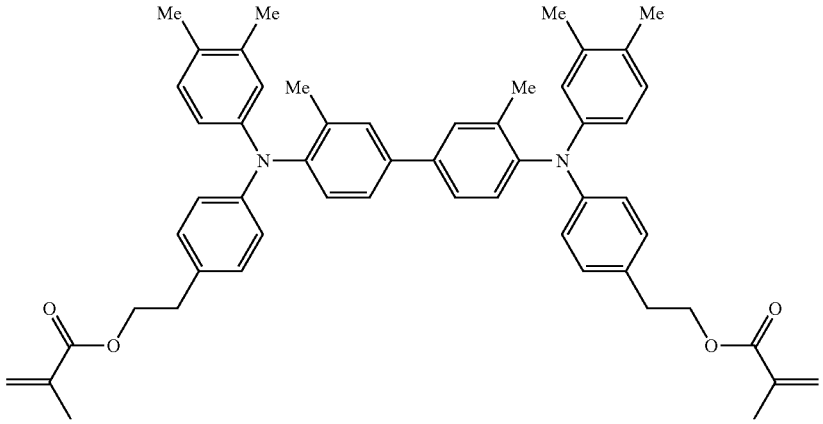 |
| ii-11 | 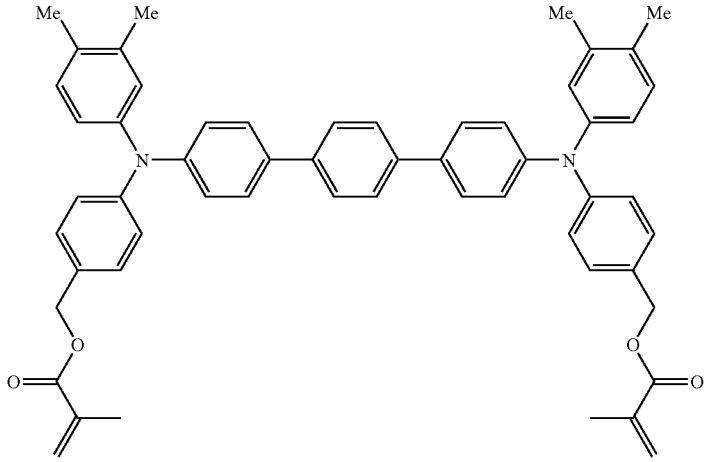 |
| ii-12 | 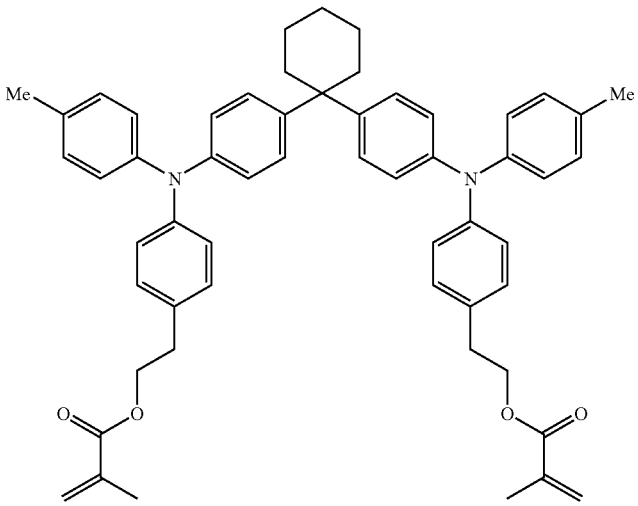 |

-continued
No.
ii-13
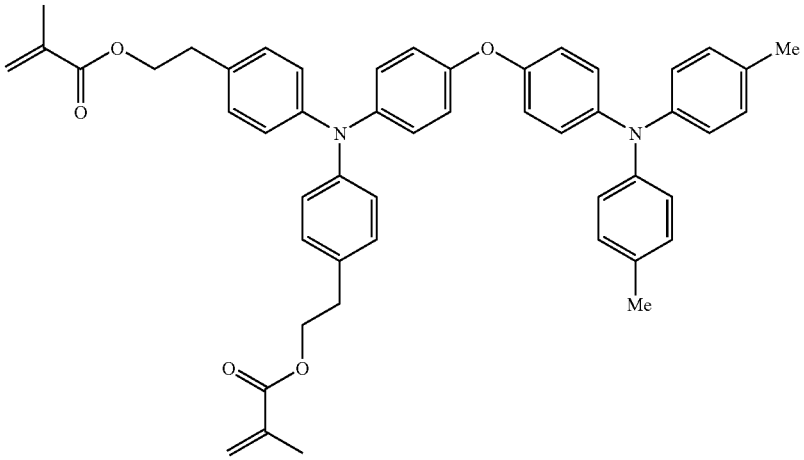
ii-14
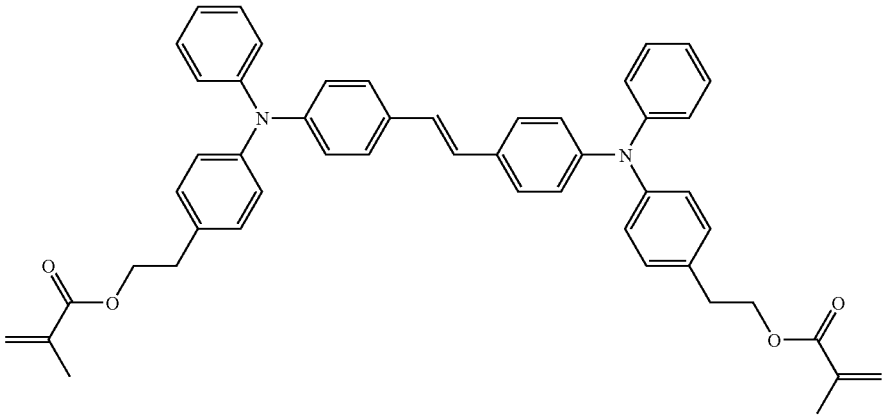
ii-15
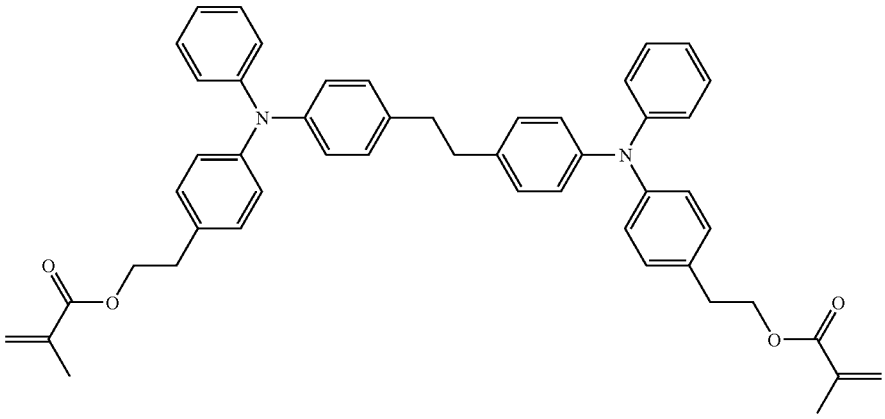

-continued
| No. | |
|---|---|
| ii-16 | 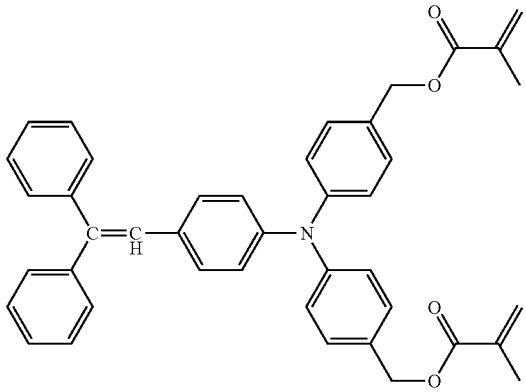 |
| ii-17 | 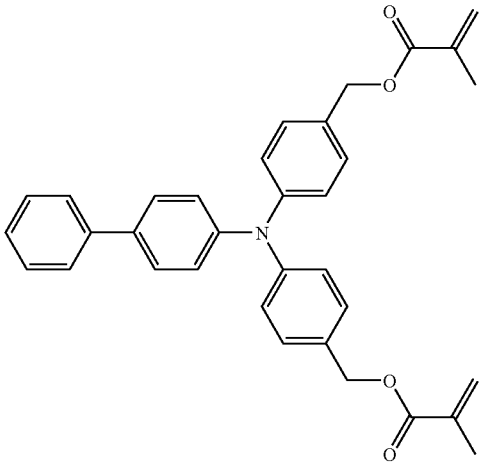 |
| ii-18 | 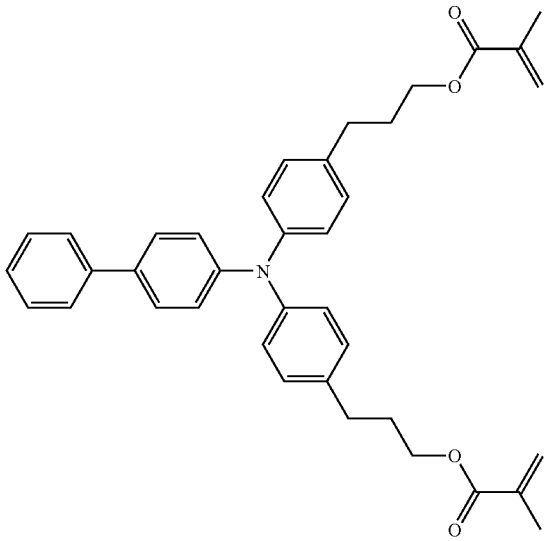 |

-continued
| No. | |
|---|---|
| ii-19 | 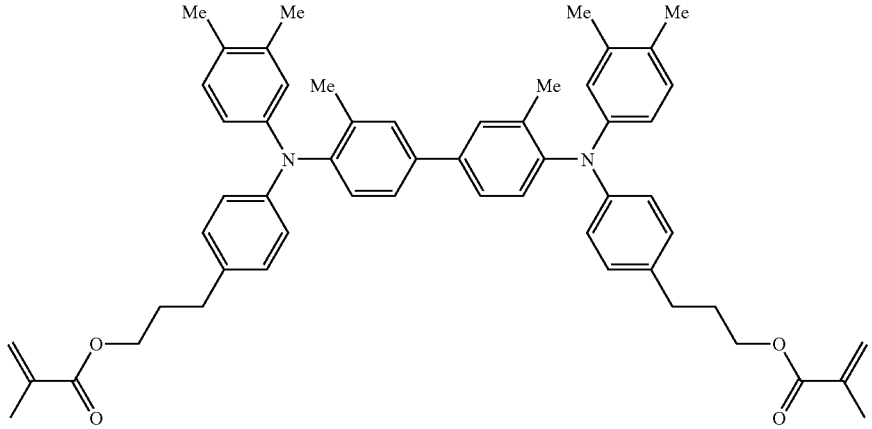 |
| ii-20 | 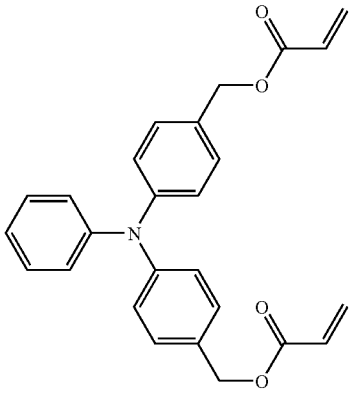 |
| ii-21 | 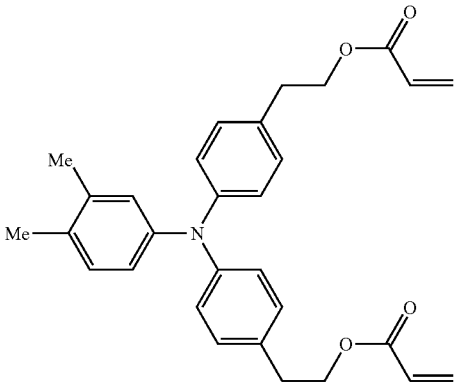 |

-continued
| No. | |
|---|---|
| ii-22 | 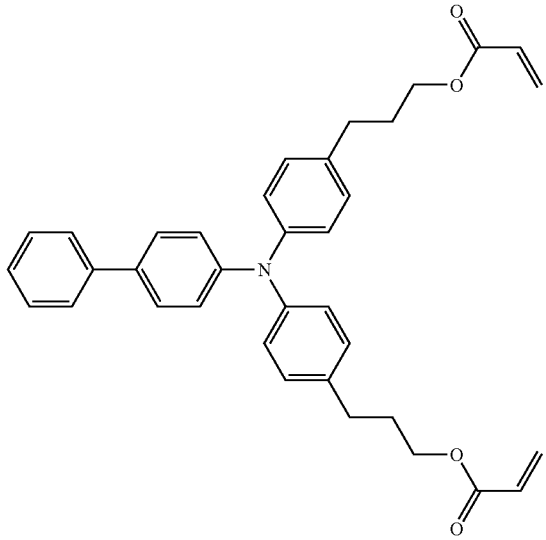 |
| ii-23 | 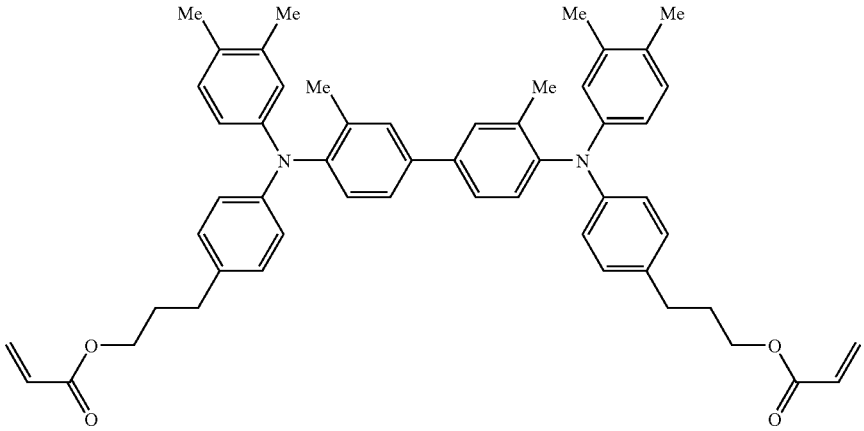 |
In the next place, specific examples (compounds iii-1 to iii-11) when n in formula (I) is 3 are shown without restricting thereto.
| No. | |
|---|---|
| iii-1 | 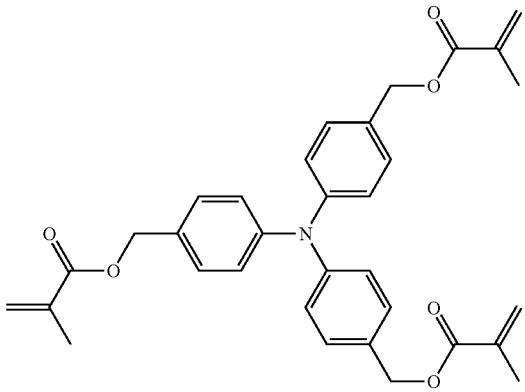 |

-continued
| No. |
| --- |
| iii-2 |
| iii-3 |
| iii-4 |
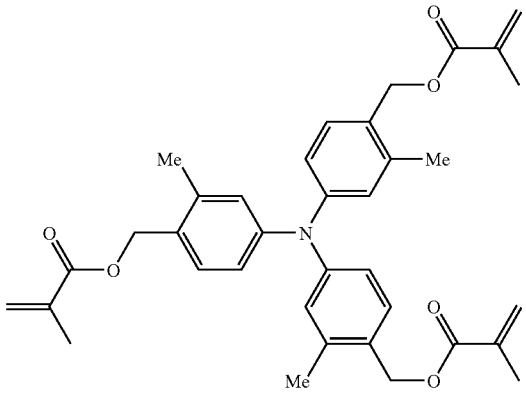
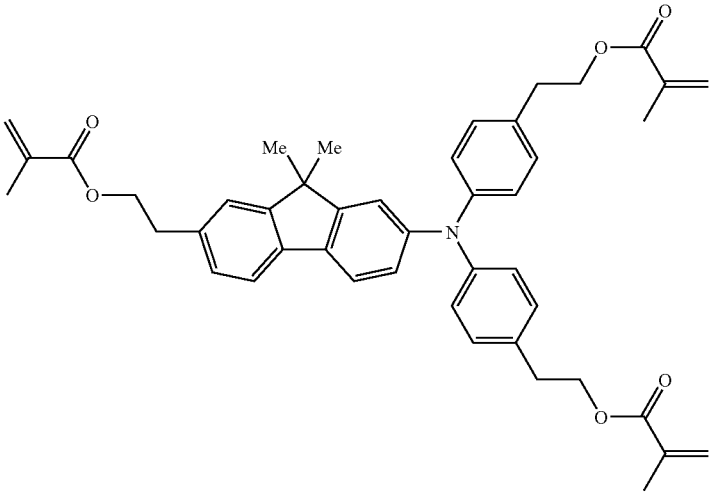
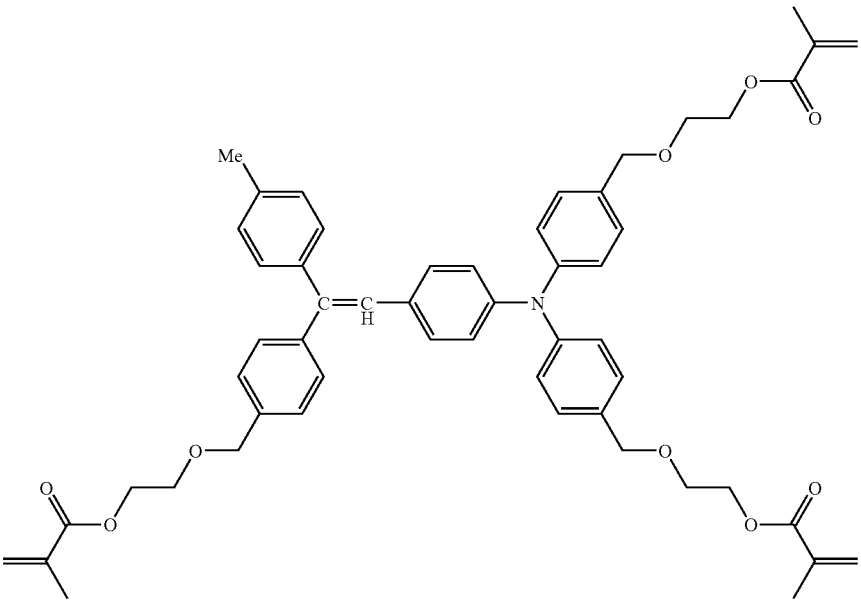

-continued
| No. |
| --- |
| iii-5 |
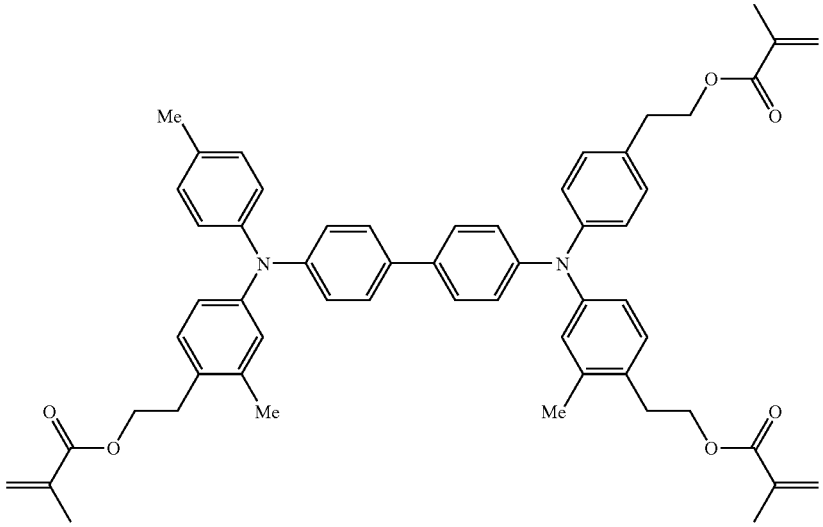
iii-6
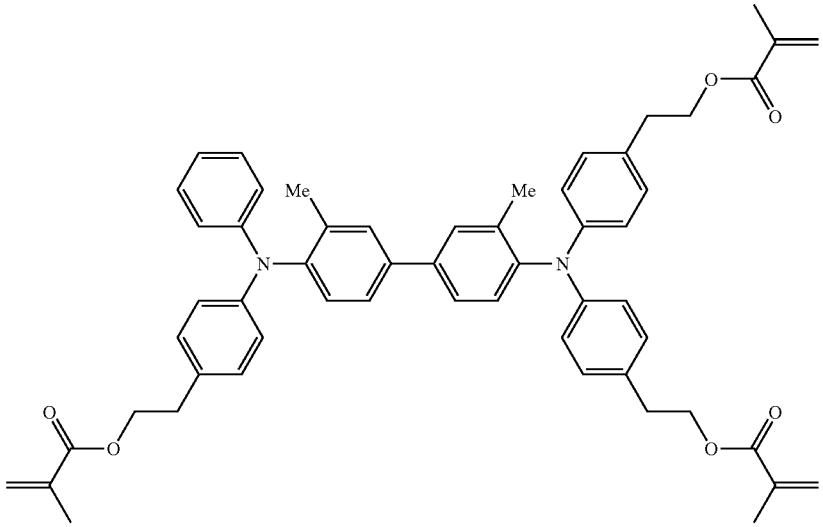
iii-7
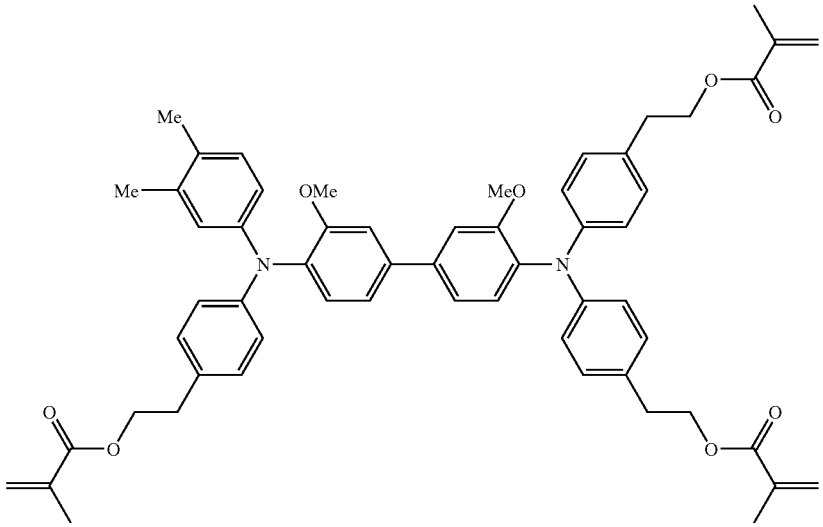

-continued
No.
iii-8
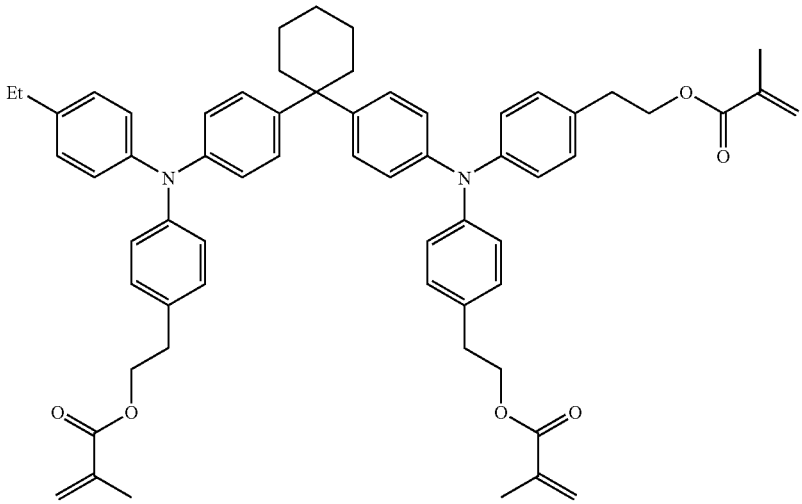
iii-9
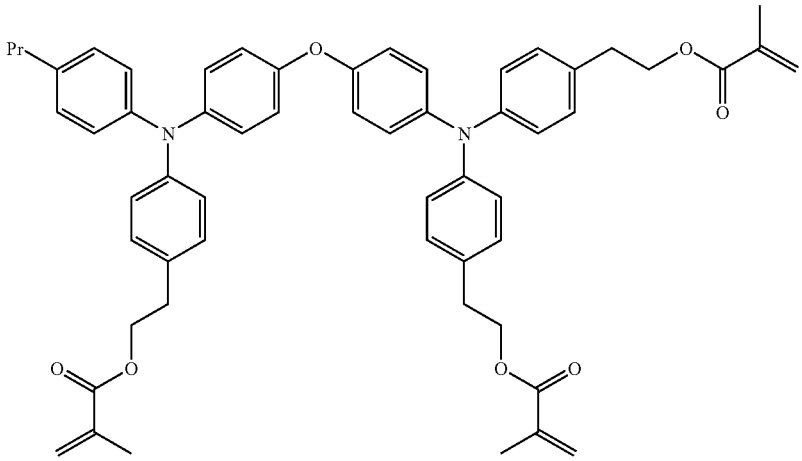
iii-10
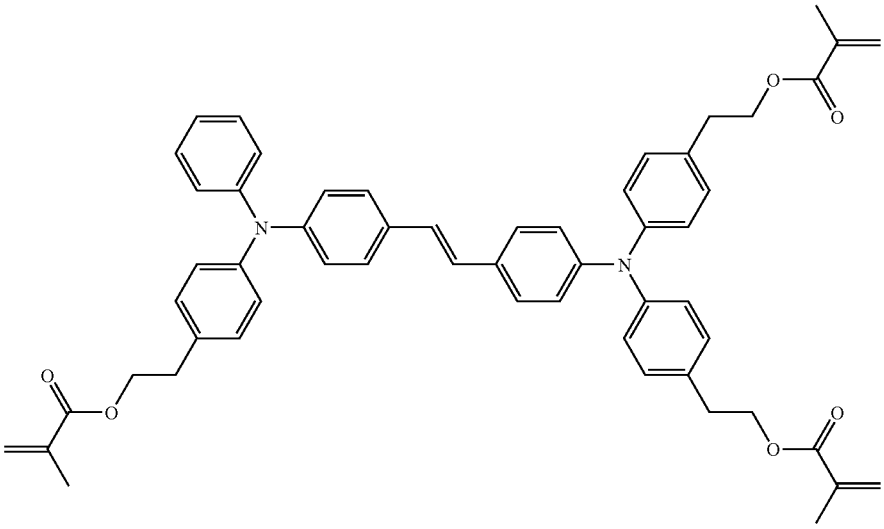

-continued
| No. | |
|---|---|
| iii-11 | 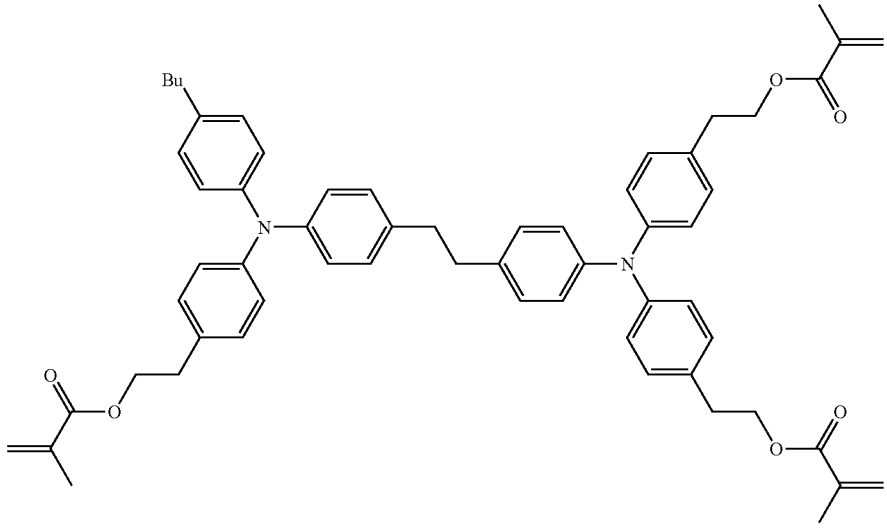 |
25
Then, specific examples (compounds iv-1 to iv-18) when n in formula (I) is 4, a specific example (compound v-1) when n in formula (I) is 5, and specific examples (compounds vi-1 and vi-2) when n in formula (I) is 6 are shown.
| No. | |
|---|---|
| iv-1 | 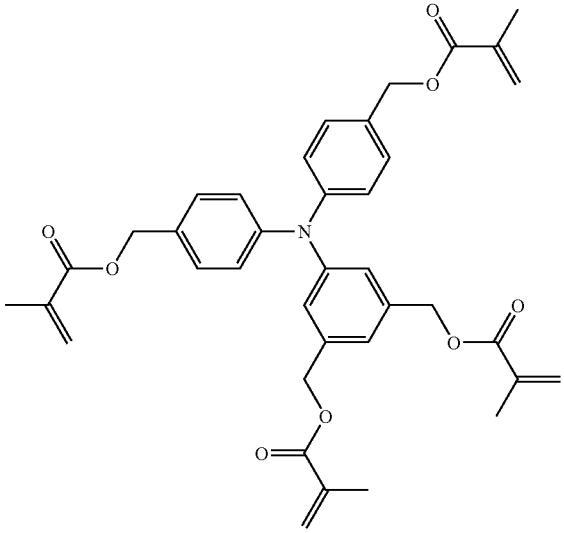 |
| iv-2 | 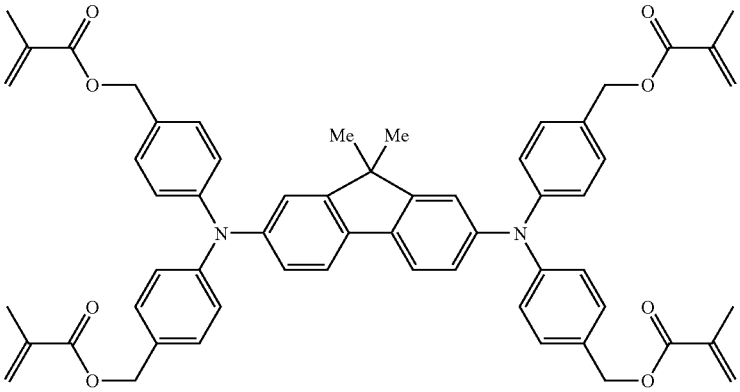 |

-continued
| No. | |
|---|---|
| iv-3 | 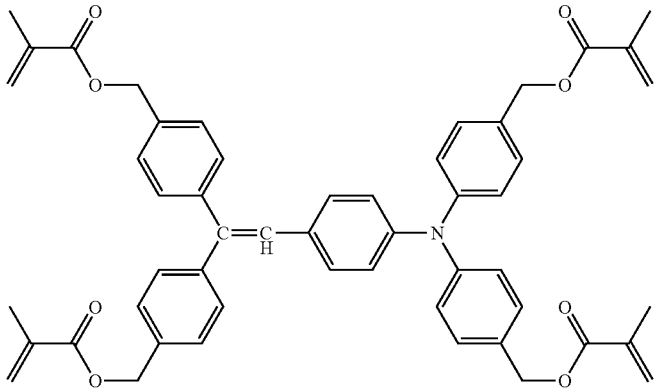 |
| iv-4 | 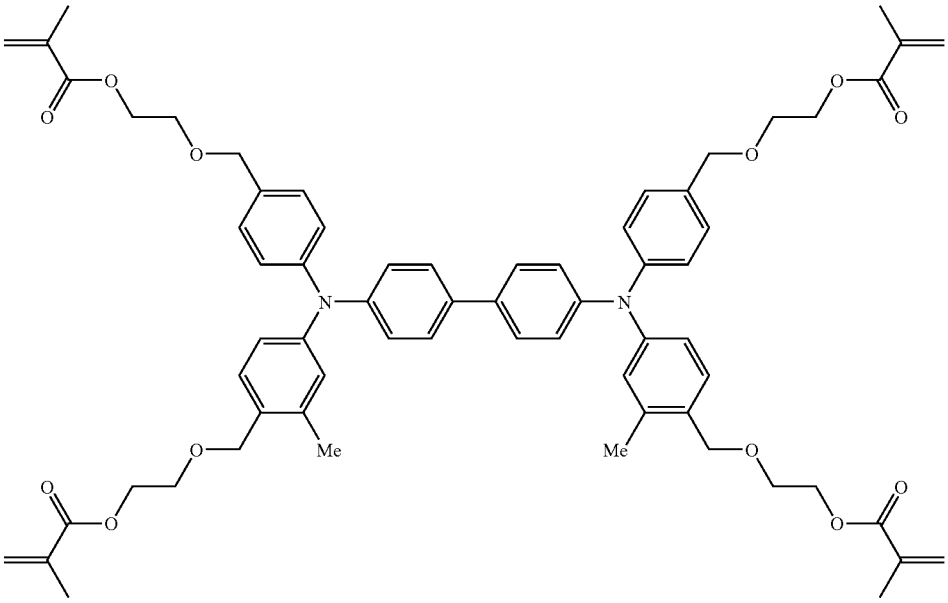 |
| iv-5 | 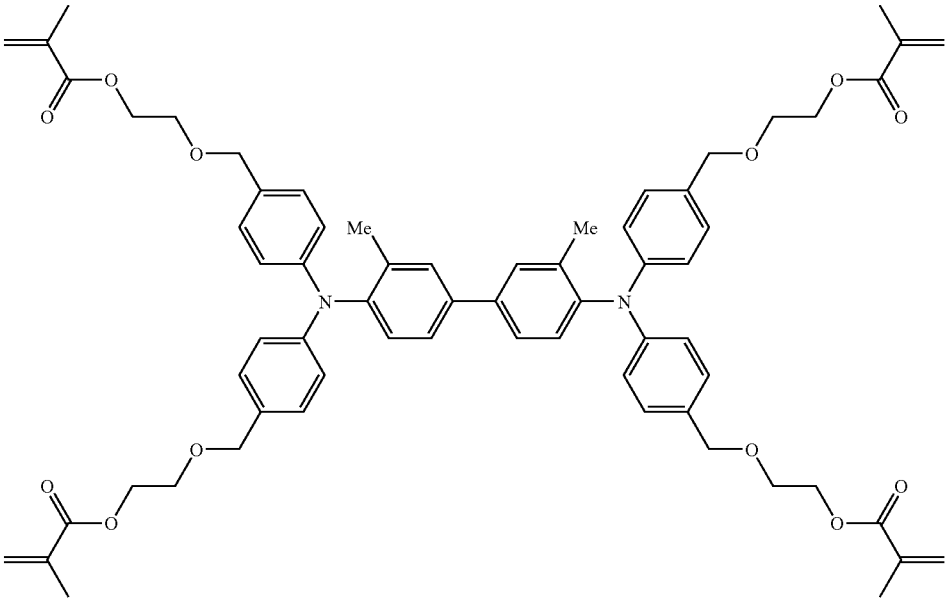 |

-continued
No.
iv-6
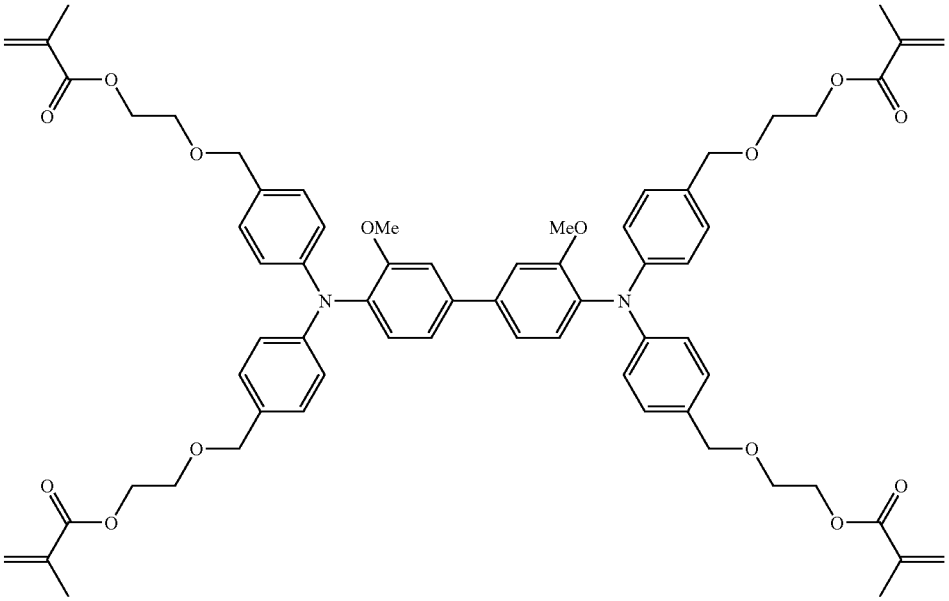
iv-7
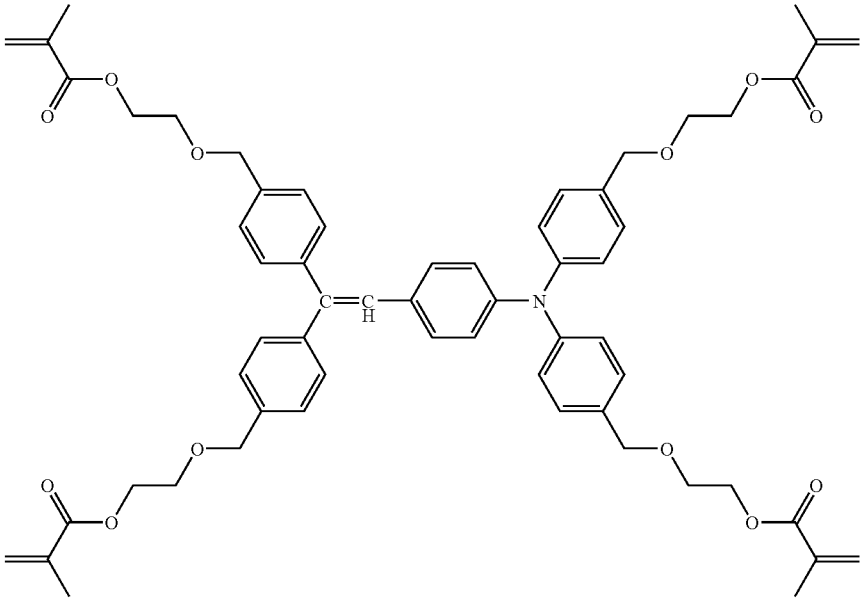

-continued
| No. | |
|---|---|
| iv-8 | 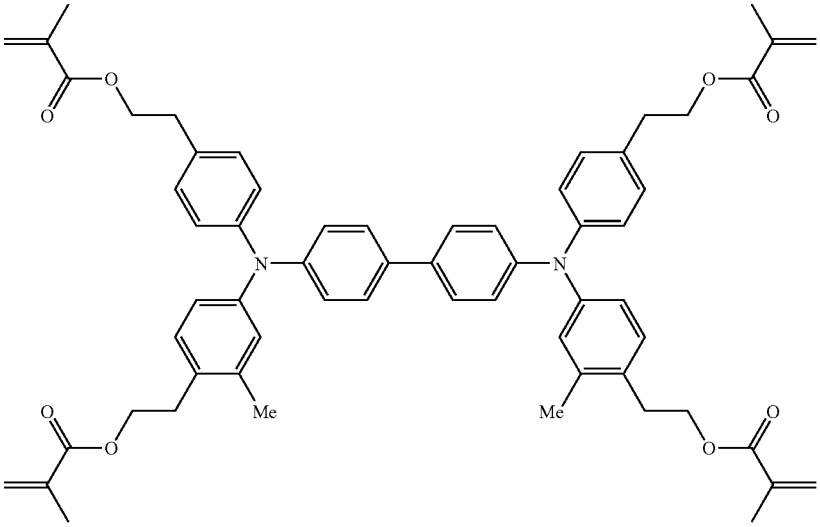 |
| iv-9 | 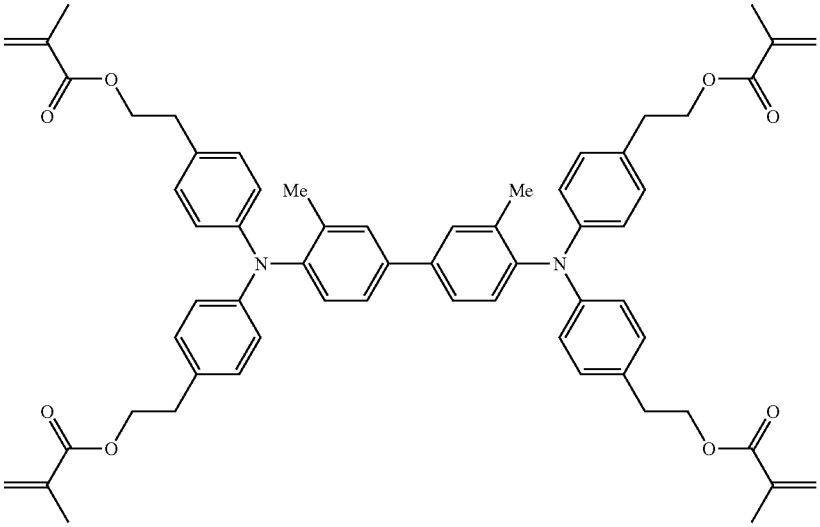 |
| iv-10 | 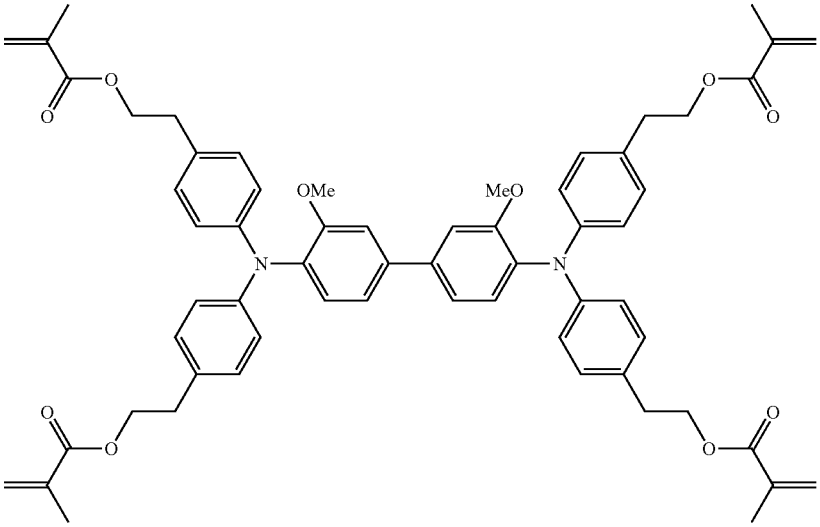 |

-continued
No.
iv-11
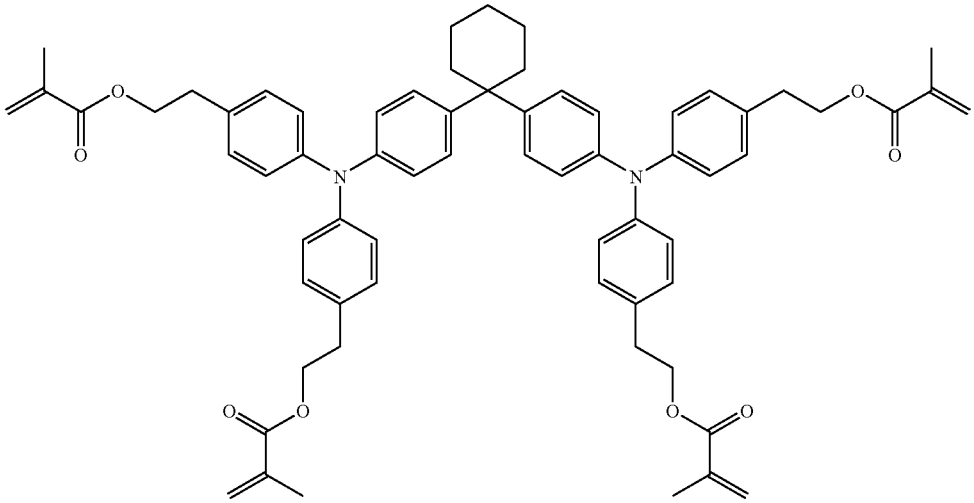
iv-12
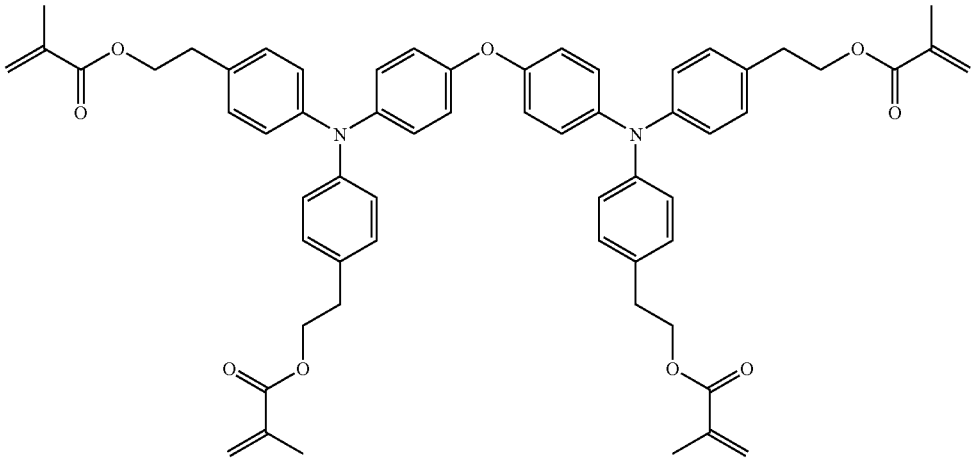
iv-13
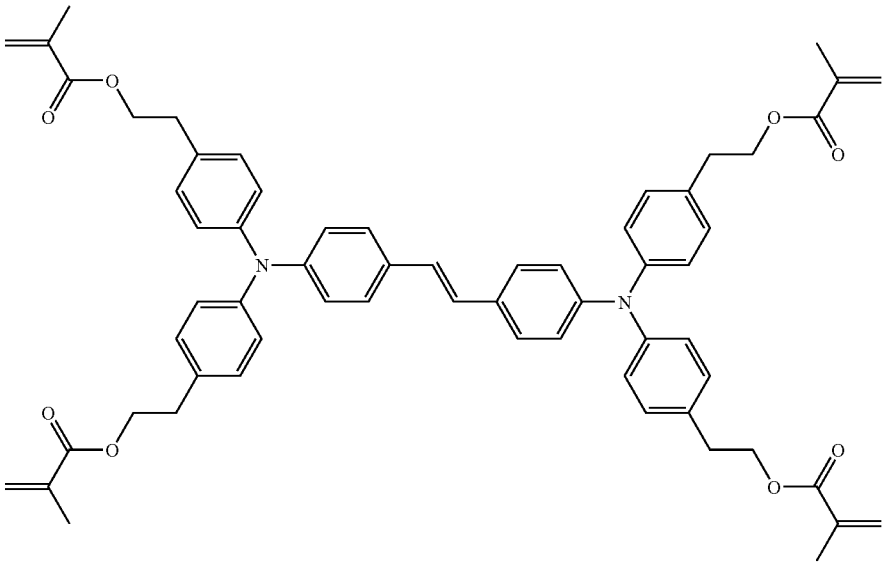

-continued
| No. | |
|---|---|
| iv-14 | 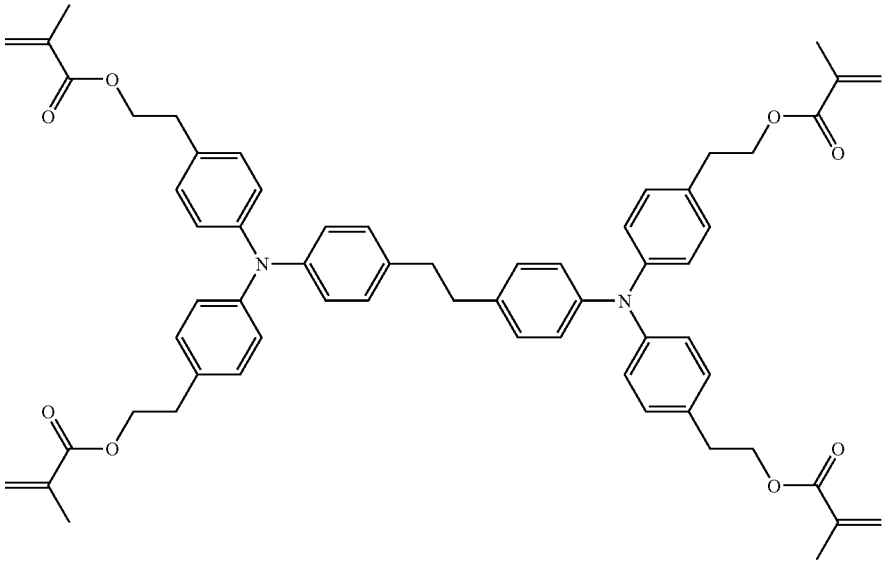 |
| iv-15 | 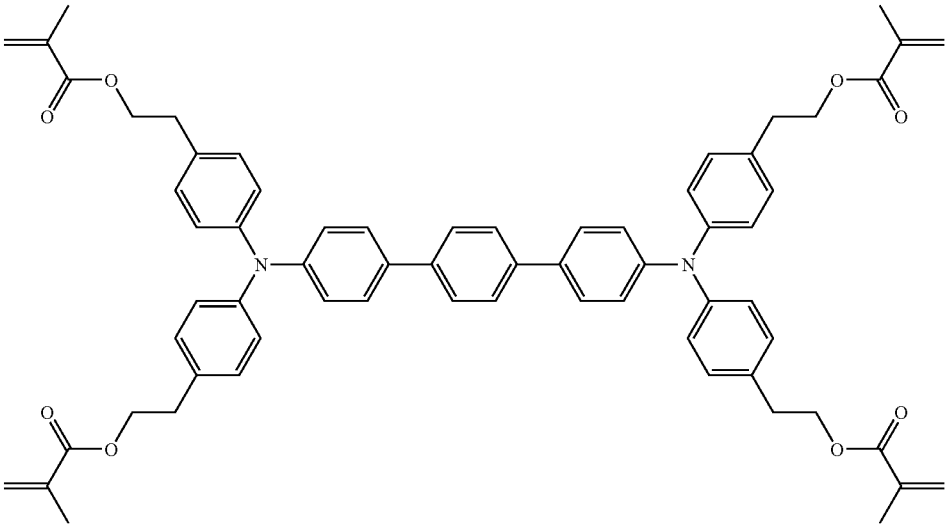 |
| iv-16 | 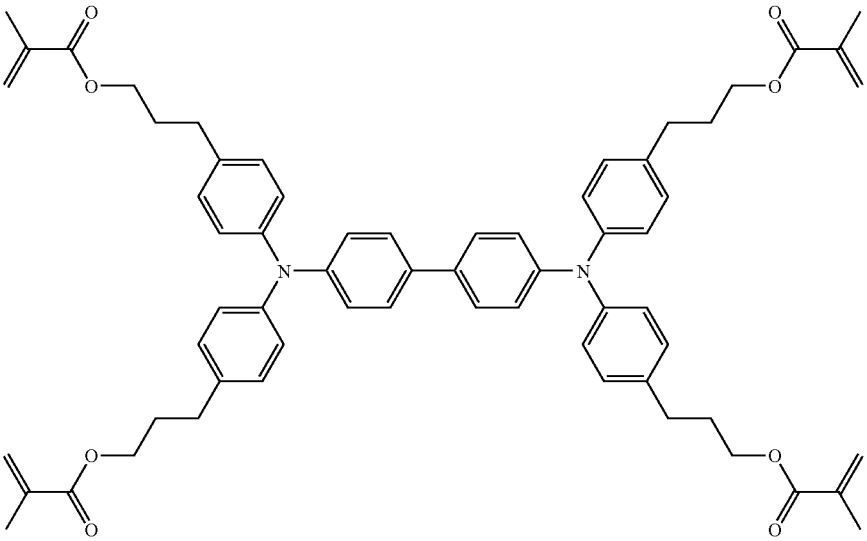 |

-continued
| No. | |
|---|---|
| iv-17 | 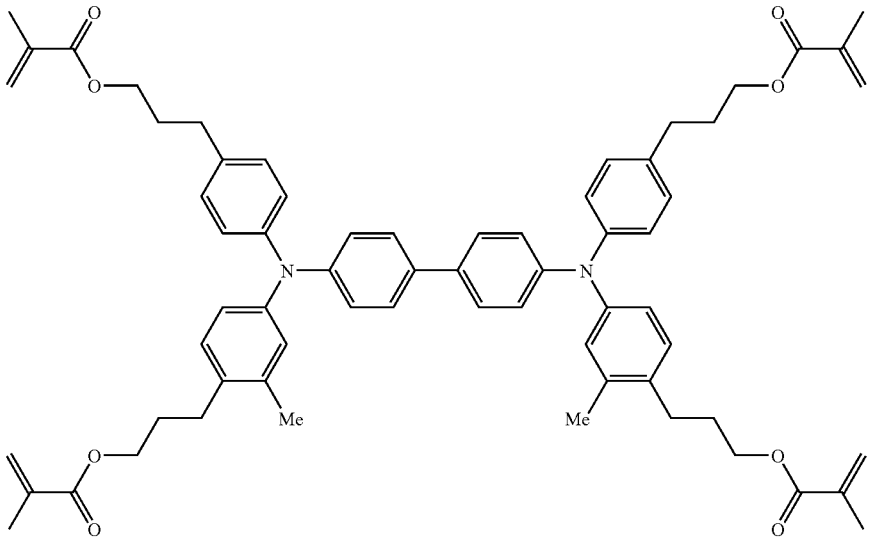 |
| iv-18 | 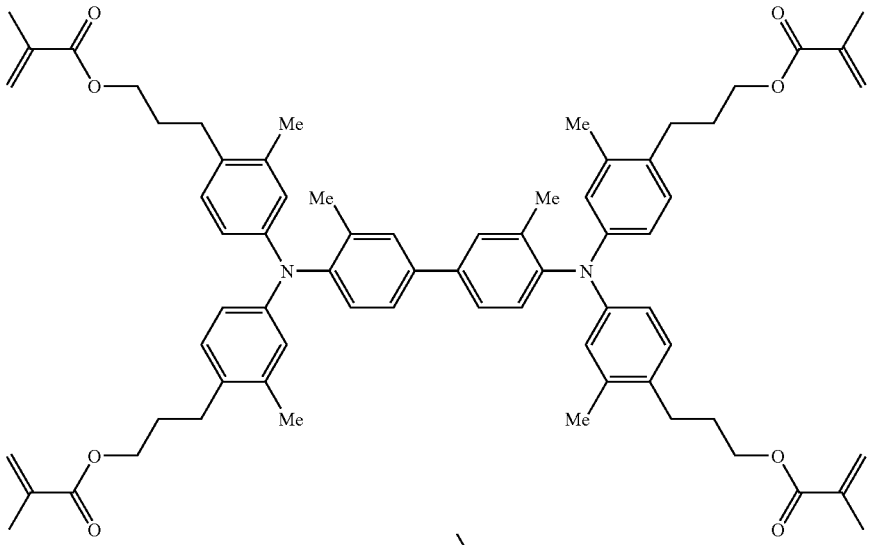 |
| v-1 | 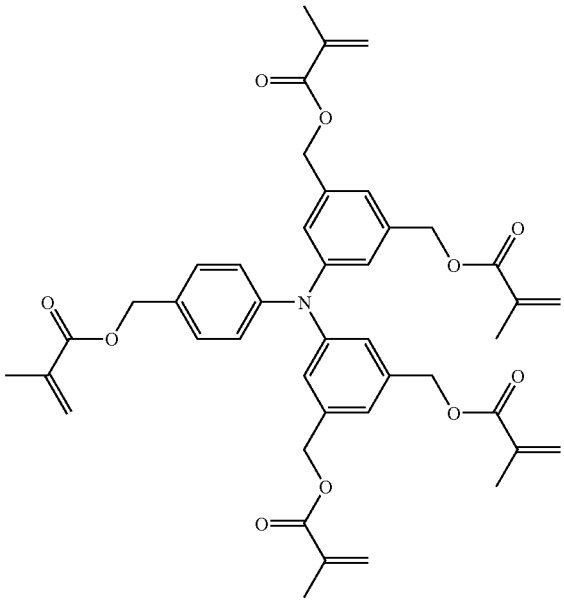 |

-continued

| No. | |
|---|---|
| vi-1 | 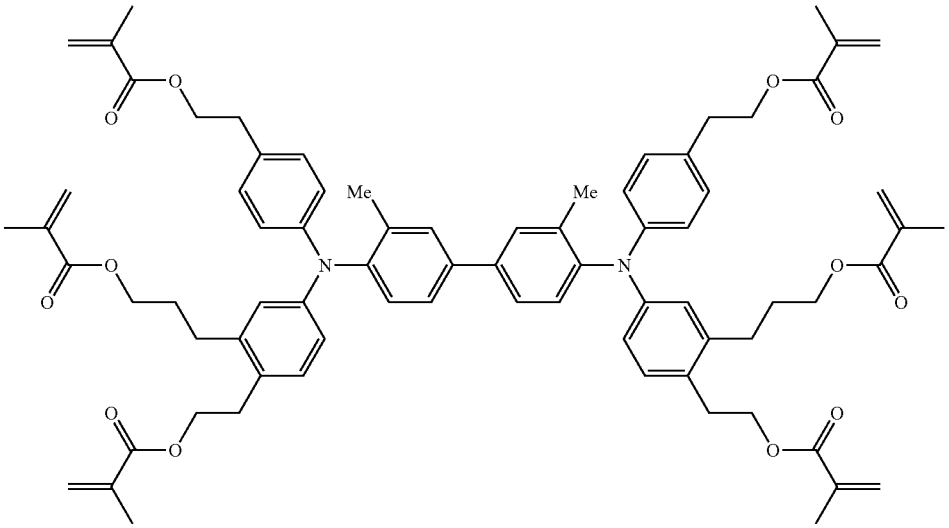 |
| vi-2 | 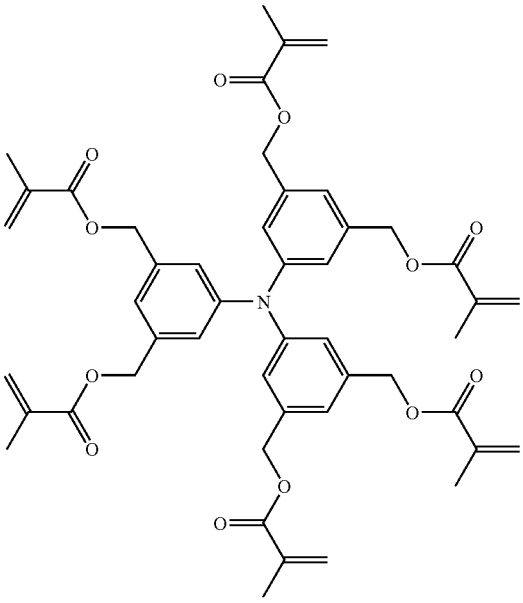 |

In the compounds i-1 to vi-2, Me represents a methyl group, Pr represents a n-propyl group, and Bu represents a n-butyl group. When a bonding hand of a single bond is described and a substituent of a terminal is not described, the substituent is a methyl group. Furthermore, when a bonding hand of a double bond is described and a substituent of a terminal is not described, the substituent is a $=CH_2$ group.

A compound where n in formula (I) is 4 or more is synthesized in a manner substantially similar to that in the synthesis path of compound iv-4 and the synthesis path of compound iv-17 described below.

Hereinafter, the synthesis path of compound iv-4 and the synthesis path of compound iv-17 will be shown as an example of synthesis of a compound where n in formula (I) is 4 or more.

In the synthesis path shown below, Me represents a methyl group. When a bonding hand of a single bond is described and a substituent of a terminal is not described, the substituent of a terminal is a methyl group. Furthermore, when a bonding hand of a double bond is described and a substituent of a terminal is not described, the substituent is a $=CH_2$ group.

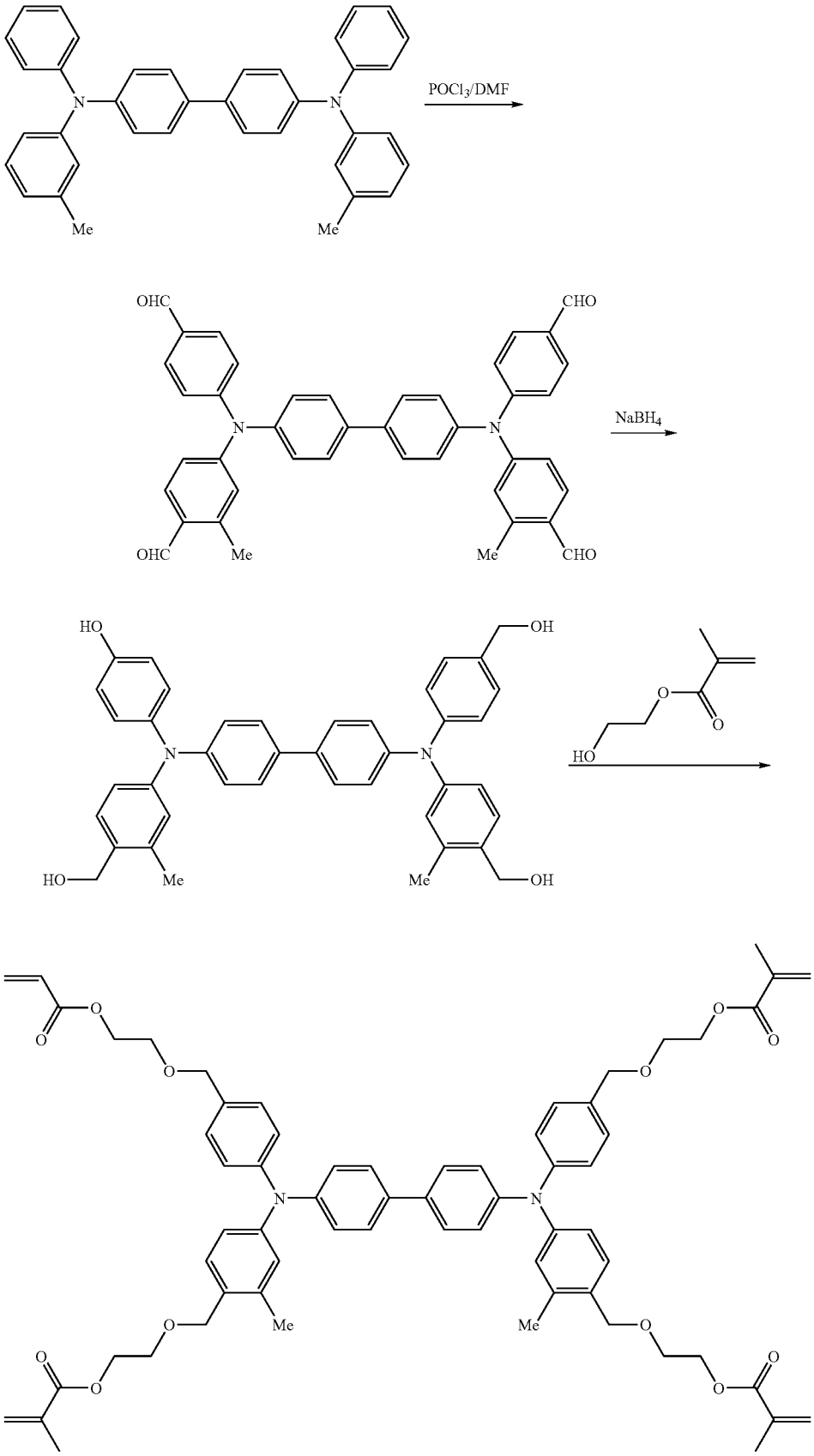
Compound iv-4

-continued
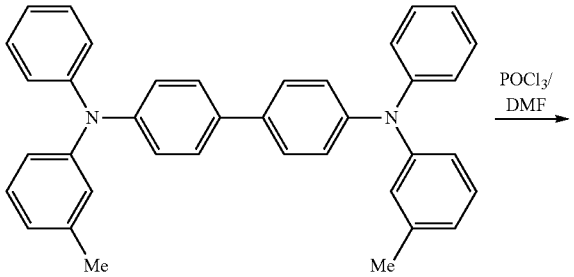
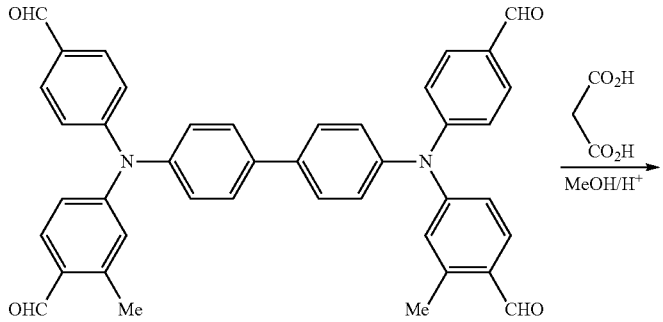
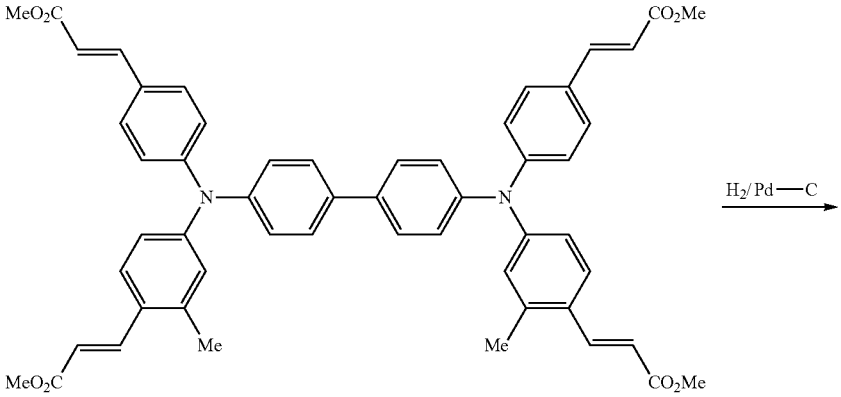
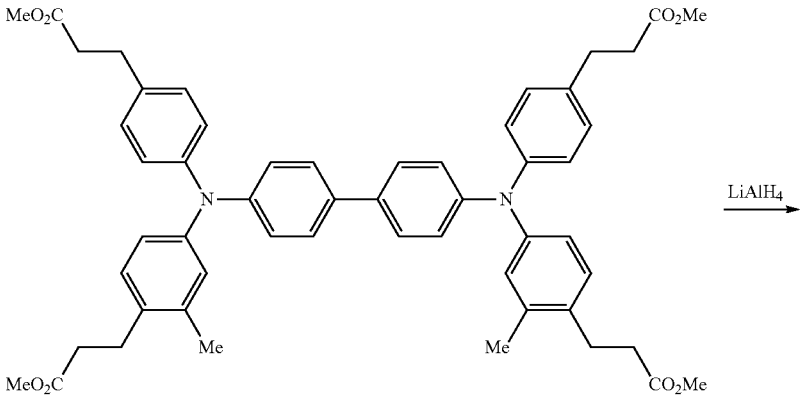

-continued

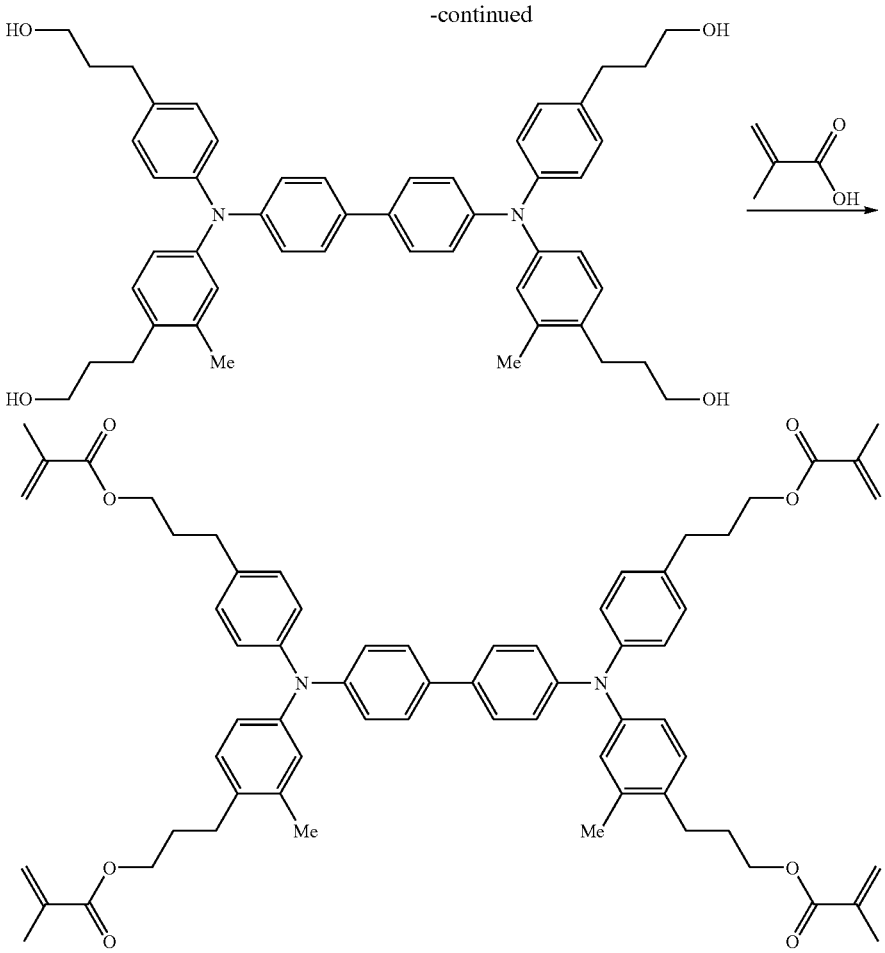

Compound iv-17

In the exemplary embodiment of the invention, as a compound represented by formula (I), as mentioned above, a compound having n of 2 or more is preferably used and a compound having n of 4 or more is more preferably used.

As a compound represented by formula (I), a compound having n of 4 or more and a compound having n of 1 to 3 may be used together. When these are used together, the mechanical strength of a cured material may be controlled without deteriorating charge transportability.

When a compound having n of 4 or more and a compound having n of 1 to 3 are used together as a compound represented by formula (I), a compound having n of 4 or more is preferably contained in an amount of 5% by weight or more and more preferably 20% by weight or more relative to the total content of the compounds represented by formula (I).

The total content of the compounds represented by formula (I) is preferably 10% by weight or more, more preferably 20% by weight or more and still more preferably 30% by weight (about 30% by weight) or more relative to the composition used when the protective layer 5 is formed.

When the total content is set in the range, a thick cured material excellent in the electric characteristics is realized.

In the exemplary embodiment, a compound represented by formula (I) and a known charge transporting material that does not have a reactive group may be used together. The known charge transporting material that does not have a reactive group does not have a reactive group that does not assume charge transportation; accordingly, a component concentration of a charge transporting material is substantially heightened, and thereby, the electric characteristics are effectively further improved.

Examples of the known charge transporting materials include the charge transporting materials constituting the charge transport layer 3 described above.

(Compound Having Charge Transportability and Azo Group)

Next, the compound having charge transportability and an azo group, which is used in the exemplary embodiment of the invention, will be described.

In the compound having charge transportability and an azo group, a "compound having charge transportability" means a compound in which carrier transportation is observed according to the Time of Flight method. Specifically, preferable examples of the charge transporting material include electron transporting compounds such as a quinone compound such as p-benzoquinone, chloranyl, bromanyl, or anthraquinone, a tetracyanoquinodimethane compound, a fluorenone compound such as 2,4,7-trinitrofluorenone, a xanthone compound, a benzophenone compound, a cyanovinyl compound, and an ethylene compound; and compounds having a structure of a triarylamine compound, a benzidine compound, an arylalkane compound, an aryl-substituted ethylene compound, a stilbene compound, an anthracene compound or a hydrazone compound. Compounds having a triarylamine structure are particularly preferable from the viewpoints of stability of electric characteristics, durability and matching with a substrate.

As for the azo group of the compound having charge transportability and an azo group, at least one azo group may be contained in a molecule thereof. However, one or two azo groups are preferably contained therein from the viewpoints of a starting efficiency with the compound represented by formula (I) and compatibility therewith.

In the present exemplary embodiment, the compound having charge transportability and an azo group is preferably a compound represented by formula (A) shown below.

(A)

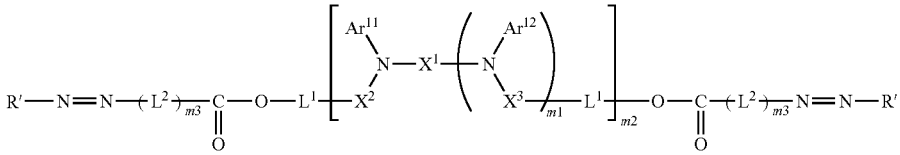

In formula (A), $Ar^{11}$ and $Ar^{12}$ each independently represent a substituted or unsubstituted aryl group, and $X^1$ represents a divalent hydrocarbon group having an aromatic cyclic structure or a divalent heteroatom-containing hydrocarbon group having an aromatic cyclic structure. $X^2$ and $X^3$ each independently represent a substituted or unsubstituted arylene group. $L^1$ and $L^2$ each independently represent a divalent hydrocarbon group that may contain a branched or cyclic structure or a divalent heteroatom-containing hydrocarbon group that may contain a branched or cyclic structure. m1 and m3 each independently represent 0 or 1, and m2 represents a number of 1 or more. R' represents a monovalent hydrocarbon group or a monovalent heteroatom-containing hydrocarbon group.

$Ar^{11}$ and $Ar^{12}$ each independently represent a substituted or unsubstituted aryl group. However, a substituted or unsubstituted aryl group having from 6 to 16 carbon atoms is preferable. Specific examples of the aryl group include a phenyl group, a biphenyl group, a naphthyl group, and a pyrenyl group. Furthermore, examples of a substituent introduced into the aryl group include a methyl group, an ethyl group, a methoxy group, and a halogen atom.

$X^1$ represents a divalent hydrocarbon group having an aromatic cyclic structure or a divalent heteroatom-containing hydrocarbon group having an aromatic cyclic structure. Both the hydrocarbon group and the heteroatom-containing hydrocarbon group preferably have from 6 to 20 carbon atoms. Examples of a heteroatom in the heteroatom-containing hydrocarbon include an oxygen atom and a sulfur atom. Specific examples of $X^1$ include a phenylene group, a biphenylene group, a terphenylene group, a naphthylene group, a methylene diphenyl group, a cyclohexylene diphenyl group, an oxydiphenyl group, and a thiodiphenyl group. The hydrocarbon group and heteroatom-containing hydrocarbon group represented by $X^1$ each may have a substituent, and examples of the substituent include a methyl group, an ethyl group, a methoxy group and a halogen atom.

$X^1$ is preferably a substituted or unsubstituted biphenylene group and more preferably a 3,3'-substituted biphenylene group particularly from the viewpoints of charge transporting property and chemical stability.

$X^2$ and $X^3$ each independently represent a substituted or unsubstituted arylene group. However, a substituted or unsubstituted arylene group having from 6 to 18 carbon atoms is preferable. Specific examples of the arylene group include a phenylene group, a biphenylene group, a terphenylene group, and a naphthylene group. Furthermore, examples of a substituent that may be introduced into the arylene group include a methyl group, an ethyl group, a methoxy group, and a halogen atom.

$L^1$ represents a divalent hydrocarbon group or a divalent heteroatom-containing hydrocarbon group. The hydrocarbon group and heteroatom-containing hydrocarbon group each may contain a branched or cyclic structure and each preferably have from 1 to 20 carbon atoms. Examples of the heteroatom in the heteroatom-containing hydrocarbon include an oxygen atom, a sulfur atom and a nitrogen atom. $L^1$ preferably contains an ester bond and has 20 or less carbon atoms and more preferably is a combination of an ester bond, and an alkylene group and/or a phenylene group, particularly from the viewpoint of mechanical characteristics.

Specific examples of $L^1$ include following.

$L^1$-1

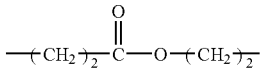

$L^1$-2

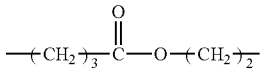

$L^1$-3

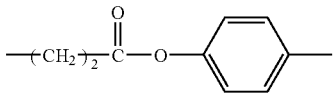

$L^1$-4

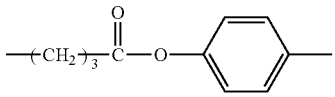

Furthermore, $L^2$s each independently represent a divalent hydrocarbon group or a divalent heteroatom-containing hydrocarbon group. The divalent hydrocarbon group and divalent heteroatom-containing hydrocarbon group each may contain a branched or cyclic structure and each preferably have from 1 to 20 carbon atoms. Examples of the heteroatom in the heteroatom-containing hydrocarbon include an oxygen atom, a sulfur atom and a nitrogen atom. $L^2$ preferably contains an alkylene group or a cyano group having from 1 to 20 carbon atoms in particular from the viewpoints of electric characteristics and polymerization initiating ability.

Specific examples of $L^2$ include the followings.

$L^2$-1

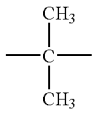

-continued $L^2$-2

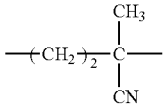

R' represents a monovalent hydrocarbon group or a heteroatom-containing hydrocarbon group. The hydrocarbon group or heteroatom-containing hydrocarbon group preferably has from 1 to 20 carbon atoms. R' preferably contains an alkylene group, an ester group, a cyano group or a carboxy group in a structure thereof particularly from the viewpoints of electric characteristics and polymerization initiating ability.

Specific examples of R' include the followings.

R'-1

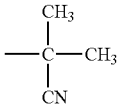

-continued

R'-2

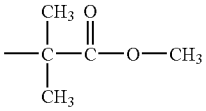

R'-3

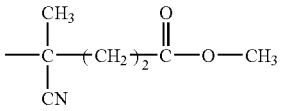

m1 and m3 each independently represent 0 or 1, and m2 represents a number of 1 or more.

m2 is preferably from 1 to 1000 and more preferably from 5 to 500 from the viewpoints of electric characteristics and mechanical strength. Thus, when m2 is 2 or more and a compound represented by formula (A) is a polymer, a mixture is generated and m2 may represent an average value.

Specific examples of the compounds represented by formula (A) (compounds A-1 to A-13) will be shown below without restricting thereto.

TABLE 1

| | $Ar^{11}$ | $Ar^{12}$ | $X^1$ |
|---|---|---|---|
| A-1 | 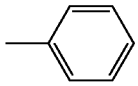 | 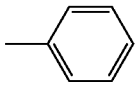 | 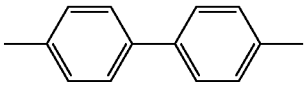 |
| A-2 | 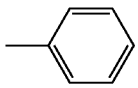 | 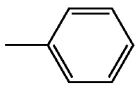 | 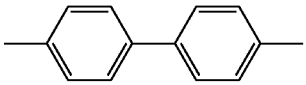 |
| A-3 | 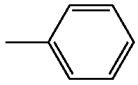 | 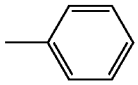 | 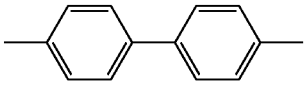 |
| A-4 | 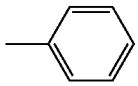 | — | 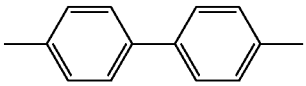 |
| A-5 | 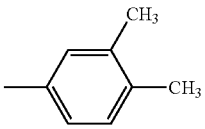 | 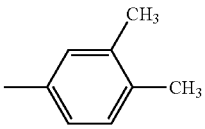 | 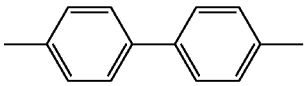 |
| A-6 | 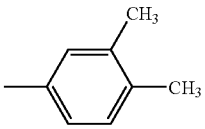 | 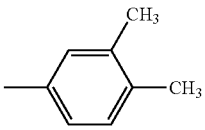 | 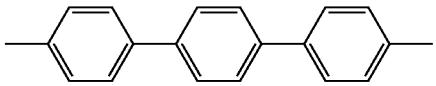 |
| A-7 | 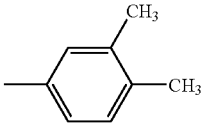 | 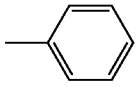 | 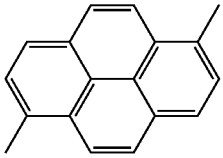 |

TABLE 1-continued
| | | | | | | | | | |
|---|---|---|---|---|---|---|---|---|---|
| A-8 | 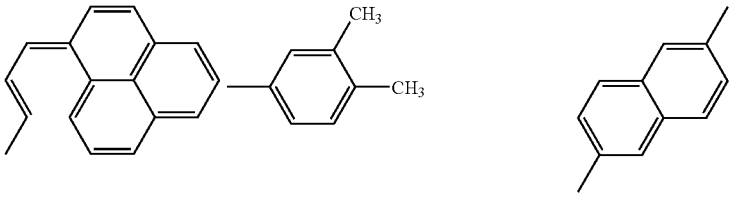 | | | | | | | | |
| | | $X^2$ | $X^3$ | $L^1$ | m1 | $L^2$ | m3 | R' | m2 |
| | A-1 | 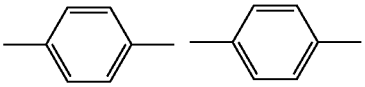 |  | $L^1$-1 | 1 | $L^2$-1 | 1 | R'-2 | 1 |
| | A-2 | 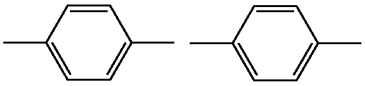 |  | $L^1$-1 | 1 | — | 0 | R'-1 | 25 |
| | A-3 | 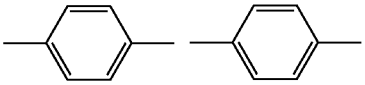 |  | $L^1$-1 | 1 | $L^2$-2 | 1 | R'-3 | 30 |
| | A-4 | 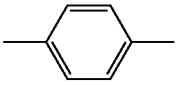 | — | $L^1$-2 | 0 | $L^2$-1 | 1 | R'-2 | 25 |
| | A-5 | 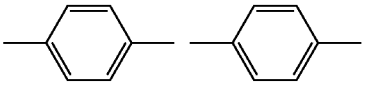 |  | $L^1$-1 | 1 | $L^2$-2 | 1 | R'-3 | 5 |
| | A-6 | 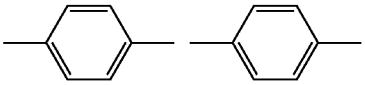 |  | $L^1$-1 | 1 | $L^2$-2 | 1 | R'-3 | 29.5 |
| | A-7 | 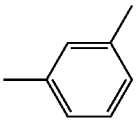 | 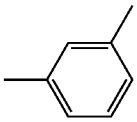 | $L^1$-3 | 1 | $L^2$-1 | 1 | R'-2 | 5 |
| | A-8 | 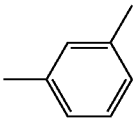 | 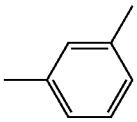 | $L^1$-4 | 1 | — | 0 | R'-1 | 9 |
TABLE 2
| | $Ar^{11}$ | $Ar^{12}$ | $X^1$ |
|---|---|---|---|
| A-9 | 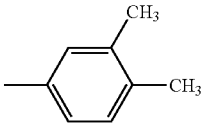 | 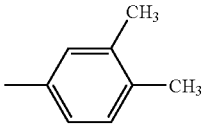 | 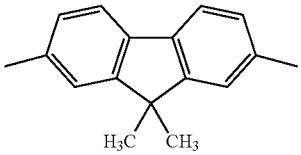 |
| A-10 | 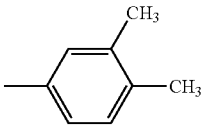 | 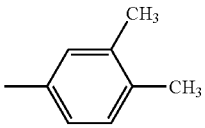 | 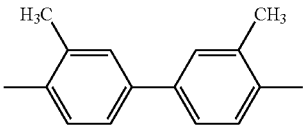 |

TABLE 2-continued

| | | | | | | | | | |
|---|---|---|---|---|---|---|---|---|---|
| A-11 | 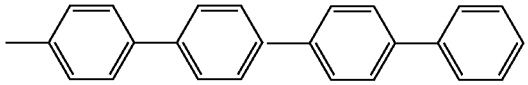 | | 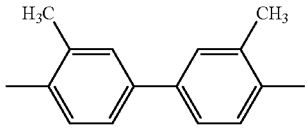 | | | | | | |
| A-12 | 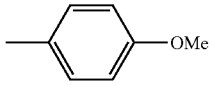 | | 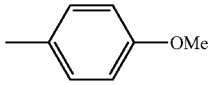 | | 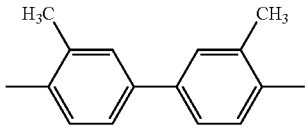 | | | | |
| A-13 | 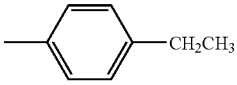 | | 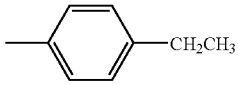 | | 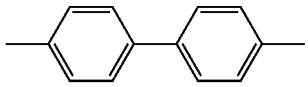 | | | | |
| | | $X^2$ | | $X^3$ | $L^1$ | m1 | $L^2$ | m3 | R' | m2 |
| A-9 | | 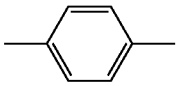 | | 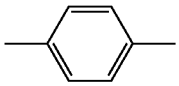 | $L^1$-1 | 1 | $L^2$-2 | 1 | R'-3 | 10 |
| A-10 | | 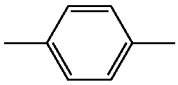 | | 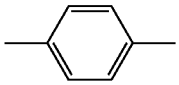 | $L^1$-1 | 1 | $L^2$-2 | 1 | R'-3 | 37.5 |
| A-11 | | 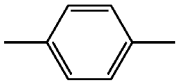 | | 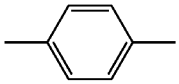 | $L^1$-1 | 1 | $L^2$-2 | 1 | R'-3 | 30 |
| A-12 | | 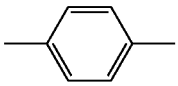 | | 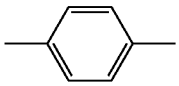 | $L^1$-1 | 1 | $L^2$-2 | 1 | R'-3 | 30 |
| A-13 | | 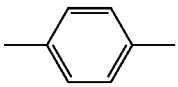 | | 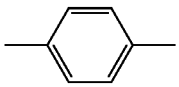 | $L^1$-1 | 1 | $L^2$-2 | 1 | R'-3 | 70 |

A compound represented by formula (A) is synthesized in a manner similar to that in the synthesis path of compound A-6 shown below.

Hereinafter, the synthesis path of compound A-6 will be shown as an example of synthesis of a compound represented by formula (A).

In the synthesis path shown below, m2 in compound A-6 is a number of from 5 to 100.

Compound A-6

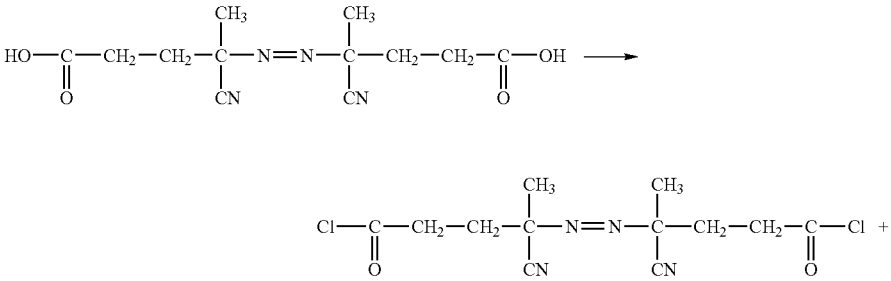

-continued

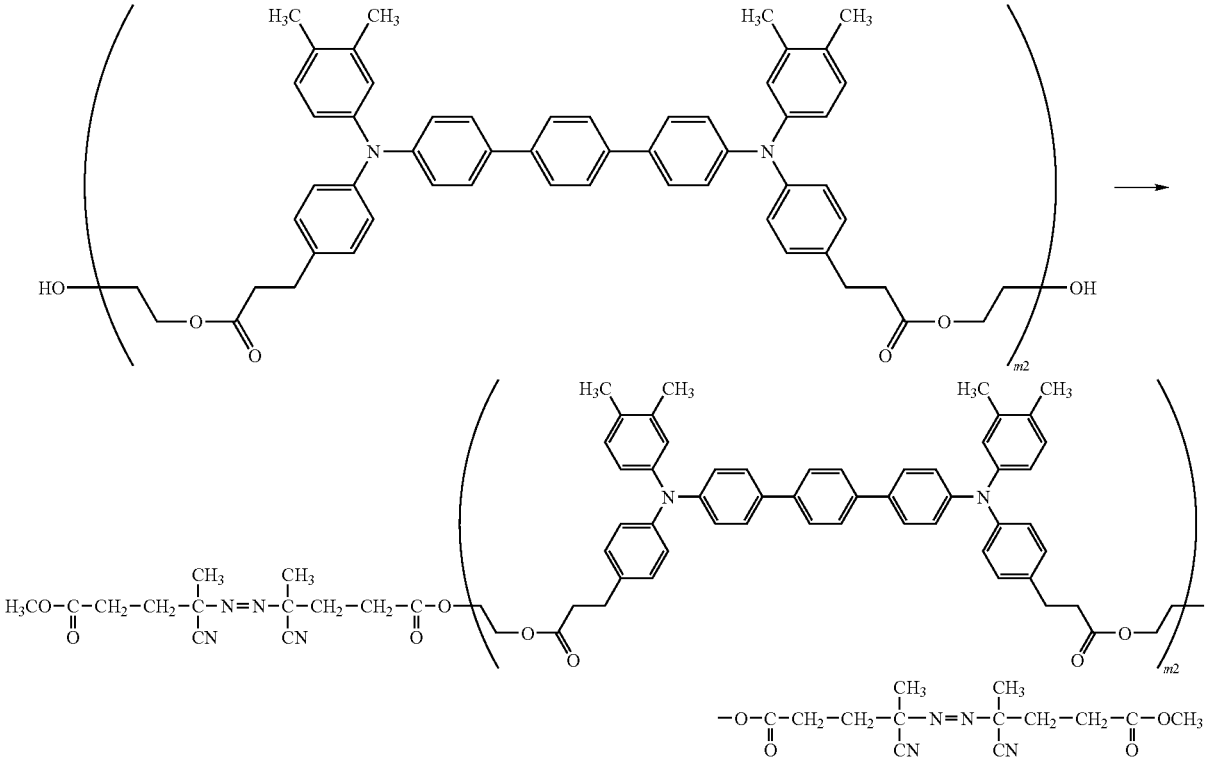

Compound A-6

A suitable combination of a compound represented by formula (A) and a compound represented by formula (I) is as shown below.

A combination of compounds having similar structures is preferred. In particular, each combination of triarylamine compounds, benzidine compounds, arylalkane compounds, aryl-substituted ethylene compounds, stilbene compounds, anthracene compounds or hydrazone compounds are preferred.

Compounds represented by formula (A) may be used alone or in a mixture of plural compounds.

A compound represented by formula (A) may be used together with a thermal polymerization initiator such as shown below.

The thermal polymerization initiator that may be used together is not particularly restricted. However, a 10 hr half-value period temperature is preferably from 40° C. to 110° C. for the purpose of inhibiting a photosensitive material in a photosensitive layer from being damaged when a protective layer 5 is formed.

Examples of commercially available thermal polymerization initiator that may be used together include: azo initiators such as V-30 (10 hr half-value period temperature: 104° C.), V-40 (ditto: 88° C.), V-59 (ditto: 67° C.), V-601 (ditto: 66° C.), V-65 (ditto: 51° C.), V-70 (ditto: 30° C.), VF-096 (ditto: 96° C.), Varn-110 (ditto: 111° C.) or Varn-111 (ditto: 111° C.) (trade name, all manufactured by Wako Pure Chemical Industries Ltd.), or $OT_{AZO}$-15 (ditto: 61° C.), $OT_{AZO}$-30, AIBM (ditto: 65° C.), AMBN (ditto: 67° C.), ADVN (ditto: 52° C.) or ACVA (ditto: 68° C.) (trade name, all manufactured by Otsuka Pharmaceutical Co., Ltd.); PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PERLOYL IB, PERLOYL 355, PERLOYL L, PERLOYL SA, NIPER BW, NIPER BMT-K40/M, PERLOYL IPP, PERLOYL NPP, PERLOYL TCP, PERLOYL OPP, PERLOYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT and PERBUTYL Z (trade name, all manufactured by Nippon Oil & Fats Co., Ltd.); KAYAKETAL AM-C55, TRIGONOX 36-C75, LAUROX, PERKADOX L-W75, PERKADOX CH-50L, TRIGONOX TMBH, KAYACUMEN H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-C50, KAYABUTYL B, KAYACARBON EH-C70, KAYACARBON EH-W60, KAYACARBON I-20, KAYACARBON BIC-75, TRIGINOX 117, or KAYAREN 6-70 (trade name, all manufactured by Kayaku Akzo Corporation); and LUPEROX LP (ditto: 64° C.), LUPEROX 610 (ditto: 37° C.), LUPEROX 188 (ditto: 38° C.), LUPEROX 844 (ditto: 44° C.), LUPEROX 259 (ditto: 46° C.), LUPEROX 10 (ditto: 48° C.), LUPEROX 701 (ditto: 53° C.), LUPEROX 11 (ditto: 58° C.), LUPEROX 26 (ditto:

77° C.), LUPEROX 80 (ditto: 82° C.), LUPEROX 7 (ditto: 102° C.), LUPEROX 270 (ditto: 102° C.), LUPEROX P (ditto: 104° C.), LUPEROX 546 (ditto: 46° C.), LUPEROX 554 (ditto: 55° C.), LUPEROX 575 (ditto: 75° C.), LUPEROX TANPO (ditto: 96° C.), LUPEROX 555 (ditto: 100° C.), LUPEROX 570 (ditto: 96° C.), LUPEROX TAP (ditto: 100° C.), LUPEROX TBIC (ditto: 99° C.), LUPEROX TBEC (ditto: 100° C.), LUPEROX JW (ditto: 100° C.), LUPEROX TAIC (ditto: 96° C.), LUPEROX TAEC (ditto: 99° C.), LUPEROX DC (ditto: 117° C.), LUPEROX 101 (ditto: 120° C.), LUPEROX F (ditto: 116° C.), LUPEROX DI (ditto: 129° C.), LUPEROX 130 (ditto: 131° C.), LUPEROX 220 (ditto: 107° C.), LUPEROX 230 (ditto: 109° C.), LUPEROX 233 (ditto: 114° C.), and LUPEROX 531 (ditto: 93° C.) (trade name, all manufactured by Arkema Yoshitomi Ltd.).

The compound represented by formula (A) is contained preferably in an amount of from 0.1% by weight to 1000% by weight, more preferably from 1% by weight to 500% by weight, and still more preferably from 2% by weight (or about 2% by weight) to 200% by weight (or about 200% by weight), relative to a reactive compound (the compound represented by formula (I) and other monomer and oligomer) in the composition.

When the compound represented by formula (A) and a thermal polymerization initiator such as mentioned above are used together, the total amount thereof is preferably from 0.01% by weight to 10% by weight, more preferably from 0.05% by weight 5% by weight, and still more preferably from 0.1% by weight to 2% by weight, relative to a reactive compound (a compound represented by formula (I) and other monomer and oligomer) in the composition.

Hereinafter, other components that constitute the composition used to form the protective layer 5 will be described.

In addition to the compound represented by formula (I) and the compound having charge transportability and an azo group, a radical polymerizable monomer or oligomer, which does not have charge transportability, may be added to the composition, for the purpose of controlling viscosity of the composition, mechanical strength of a film, flexibility, smoothness and cleaning property.

Examples of monofunctional radical polymerizable monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyethyl acrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenylphenol acrylate, and o-phenylphenolglycidylether acrylate.

Examples of bifunctional radical polymerizable monomer include 1,4-butanediol diacrylate, 1,6-hexanediol diacrylate, 1,9-nonanediol diacrylate, 2-n-butyl-2-ethyl-1,3-propanediol diacrylate, tripropylene glycol diacrylate, tetraethylene glycol diacrylate, dioxane glycol diacrylate, polytetramethylene glycol diacrylate, ethoxylated bisphenol A diacrylate, ethoxylated bisphenol A dimethacrylate, tricyclodecanemethanol diacrylate and tricyclodecanemethanol dimethacrylate.

Examples of tri- or higher functional radical polymerizable monomer include trimethylolpropane triacrylate, trimethylolpropane trimethacrylate, pentaerythritol acrylate, trimethylolpropane EO-added triacrylate, glycerin PO-added triacrylate, trisacryloyloxyethyl phosphate, pentaerythritol tetraacrylate and ethoxylated isocyanuric acid triacrylate.

Examples of radical polymerizable oligomer include epoxy acrylate oligomers, urethane acrylate oligomers and polyester acrylate oligomers.

The radical polymerizable monomer or oligomer that does not have charge transportability is preferably contained in an amount of from 0% by weight to 50% by weight, more preferably from 0% by weight to 40% by weight and still more preferably from 0% by weight to 30% by weight, relative to the total solid content in the composition.

A surfactant may be added to the composition that is used to form the protective layer 5 to improve a film-forming property.

As the surfactant, a surfactant that contains at least one of a structure obtained by polymerizing an acryl monomer having a fluorine atom, a structure having a carbon-carbon double bond and a fluorine atom, an alkylene oxide structure and a structure having a carbon-carbon triple bond and a hydroxyl group in a molecule is cited.

The content of the surfactant is preferably from 0.001% by weight to 10% by weight and more preferably from 0.01% by weight to 5% by weight relative to a solid content of the composition.

In the composition used to form the protective layer 5, another thermosetting resin such as a phenol resins, a melamine resins or a benzoguanamine resins may be added for the purpose of inhibiting excessively absorption of gas generated by discharge and thereby effectively inhibiting oxidation caused by the generated gas from occurring.

Furthermore, in the composition used to form the protective layer 5, a coupling agent, a hardcoat agent or a fluorine-containing compound may be further added to adjust a film-forming property of a film, flexibility, lubricity, or adhesive property. Specific examples of the additive include various silane coupling agents and commercially available silicone hardcoat agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane.

Examples of the commercially available hardcoat agent include KP-85, X-40-9740 and X-8239 (trade name, all manufactured by Shin-Etsu Silicone Co., Ltd.) and AY42-440, AY42441 and AY49-208 (trade name, all manufactured by Dow Corning Toray Co., Ltd.).

Furthermore, in order to impart water repelling property, a fluorine-containing compound such as (tridecafluoro-1,1,2,2-tetrahydrooctyl)trimethoxysilane, (3,3,3-trifluoropropyl)trimethoxysilane, 3-(heptafluoroisopropoxy)propyltriethoxysilane, 1H, 1H, 2H, 2H-perfluoroalkyltriethoxysilane, 1H, 1H, 2H, 2H-perfluorodecyltriethoxysilane, or 1H, 1H, 2H, 2H-perfluorooctyltriethoxysilane may be added.

A silane coupling agent may be used at any amount. However, an amount of a fluorine-containing compound is preferably set at 0.25 times or less a compound that does not contain fluorine. When the usage amount is exceeded, there may be generated a problem in the film-forming property of a crosslinked film.

Furthermore, in the composition used to form the protective layer 5, a thermoplastic resin may be added to improve discharge gas resistance of the protective layer, mechanical strength and scratch resistance, to reduce torque, to control a wear amount, to extend a pot-life and to control dispersibility of particles and viscosity.

Examples of the thermoplastic resin include a polyvinyl acetal resins such as a polyvinyl butyral resins, a polyvinyl formal resins, or a partially acetalized polyvinyl acetal resins in which butyral is partially modified with formal or acetoacetal (for example, S-LEC B, K (trade name, manufactured by Sekisui Chemical Co., Ltd.)), a polyamide resins, a cellulose resins, and a polyvinyl phenol resins. A polyvinyl acetal resins and a polyvinyl phenol resins are preferred in view of electric characteristics. A weight average molecular weight of the resin is preferably from 2000 to 100,000 and more preferably from 5,000 to 50,000. When the molecular weight of the resin is less than 2,000, an addition effect of the resin tends to be insufficient. On the other hand, when the molecular weight of the resin exceeds 100,000, the solubility is lowered to tend to result in limiting an addition amount and causing film-forming defect during coating. An addition amount of the resin is preferably from 1% by weight to 40% by weight, more preferably from 1% by weight to 30% by weight and still more preferably from 5% by weight to 20% by weight. When the addition amount of the resin is less than 1% by weight, an addition effect of the resin tends to be insufficient. On the other hand, when the addition amount thereof exceeds 40% by weight, image blurring tends to occur under a high temperature and high humidity (for example, 28° C., 85% RH) environment.

In the composition used to form the protective layer 5, an antioxidant is preferably added. to inhibit the protective layer from being deteriorated by an oxidizing gas such as ozone generated by a charging unit. When a photoreceptor surface is heightened in the mechanical strength and thereby a photoreceptor is extended in the lifetime, a photoreceptor is in contact with the oxidizing gas over a longer period of time; accordingly, oxidation resistance stronger than ever is demanded.

The anti-oxidant is preferably a hindered phenol antioxidant or a hindered amine antioxidant, and a known antioxidant such as an organic sulfur antioxidant, a phosphite antioxidant, a dithiocarbamic acid salt antioxidant, a thiourea antioxidant or a benzimidazole antioxidant may be used. An addition amount of the antioxidant is preferably 20% by weight or less and more preferably 10% by weight or less.

Examples of the hindered phenol antioxidant include 2,6-di-t-butyl-4-methylphenol, 2,5-di-t-butylhydroquinone, N,N'-hexamethylene bis(3,5-di-t-butyl-4-hydroxy)hydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylene bis(4-methyl-6-t-butylphenol), 2,2'-methylene bis(4-ethyl-6-t-butylphenol), 4,4'-butylidene bis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butyl phenol).

Furthermore, in the composition used to form the protective layer 5, various particles may be added to lower a residual potential or to improve mechanical strength of the protective layer.

As an example of particle, a silicon-containing particle is cited. The silicon-containing particle is a particle that contains silicon in constituent elements, and, specifically, colloidal silica and silicone particle are cited. Colloidal silica used as a silicon-containing particle is selected from acidic or alkaline aqueous dispersion, and organic solvent (such as alcohol, ketone or ester) dispersions containing colloidal silica having an average particle diameter of from 1 nm to 100 nm and preferably from 10 nm to 30 nm. Commercially available colloidal silica may be used. A solid content of colloidal silica in the protective layer 5 is not particularly restricted. However, the solid content of colloidal silica relative to the total solid content in the protective layer 5 is used in the range of from 0.1% by weight to 50% by weight and preferably in the range of from 0.1% by weight to 30% by weight, from the viewpoints of film-forming property, electric characteristics and mechanical strength.

A silicone particle that is used as a silicon-containing particle is selected from a silicone resin particle, a silicone rubber particle and a silica particle surface treated with silicone, and commercially available silicone particles are generally used. The silicone particle is spherically formed and an average particle diameter thereof is preferably from 1 nm to 500 nm and more preferably from 10 nm to 100 nm. The silicone particle is a fine particle that is chemically inactive, excellent in the dispersibility in a resin and low in content necessary to obtain sufficient characteristics; accordingly, a surface property of an electrophotographic photoreceptor is improved without disturbing a crosslinking reaction. That is, in a state contained in a strong crosslinking structure without generating fluctuation, lubricity and water repellency of a surface of an electrophotographic photoreceptor are improved and thereby excellent wear resistance and contamination attachment resistance are maintained over a long period of time.

The content of silicone particles in the protective layer 5 is preferably from 0.1% by weight to 30% by weight and more preferably from 0.5% by weight to 10% by weight, relative to the total solid content in the protective layer 5.

Examples of other particle include fluorine-based particles of tetrafluoroethylene, trifluoroethylene, hexafluoropropylene, vinyl fluoride, or vinylidene fluoride; particles made of resins obtained by copolymerizing a fluororesin and a monomer having a hydroxy group such as shown in "Preprints of the 8th Polymer Material Forum, p.89"; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO or MgO. Furthermore, oil such as silicone oil may be added for the same purpose. Examples of silicone oil include silicone oil such as dimethylpolysiloxane, diphenylpolysiloxane, or phenylmethylsiloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, or phenol-modified polysiloxane; cyclic dimethylcyclosiloxanes such as hexamethylcyclotrisiloxane, octamethylcyclotetrasiloxane, decamethylcyclopentasiloxane or dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane or 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane or phenylhydrocyclosiloxane; and vinyl group-containing cyclosiloxanes such as pentavinylpentamethylcyclopentasiloxane.

In the composition used to form the protective layer 5, metal, metal oxide or carbon black may be added. As metal, aluminum, zinc, copper, chromium, nickel, silver and stainless steel are cited, and plastic particles on a surface of which the metal is deposited are cited as well. Examples of the metal oxide include zinc oxide, titanium oxide, tin oxide, antimony oxide, indium oxide, bismuth oxide, tin-doped indium oxide, antimony or tantalum-doped tin oxide and antimony-doped zirconium oxide. These may be used alone or in a combination of at least two of them. When at least two of them are used in combination, any one of a simple mixture, a solid solution thereof and a fused form may be used. An average particle diameter of the conductive particles is preferably 0.3 μm or less and particularly preferably 0.1 μm or less from the viewpoint of transparency of a protective layer.

The composition used to form the protective layer 5 is preferably prepared as a coating solution for forming the protective layer. The coating solution for forming the protective layer may be free from a solvent or may contain, as required, a solvent such as alcohols such as methanol, ethanol, propanol, butanol, cyclopentanol or cyclohexanol; ketones such as acetone or methyl ethyl ketone; or ethers such as tetrahydrofuran, diethyl ether or dioxane.

These solvents may be used alone or in a mixture of at least two of them and preferably have a boiling temperature of 100° C. or less. As the solvent, at least one of solvents having a hydroxyl group (for example, alcohols) is preferably used.

The coating solution for forming the protective layer including the composition used to form the protective layer 5 is coated on the charge transport layer 3 by use of an ordinary coating method such as a blade coating method, a wire bar coating method, a spray coating method, a dip coating method, a bead coating method, an air-knife coating method or a curtain coating method, as required, followed by heating at a temperature of from 100° C. to 170° C. to cure, thereby a cured material is obtained. As a result, the protective layer (outermost surface layer) 5 made of the cured material is obtained.

An oxygen concentration during curing of the coating solution for forming the protective layer is preferably 1% or less, more preferably 1000 ppm or less and still more preferably 500 ppm or less.

The coating solution for forming the protective layer is used for example in a fluorescent color forming coating material, or an antistatic film on a glass surface or a plastic surface, other than in a photoreceptor. When the coating solution is used, a film excellent in adhesion to a lower layer is formed, and thereby performance deterioration caused by repeating usage over a long period of time is suppressed.

As an electrophotographic photoreceptor, an example of a function separation type has been described. The content of the charge generating material in a single layer photosensitive layer 6 (charge generating/charge transport layer) is substantially from 10% by weight to 85% by weight and preferably from 20% by weight to 50% by weight. Content of a charge transporting material is preferably from 5% by weight to 50% by weight. A method for forming the monolayer type photosensitive layer 6 (charge generating/charge transport layer) is conducted in a manner substantially similar to that in the method for forming the charge generating layer 2 or charge transport layer 3. A film thickness of the monolayer type photosensitive layer (charge generating/charge transport layer) 6 is set at preferably substantially from 5 μm to 50 μm and more preferably from 10 μn to 40 μm.

In the foregoing exemplary embodiment, a form where a protective layer 5 is an outermost surface layer made of a cured material of a composition containing a compound represented by formula (I) and a compound having charge transportability and an azo group has been described. However, in the case of a layer structure where a protective layer 5 is not formed, a charge transport layer located on the outermost surface in the layer structure is the outermost surface layer.

[Image Forming Apparatus/Process Cartridge]

Figure 4:
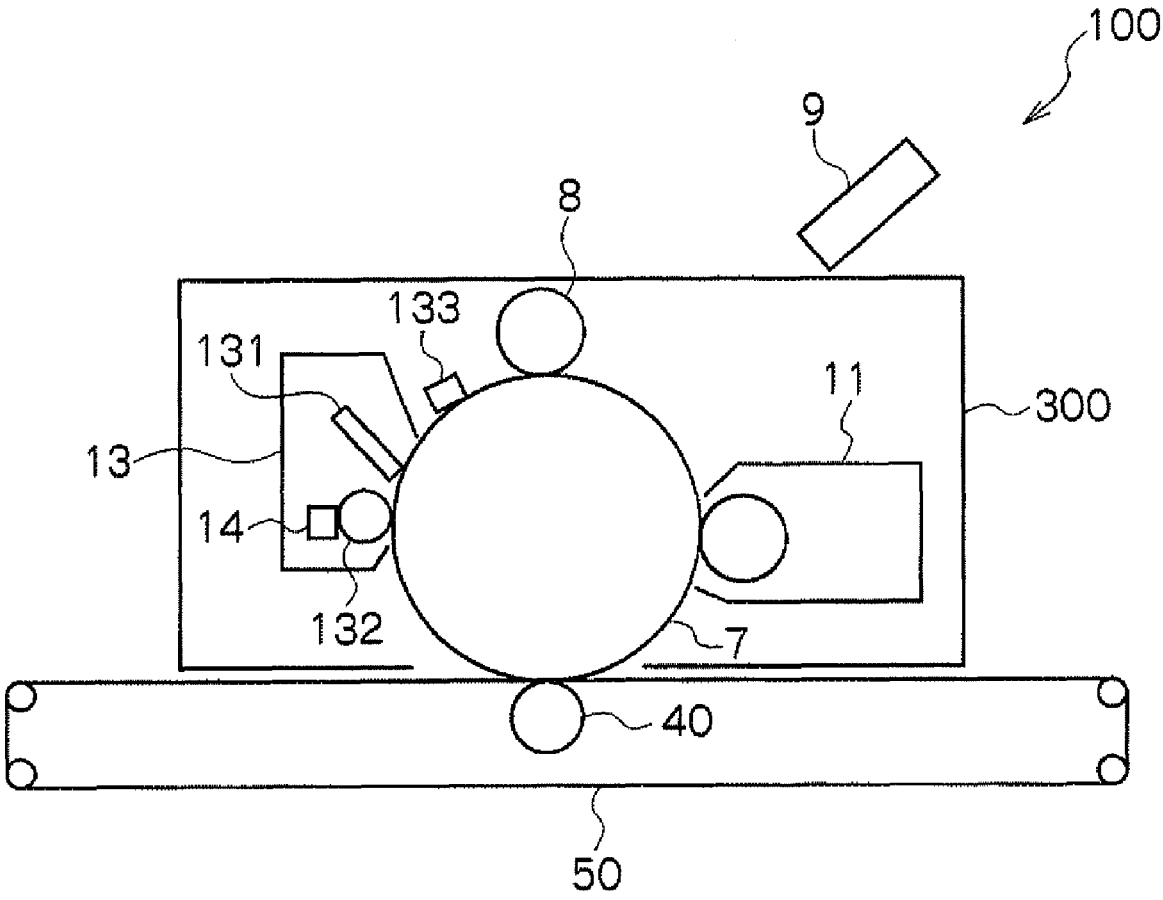
FIG. 4 is a schematic view showing an image forming apparatus according to an exemplary embodiment of the invention.

FIG. 4 is a schematic configuration diagram showing an image forming apparatus 100 involving the exemplary embodiment of the invention.

The image forming apparatus 100 shown in FIG. 4 includes: a process cartridge 300 provided with an electrophotographic photoreceptor 7; an exposing apparatus (electrostatic latent image forming unit) 9; a transfer apparatus (transfer unit) 40; and an intermediate transfer medium 50. In the image forming apparatus 100, the exposing apparatus 9 is disposed at a position capable of exposing the electrophotographic photoreceptor 7 from an opening of the process cartridge 300, the transfer apparatus 40 is disposed at a position facing the electrophotographic photoreceptor 7 via the intermediate transfer medium 50, and the intermediate transfer medium 50 is disposed partially in contact with the electrophotographic photoreceptor 7.

The process cartridge 300 in FIG. 4 integrally supports the electrophotographic photoreceptor 7, a charging apparatus (charging unit) 8, a developing apparatus (developing unit) 11 and a cleaning apparatus 13 in a housing. The cleaning apparatus 13 includes a cleaning blade (cleaning member), and the cleaning blade 131 is disposed so as to come into contact with a surface of the electrophotographic photoreceptor 7.

In FIG. 4, an example where, as the cleaning apparatus 13, a fibrous member 132 (roll) for supplying a lubricant 14 on a surface of the photoreceptor 7 is provided and a fibrous member 133 (planar brush) for assisting cleaning is used is shown. However, these may be used as required.

As the charging apparatus 8, a contact charging device that uses, for example, a conductive or semiconductive charging roller, charging brush, charging film, charging rubber blade or charging tube is used. A well-known charging device such as a non-contact roller charging device, Scorotron corona charger or Corotron corona charger that makes use of corona discharge may be used as well.

Though not shown in the drawing, a photoreceptor heating member for elevating a temperature of the electrophotographic photoreceptor 7 to reduce a relative temperature may be disposed around the electrophotographic photoreceptor 7 to heighten the stability of an image.

As the exposing apparatus 9, an optical device for desirably imagewise exposing light of semiconductor laser beam, LED light or liquid crystal shutter light on a surface of the photoreceptor 7 is cited. A wavelength of a light source, which is in a spectral sensitivity range of a photoreceptor, is used. As a wavelength of a semiconductor laser, near-infrared having an oscillation wavelength in the proximity of 780 nm is mainly used. However, without restricting to the wavelength, a laser having an oscillation wavelength of 600 something nm or a laser having an oscillation wavelength in the vicinity of from 400 nm 450 nm as a blue laser may be used. Furthermore, when a color image is formed, a surface-emitting laser light source capable of outputting multi-beams as well is effective.

As the developing apparatus 11, a general developing apparatus where, for example, a magnetic or nonmagnetic single component developing agent or two-component developing agent is used in contact or without contact to develop may be used. The developing apparatus is selected in accordance with the object as long as the foregoing functions are possessed. For example, a known developing device where the single component or two-component developing agent is attached to a photoreceptor 7 by use of a brush or a roller is cited. Among these, a developing roller retaining a developing agent on a surface thereof is preferably used.

Hereinafter, a toner that is used in the developing apparatus 11 will be described.

As such a toner, an average shape factor (shape factor=number average of $ML^2/A\times\pi/4\times100$, wherein, ML represents a maximum length of a toner particle and A represents a projected area of the toner particle) is preferably from 100 to 150 and more preferably from 100 to 140. Furthermore, as the toner, a volume average particle diameter is preferably from 2 μm to 12 μm, more preferably from 3 μm to 12 μm and still more preferably from 3 μm to 9 μm. When a toner thus satisfying the average shape factor and the volume average particle diameter is used, an image having higher developing property, transfer property and image quality is obtained.

A toner is not particularly restricted in a producing method thereof as long as the toner is in a range that satisfies the average shape factor and volume average particle diameter. A toner that is produced according to, for example, a kneading and crashing method where a binder resin, a colorant, a mold releaser, and, as required, a charge controlling agent are added, followed by kneading, crashing and classifying; a method where particles obtained according to the kneading and crashing method are changed in shape by mechanical impact or thermal energy; an emulsion-polymerization flocculation process where a polymerizable monomer of a binder resin is emulsion-polymerized, and the resulting dispersion liquid, a colorant and a mold releaser, and, as required, a dispersion liquid of a charge controlling agent are mixed, followed by flocculating, heating and fusing to obtain a toner; a suspension polymerization method where a polymerizable monomer for obtaining a binder resin, a colorant and a mold releaser, and as required, a solution of a charge controlling agent are dispersed in an aqueous solvent to polymerize; or a dissolution suspension method where a binder resin, a colorant and a mold releaser, and, as required, a solution of a charge controlling agent are suspended in an aqueous solvent to granulate, is used.

Furthermore, a known producing method such as a method where, with the toner obtained by the foregoing method as a core, flocculating particles are further attached thereto, followed by heating and fusing to impart a core-shell structure may be used. As a method for producing a toner, a suspension polymerization method, an emulsion-polymerization flocculation method and a dissolution suspension method, in which an aqueous solvent is used to produce, are preferable from the viewpoints of shape control and particle size distribution control, and an emulsion-polymerization flocculation method is particularly preferred.

A toner mother particle is constituted by containing a binder material, a colorant and a mold releaser, and, as required, silica and a charge controlling agent.

Examples of a binder resin used in a toner mother particle include: homopolymers and copolymers of such as styrenes such as styrene or chlorostyrene, monoolefins such as ethylene, propylene, or butylene, diolefins such as isoprene, vinyl esters such as vinyl acetate, vinyl propionate, vinyl benzoate or vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate, vinyl ethers such as vinyl methyl ether, vinyl ethyl ether, or vinyl butyl ether, or vinyl ketones such as vinyl methyl ketone, vinyl hexyl ketone, or vinyl isopropenyl ketone; and polyester resins obtained by copolymerization of dicarboxylic acids and diols.

Examples of particularly typical binder materials include polystyrene resins, styrene-alkyl acrylate copolymer resins, styrene-alkyl methacrylate copolymer resins, styrene-acrylonitrile copolymer resins, styrene-butadiene copolymer resins, styrene-maleic anhydride copolymer resins, polyethylene resins, polypropylene resins, and polyester resins. Furthermore, polyurethane resins, epoxy resins, silicone resins, polyamide resins, modified rosin, and paraffin wax are further cited.

Typical examples of the colorant include magnetic powders such as magnetite or ferrite, carbon black, Aniline Blue, Chalcoil Blue, Chrome Yellow, Ultramarine Blue, DuPont Oil Red, Quinoline Yellow, Methylene Blue Chloride, Phthalocyanine Blue, Malachite Green Oxalate, Lamp Black, Rose Bengal, C.I. Pigment Red 48: 1, C.I. Pigment Red 122, C.I. Pigment Red 57: 1, C.I. Pigment Yellow 97, C.I. Pigment Yellow 17, C.I. Pigment Blue 15:1 and C.I. Pigment Blue 15:3.

Typical examples of the mold releaser include low-molecular weight polyethylene, low-molecular weight polypropylene, Fisher-Tropsch wax, montan wax, carnauba wax, rice wax, and candelilla wax.

As the charge controlling agent, known charge controlling agents may be used, and these include azo metal complex compounds, metal complex compounds of salicylic acid, and resin type charge controlling agents containing a polar group. When the toner is produced by a wet process, a material that is hardly soluble in water is preferably used, from the viewpoints of controlling the ionic strength and reducing waste fluid pollution. Furthermore, the toner may be either one of a magnetic toner including a magnetic material and a non-magnetic toner containing no magnetic material.

The toner used for the developing apparatus 11 is produced by mixing the foregoing toner mother particles and the external additives by a Henshel mixer or a V-type blender. Moreover, when the toner mother particles are produced by a wet process, the additives may be externally added as well by a wet process.

In the toner used for the developing apparatus 11, lubricating particles may be added. Examples of the lubricating particles include: solid lubricants such as graphite, molybdenum disulfide, talc, fatty acids, or fatty acid metal salts; low-molecular weight polyolefins such as polypropylene, polyethylene, or polybutene; silicones that are softened by heating; fatty acid amides such as oleamide, erucamide, ricinoleic acid amide, or stearamide; vegetable waxes such as carnauba wax, rice wax, candelilla wax, Japan wax, or jojoba oil; animal waxes such as bees wax; mineral and petroleum waxes such as montan wax, ozocerite, ceresine, paraffin wax, microcrystalline wax, or Fischer-Tropsch wax; and modified products thereof. These lubricating particles may be used alone or in a combination of at least two of them. The volume average diameter thereof is preferably in the range of from 0.1 μm to 10 μm. The particle size may be equalized by crushing these products having the chemical structure mentioned above. An addition amount thereof into the toner is preferably in the range of from 0.05% by weight to 2.0% by weight, and more preferably in the range of from 0.1% by weight to 1.5% by weight.

In the toner used for the developing apparatus 11, inorganic particles, organic particles, or complex particles obtained by attaching inorganic particles to organic particles may be added to remove the attached substance and deteriorated substance on a surface of the electrophotographic photoreceptor.

Preferable examples of the inorganic particles include various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, or boron nitride.

Furthermore, the foregoing inorganic particles may be hydrophobicized with: a titanium coupling agent such as tetrabutyl titanate, tetraoctyl titanate, isopropyltriisostearoyl titanate, isopropyltridecylbenzenesulfonyl titanate, or bis (dioctylpyrophosphate)oxyacetate titanate; or a silane coupling agent such as γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane. Moreover, inorganic particles hydrophobicized with silicone oil or a metal salt of higher fatty acid such as aluminum stearate, zinc stearate, or calcium stearate as well is preferably used.

Examples of the organic particle include a styrene resin particle, a styrene acrylic resin particle, a polyester resin particle, and a urethane resin particle.

Regarding a particle diameter, a volume average particle diameter is preferably from 5 nm to 1000 nm more preferably from 5 nm to 800 nm, and still more preferably from 5 nm to 700 nm. When the volume average particle diameter is less than the lower limit value, the abrasion ability tends to be insufficient. On the other hand, when it exceeds the foregoing upper limit value, the surface of the electrophotographic photoreceptor tends to be scratched. Moreover, a sum total of addition amounts of the particles and the lubricating particles mentioned above is preferably 0.6% by weight or more.

As the other inorganic oxides being added to the toner, an inorganic oxide of a small diameter having a primary particle diameter of 40 nm or less may be used in order to control the powder fluidity or charge control, and, further thereto, an inorganic oxide having a diameter larger than the above is preferably added to reduce the adhesion and to control the charging. For these inorganic oxide particles, known particles may be used. However, silica and titanium oxide are preferably used together to accurately control the charging. Furthermore, when a surface treatment is applied to an inorganic particle of a small diameter, the dispersibility is increased, and an effect of improving the powder fluidity is increased. Still furthermore, carbonate such as calcium carbonate or magnesium carbonate, or inorganic mineral such as hydrotalcite also may be added to remove a discharge product.

An electrophotographic color toner is used by mixing with a carrier. Examples of the carrier used herein include iron powder, glass beads, ferrite powder, and nickel powder, and those having a resin coating on the surface thereof. A blending ratio thereof with the carrier may be appropriately set.

As the transfer apparatus 40, a well-known charging device such as a contact transfer charging device that uses, for example, a belt, a roller, a film or a rubber blade, or a Scorotron corona charger or Corotron corona charger that makes use of corona discharge may be used as well.

As the intermediate transfer medium 50, a belt (intermediate transfer belt) made of semiconductive polyimide, polyamideimide, polycarbonate, polyallylate, polyester or rubber may be used. As a form of the intermediate transfer medium 50, other than a belt, a drum may be used.

The image forming apparatus 100 may have, in addition to the above respective apparatuses, for example, an optical discharger that discharges the photoreceptor 7 with light.

Figure 5:
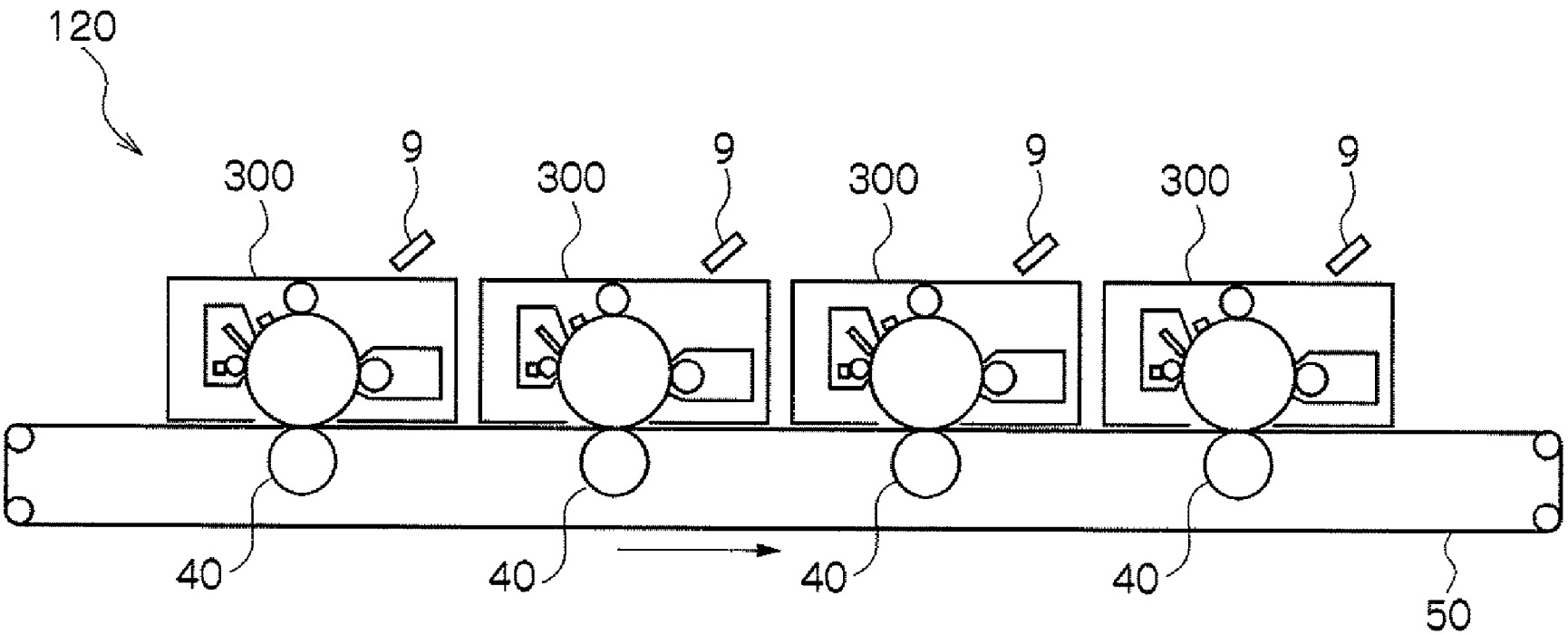
FIG. 5 is a schematic view showing an image forming apparatus according to another exemplary embodiment of the invention.

FIG. 5 is a schematic sectional view showing an image forming apparatus 120 involving another exemplary embodiment of the invention.

The image forming apparatus 120 shown in FIG. 5 is a tandem full-color image forming apparatus having four process cartridges 300.

The image forming apparatus 120 has four process cartridges 300 each disposed side by side on an intermediate transfer medium 50 and has a configuration where one electrophotographic photoreceptor is used for every color. The image forming apparatus 120 has a configuration similar to the image forming apparatus 100 except that the image forming apparatus 120 is formed into a tandem system.

When an electrophotographic photoreceptor of the invention is applied to a tandem image forming apparatus, electric characteristics of the four photoreceptors are stabilized; accordingly, an image quality excellent in a color balance over a long period of time is obtained.

Furthermore, in the image forming apparatus (process cartridge) involving the exemplary embodiment of the invention, a developing apparatus (developing unit) preferably has a developing roller that is a developing agent holder that moves in a direction opposite to a moving direction (rotation direction) of the electrophotographic photoreceptor. Herein, a developing roller has, on a surface of which, a tubular developing sleeve that holds a developing agent, and the developing apparatus having a configuration that has a restriction member that restricts the amount of the developing agent supplied to the developing sleeve is cited. When the developing roller of the developing apparatus is moved (rotated) in a direction opposite to a direction of rotation of the electrophotographic photoreceptor, a surface of the electrophotographic photoreceptor is scrubbed with a toner staying between the developing roller and the electrophotographic photoreceptor. Furthermore, in the case where the toner remained on the electrophotographic photoreceptor is cleansed, for example, when pressing pressure of a blade is heightened to heighten the cleanability of a toner having a near sphere shape, a surface of the electrophotographic photoreceptor is strongly scrubbed.

Conventionally known electrophotographic photoreceptors are strongly damaged by scrubbing; accordingly, wear, scratch or filming of the toner is readily caused, and, thereby, an image is deteriorated. When an electrophotographic photoreceptor surface that is heightened in mechanical strength owing to a crosslinked material of a specific charge transporting material of the invention (in particular, a material capable of obtaining a cured film high in the crosslinking density by increasing a number of reactive functional groups to contain at a high concentration) and formed into a thick film owing to excellent electric characteristics, a high image quality is enabled to maintain over a long period of time. It is thought that such a discharge product is inhibited from depositing over a very long period of time.

In the image forming apparatus of the exemplary embodiment of the invention, distance between a developing sleeve and a photoreceptor is preferably set at from 200 μm to 600 μm and more preferably at from 300 μm to 500 μm, from the viewpoint of inhibiting, over a longer period of time, the discharge product from depositing. Furthermore, from the similar viewpoint, distance between the developing sleeve and a restricting blade that is a restricting member for restricting an amount of the developing agent is preferably set at from 300 μm to 1000 μm and more preferably at from 400 μm to 750 μm.

Furthermore, an absolute value of a traveling speed of a developing roll surface is set preferably at from 1.5 times to 2.5 times and more preferably at from 1.7 times to 2.0 times an absolute value (process speed) of a traveling speed of a photoreceptor surface, from the viewpoint of inhibiting, over a long period of time, the discharge product from depositing.

In the image forming apparatus (process cartridge) involving the exemplary embodiment of the invention, it is preferable that a developing apparatus (developing unit) includes a developing agent holder having a magnetic body and an electrostatic latent image is developed using a two-component developing agent containing a magnetic carrier and a toner. In this configuration, a color image having image quality beautiful more than the case using a single component developing agent, in particular, a non-magnetic single component developing agent is obtained, and thereby high image quality and high durability are realized at a higher level.

EXAMPLES

Hereinafter, the present invention will be more specifically described with reference to Examples. However, the invention is not restricted to the Examples. A person skilled in the art may add modifications to the Examples shown below from known knowledge of polymer synthesis chemistry and electrophotographic technology.

Synthesis Example 1

Synthesis of 4,4'-azobis(4-cyanovaleric acid chloride)

First, 140 ml of thionyl chloride is cooled using ice, and 48 g of 4,4'-azobis(4-cyanovaleric acid) is gradually added thereto. The resulting mixture is heated at 30° C. for 6 hr, and excess thionyl chloride is distilled away under reduced pressure. The residual material is recrystallized from chloroform, and, thereby, 22 g of 4,4'-azobis(4-cyanovaleric acid chloride) crystal is obtained.

Synthesis Example 2

Synthesis of Compound (Compound A-6) having Charge Transportability and Azo Group Firstly, 100 g of N,N'-bis(p,m-dimethylphenyl)-N,N'-bis[p-(2-methoxycarbonylethyl)phenyl]-[p-terphenyl]4,4'-diamine, 200 g of ethylene glycol and 2 g of tetrabutoxytitanium are heated and refluxed for 4 hr under a nitrogen flow. Thereafter, the solution is heated to 225° C. while pressure inside of the reaction vessel is gradually reduced to 1 mm Hg, thereby distilling away excess ethylene glycol, followed by allowing reaction to continue for 4 hr as is. Thereafter, cooling to room temperature is carried out, methylene chloride is added to the reaction liquid to dissolve the insoluble matter, followed by reprecipitating in methanol, whereby 90 g of a prepolymer having a hydroxy group at each of both ends is obtained. A weight average molecular weight of the obtained prepolymer is 25,000.

Next, 40 g of the prepolymer and 0.5 g of triethylamine are dissolved in 120 ml of dichloroethane, followed by cooling to 0° C. or lower. Therein, a solution obtained by dissolving 12 g of the 4,4'-azobis(4-cyanovaleric acid chloride) obtained in Synthesis Example 1 in 40 ml of dichloromethane is added dropwise. The resulting mixture is allowed to react at room temperature for 1 hr, followed by allowing reaction at 30° C. for 5 hr. Thereafter, the solvent is distilled away, a solution obtained by dissolving the reaction product by adding tetrahydrofuran is added dropwise to methanol, followed by stirring for 1 hr, and further followed by filtering a precipitated solid. This reprecipitation operation is further repeated twice. The residue is dried, and thereby, 34 g of a compound (compound A-6) having charge transportability and an azo group is obtained.

Synthesis Example 3

Synthesis of Compound (Compound A-10) Having Charge Transportability and Azo Group Firstly, 100 g of N,N'-bis(p,m-dimethylphenyl)-N,N'-bis[p-(2-methoxycarbonylethyl)phenyl]-[3,3'-dimethyl-1,1'-biphenyl]-4,4'-diamine, 200 g of ethylene glycol and 5 g of tetrabutoxytitanium are heated and refluxed for 3 hr under nitrogen flow. Thereafter, the solution is heated to 225° C. while gradually reducing pressure inside of the reaction vessel to 1 mm Hg and distilling away excess ethylene glycol, followed by continuing reaction for 4 hr as it is. Thereafter, after cooling to room temperature, methylene chloride is added to the reaction liquid to dissolve the insoluble matter, followed by reprecipitating in methanol, thereby 92 g of prepolymer having a hydroxy group at each of both ends is obtained. A weight average molecular weight of the obtained prepolymer is 30000.

In the next place, 40 g of the prepolymer and 0.5 g of triethylamine are dissolved in 120 ml of dichloroethane, followed by cooling to 0° C. or lower. Therein, a solution obtained by dissolving 10 g of 4,4'-azobis(4-cyanovaleric acid chloride) obtained in Synthesis Example 1 in 40 ml of dichloromethane is added dropwise. The resulting mixture is allowed to react at room temperature for 1 hr, followed by allowing to react at 30° C. for 5 hr. Thereafter, the solvent is distilled away, a solution obtained by dissolving the reaction product by adding tetrahydrofuran is added dropwise to methanol, followed by stirring for 1 hr, further followed by filtering precipitated solid. The reprecipitation operation is further repeated twice. The residue is dried and thereby 35 g of a compound (Compound A-10) having charge transportability and an azo group is obtained.

Example 1

(Preparation of Undercoat Layer)

In the beginning, 100 parts by weight of zinc oxide (average particle diameter: 70 nm, specific surface area: 15 $m^2/g$, manufactured by TEIKA Co., Ltd.) and 500 parts by weight of tetrahydrofuran are mixed and stirred, 1.3 parts by weight of a silane coupling agent (trade name: KBM503, manufactured by Shin-Etsu Chemical Co., Ltd.) are added thereto, followed by stirring for 2 hr. Thereafter, tetrahydrofuran is distilled away under reduced pressure, followed by baking at 120° C. for 3 hr, thereby zinc oxide surface-treated with a silane coupling agent is obtained.

In the next place, 110 parts by weight of surface-treated zinc oxide and 500 parts by weight of tetrahydrofuran are mixed and stirred, therein a solution obtained by dissolving 0.6 parts by weight of alizarin in 50 parts by weight of tetrahydrofuran is added, followed by stirring at 50° C. for 5 hr. Thereafter, alizarin-added zinc oxide is filtered under reduced pressure, followed by drying at 60° C. under reduced pressure, and thereby alizarin-added zinc oxide is obtained.

Then, 38 parts by weight of a solution obtained by mixing 60 parts by weight of the alizarin-added zinc oxide, 13.5 parts by weight of a hardener (block isocyanate, trade name: SUMIDULE 3175, manufactured by Sumitomo-Bayer Urethane Co., Ltd.) and 15 parts by weight of a butyral resin (trade name: S-LEC BM-1, manufactured by Sekisui Chemical Co., Ltd.) in 85 parts by weight of methyl ethyl ketone and 25 parts by weight of methyl ethyl ketone are mixed, followed by dispersing for 2 hr by use of a sand mill with glass beads having a diameter of 1 mmϕ, thereby a dispersion liquid is obtained.

To the resulting dispersion liquid, 0.005 parts by weight of dioctyltin dilaurate and 40 parts by weight of silicone resin particles (trade name: TOSPEARL 145, manufactured by GE-Toshiba Silicone Co., Ltd.) are added, and thereby a coating solution for forming an undercoat layer is obtained. The coating solution is coated by dipping on an aluminum substrate having a diameter of 30 mm, a length of 340 mm and a thickness of 1 mm, followed by drying and curing at 170° C. for 40 min, and thereby an undercoat layer having a thickness of 19 μm is obtained.

(Preparation of Charge Generating Layer)

In the beginning, a mixture containing 15 parts by weight of hydroxygallium phthalocyanine having diffraction peaks at least at 7.3°, 16.0°, 24.9° and 28.0° by Bragg angle (2θ±0.2°) in an X-ray diffraction spectrum obtained with CuKα characteristic X-ray as a charge generating material, 10 parts by weight of a vinyl chloride/vinyl acetate copolymer resin (trade name: VMCH, manufactured by Nippon Unicar Co., Ltd.) and 200 parts by weight of n-butyl acetate is dispersed for 4 hr by use of a sand mill with glass beads having a diameter of 1 mmϕ. To the resulting dispersion liquid, 175 parts by weight of n-butyl acetate and 180 parts by weight of methyl ethyl ketone are added, followed by stirring, thereby a coating solution for forming a charge generating layer is obtained. The coating solution for forming a charge generating layer is coated on the undercoat layer by dipping, followed by drying at room temperature (25° C.), and thereby a charge generating layer having a film thickness of 0.2 μm is formed.

(Preparation of Charge Transport Layer)

Firstly, 55 parts by weight of a compound represented by formula (I) (compound i-1) and 45 parts by weight of a compound having charge transportability and an azo group (a compound represented by formula (A); Compound A-6) are dissolved in 600 parts by weight of tetrahydrofuran (THF), followed by further dissolving 1 parts by weight of a fluorocarbon surfactant (trade name: KL-600, manufactured by Kyoeisha Chemical Co., Ltd.) therein, thereby a coating solution for forming a charge transport layer is obtained. The coating solution is coated on the charge generating layer, followed by heating at 150° C. for 45 min under an atmosphere having an oxygen concentration of substantially 100 ppm, and thereby a charge transport layer (outermost surface layer) having a thickness of 20 μm is formed.

According to such a method, an electrophotographic photoreceptor is obtained. The photoreceptor is referred to as a photoreceptor 1.

Evaluation

-Evaluation of Image Quality-

An electrophotographic photoreceptor prepared as mentioned above is installed in DocuCentre-II C7500 (color/monochrome composite apparatus) (trade name, manufactured by Fuji Xerox Co., Ltd.), followed by conducting an image evaluation test (1) under an environment of 10° C. and 15% RH.

Thereafter, under the same environment, a 5% halftone image is printed continuously on 10000 sheets. After printing 10000 sheets, an image evaluation test (2) is conducted under the same environment.

Further thereafter, an image forming apparatus is left for 24 hr under an environment of 27° C. and 80% RH, followed by conducting an image evaluation test (3) under the same environment.

In the image evaluation tests (1), (2) and (3), density unevenness, streaks, image degradation and ghosting are evaluated.

In the image forming test, P SHEET (trade name, manufactured by Fuji Xerox Co., Ltd., A4 size, sideways feed) is used.

Evaluation results are shown in Table 3.

(Evaluation of Density Unevenness)

The density unevenness is visually evaluated using the 5% halftone sample.

A: Excellent.

B: Partial density unevenness is seen.

C: Density unevenness problematic from image quality point of view is seen.

(Evaluation of Streaks)

Streaks are visually evaluated using the 5% halftone sample.

A: Excellent.

B: Partial streaks.

C: Streaks problematic from image quality point of view are seen.

(Evaluation of Image Degradation)

Together with the above tests, the image degradation as well is evaluated as shown below.

The image degradation is visually evaluated using the 5% halftone sample.

A: Excellent.

B: There is found no problem of image degradation during a continuous print test but found a problem after leaving for 24 hr.

C: There is found a problem even during a continuous print test.

(Evaluation of Ghosting)

Figure 6A:
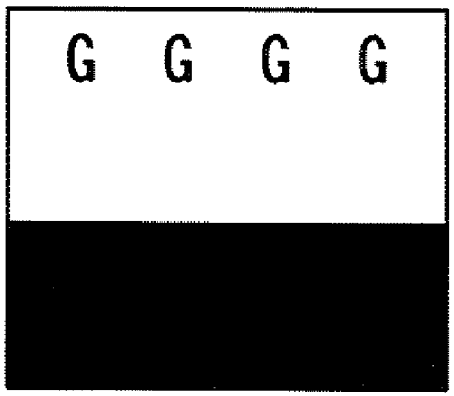
FIGS. 6A to 6C are explanatory drawings showing the criteria for evaluating ghosting.

The ghosting is evaluated by visually observing a degree of appearance of a figure G in a black region after a chart of a pattern having G and a black region, which are shown in FIG. 6A, is printed in a state where discharging light is forcibly turned off (in a state where discharge of a photoreceptor is not conducted).

A: Excellent or very slight as shown in FIG. 6A.

Figure 6B:
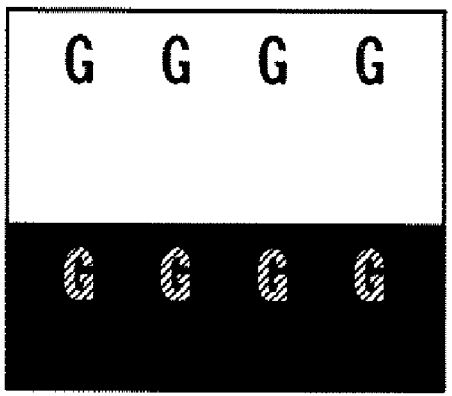

B: Slightly conspicuous as shown in FIG. 6B.

Figure 6C:
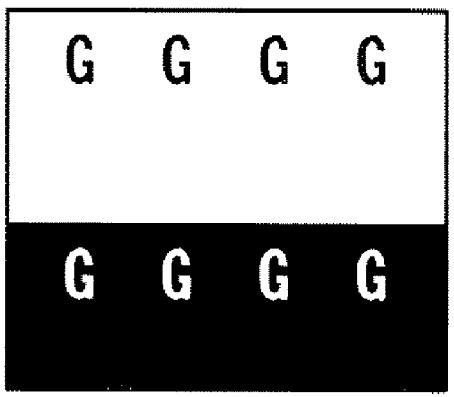

C: Clearly confirmed as shown in FIG. 6C.

(Surface Observation)

A surface of the electrophotographic photoreceptor after individual observations in the image quality evaluation tests (1), (2) and (3) is observed and evaluated as shown below.

A: Excellent, That is, there is found neither scratch nor attachment even under 20 times magnification.

B: Under 20 times magnification, slight scratch or attachment is found.

C: Scratch or attachment is observed by the naked eyes.

Examples 2 to 13, Comparative Example 1

Photoreceptors 2 to 13 and Cl are prepared in a manner substantially similar to that in Example 1 except that the respective materials that constitute the coating solution for forming a charge transport layer and blending amounts thereof are changed in accordance with Tables 3 and 4 shown below. Results are shown in Tables 5 and 6.

In Table 3, the respective materials and blending amounts thereof in Example 1 are shown together.

TABLE 3

| | Example 1 | Example 2 | Example 3 | Example 4 | Example 5 | Example 6 | Example 7 | Example 8 |
|---|---|---|---|---|---|---|---|---|
| Compound represented by formula (I) | i-1 | ii-1 | iii-1 | iv-18 | i-1 | ii-1 | iii-1 | iv-18 |
| Addition amount (parts by weight) | 55 | 55 | 55 | 55 | 55 | 55 | 55 | 55 |
| Compound represented by formula (A) | A-6 | A-6 | A-6 | A-6 | A-10 | A-10 | A-10 | A-10 |
| Addition amount (parts by weight) | 45 | 45 | 45 | 45 | 45 | 45 | 45 | 45 |
| Surfactant | KL-600 | KL-600 | KL-600 | KL-600 | KL-600 | KL-600 | KL-600 | KL-600 |
| Addition amount (parts by weight) | 1 | 1 | 1 | 1 | 1 | 1 | 1 | 1 |
| Solvent | THF | THF | THF | THF | THF | THF | THF | THF |
| Addition amount (parts by weight) | 600 | 600 | 600 | 600 | 600 | 600 | 600 | 600 |
| Photoreceptor No. | 1 | 2 | 3 | 4 | 5 | 6 | 7 | 8 |

TABLE 4

| | Example 9 | Example 10 | Example 11 | Example 12 | Example 13 | Comparative Example 1 |
|---|---|---|---|---|---|---|
| Compound represented by formula (I) | iv-18 | iv-18 | iv-18 | iv-18 | iv-18 | ii-1 |
| Addition amount (parts by weight) | 35 | 35 | 55 | 55 | 55 | 55 |
| Charge transporting material not having reactive group | CTM-1 | CTM-1 | — | — | — | — |
| Addition amount (parts by weight) | 20 | 20 | — | — | — | — |
| Compound represented by formula (A) | A-6 | A-10 | A-10 | A-10 | A-10 | — |
| Addition amount (parts by weight) | 45 | 45 | 45 | 45 | 45 | — |
| Other thermal polymerization initiator | — | — | — | — | AIBN | AIBN |
| Addition amount (parts by weight) | — | — | — | — | 1 | 3 |
| Monomer or polymer | — | — | DA-1 | PC(Z) | DA-1 | PC(Z) |
| Addition amount (parts by weight) | — | — | 10 | 10 | 10 | 10 |
| Surfactant | KL-600 | KL-600 | KL-600 | KL-600 | KL-600 | KL-600 |
| Addition amount (parts by weight) | 1 | 1 | 1 | 1 | 1 | 1 |
| Solvent | THF | THF | THF | THF | THF | THF |
| Addition amount (parts by weight) | 600 | 600 | 600 | 600 | 600 | 600 |
| Photoreceptor No. | 9 | 10 | 11 | 12 | 13 | C1 |

"CTM-1", "DA-1", "PC(Z)" and "AIBN" in Tables 3 and 4 will be described below.

CTM-1: N,N'-diphenyl-N,N'-bis(3-methylphenyl)-[1,1'-biphenyl]4,4'-diamine

DA-1: Ethoxylated bisphenol A diacrylate

PC(Z): bisphenol (Z) polycarbonate (viscosity average molecular weight: 40000, manufactured by Mitsubishi Gas Chemical Company, Inc.)

AIBN: Azobisisobutyl nitrile (thermal polymerization initiator, manufactured by Otsuka Chemical Co., Ltd.)

Example 14

An undercoat layer and a charge generating layer are disposed on an aluminum substrate in a manner substantially similar to Example 1.

Thereafter, 45 parts by weight of N,N'-diphenyl-N,N'-bis(3-methylphenyl)-[1,1'-biphenyl-4,4'-diamine and 55 parts by weight of a bisphenol Z polycarbonate resin (viscosity average molecular weight: 50000) are added to and dissolved in 800 parts by weight of chlorobenzene, and thereby a coating solution for forming a charge transport layer is obtained. The coating solution is coated on the charge generating layer, followed by drying at 130° C. for 45 min, and thereby a charge transport layer having a film thickness of 15 μm is formed.

Subsequently, the coating solution for forming the charge transport layer used in Example 1 is coated on the above charge transport layer by spraying, followed by heating at 150° C. for 45 min under an atmosphere of an oxygen concentration of substantially 100 ppm, thereby a protective layer (outermost surface layer) having a thickness of 5 μm is formed.

According to such the method mentioned above, an electrophotographic photoreceptor is obtained. The photoreceptor is referred to as a photoreceptor 14.

The photoreceptor 14 is evaluated in a manner substantially similar to that in Example 1. Results thereof are shown in Table 6.

Comparative Example 2

An undercoat layer and a charge generating layer are disposed on an aluminum substrate in a manner substantially similar to Example 1. Thereafter, 45 parts by weight of N,N'-diphenyl-N,N'-bis(3-methylphenyl)-[1,1'biphenyl]4,4'-diamine (CTM-1) and 60 parts by weight of bisphenol Z polycarbonate (PC(Z), viscosity average molecular weight: 40000, manufactured by Mitsubishi Gas Chemical Co., Ltd.) are dissolved in 800 parts by weight of THF, and thereby a coating solution for forming a charge transport layer is obtained. The coating solution is coated on the charge generating layer, followed by drying at 130° C. for 45 min, and thereby a charge transport layer having a film thickness of 20 μm is formed.

An electrophotographic photoreceptor obtained according to the method is referred to as a photoreceptor C2.

The photoreceptor C2 is evaluated in a manner substantially similar to that in Example 1. Results thereof are shown in Table 6.

TABLE 5

| | | Example 1 | Example 2 | Example 3 | Example 4 | Example 5 | Example 6 | Example 7 | Example 8 |
|---|---|---|---|---|---|---|---|---|---|
| Photoreceptor No. | | 1 | 2 | 3 | 4 | 5 | 6 | 7 | 8 |
| Test (1) | Density unevenness | A | A | A | A | A | A | A | A |
| | Streaks | A | A | A | A | A | A | A | A |
| | Image degradation | A | A | A | A | A | A | A | A |
| | Ghosting | A | A | A | A | A | A | A | A |
| | Surface observation | A | A | A | A | A | A | A | A |
| Test (2) | Density unevenness | A | A | A | A | A | A | A | A |
| | Streaks | A | A | A | A | A | A | A | A |
| | Image degradation | A | A | A | A | A | A | A | A |
| | Ghosting | A | A | A | A | A | A | A | A |
| | Surface observation | B | A | A | A | B | A | A | A |
| Test (3) | Density unevenness | A | A | A | A | A | A | A | B |
| | Streaks | B | B | A | A | B | B | A | A |
| | Image degradation | A | A | A | A | A | A | A | A |
| | Ghosting | B | B | B | B | B | B | B | B |
| | Surface observation | B | B | B | A | B | B | B | A |

TABLE 6

| | | Example 9 | Example 10 | Example 11 | Example 12 | Example 13 | Example 14 | Comparative Example 1 | Comparative Example 2 |
|---|---|---|---|---|---|---|---|---|---|
| Photoreceptor No. | | 9 | 10 | 11 | 12 | 13 | 14 | C1 | C2 |
| Test (1) | Density unevenness | A | A | A | A | A | A | A | A |
| | Streaks | A | A | A | A | A | A | A | A |
| | Image degradation | A | A | A | A | A | A | A | A |
| | Ghosting | A | A | A | A | B | A | C | A |
| | Surface observation | A | A | A | A | A | A | A | A |
| Test (2) | Density unevenness | A | A | A | A | A | A | A | A |
| | Streaks | A | A | A | A | A | A | B | B |
| | Image degradation | A | A | A | A | A | A | A | A |
| | Ghosting | A | A | A | A | B | A | C | B |
| | Surface observation | A | A | B | A | A | B | A | C |
| Test (3) | Density unevenness | A | A | A | A | A | A | A | A |
| | Streaks | A | A | A | B | B | B | B | B |
| | Image degradation | A | A | A | A | A | A | A | A |
| | Ghosting | A | A | B | A | B | A | C | B |
| | Surface observation | B | B | A | B | B | B | B | C |

What follows below are found from Tables 5 and 6.

That is, in an image forming apparatus provided with a photoreceptor obtained in each of Examples, it is found that from an image quality evaluation test (1) at an initial stage of print to an image quality evaluation test (2) after repetition of print, properties with respect to density unevenness, streaks, image degradation and ghosting are all excellent. It is also found that a surface state of a photoreceptor of each of Examples is excellent in all of image quality evaluation test (1) and image quality evaluation test (2). Furthermore, also when an image quality evaluation test (3) is conducted after storing under high temperature and high humidity, there is found no practical problem of density unevenness, streaks, image gradation, ghosting and surface state.

On the other hand, it is found that, in Comparative Example 1, in all of an image evaluation test (1) at an initial stage of print (1), an image quality test (2) after repetition of print and an image quality evaluation test (3) after storing under high temperature and high humidity, the ghosting is generated to be practically problematic.

Furthermore, Comparative Example 2 is poor in the surface state in an image quality evaluation test (1) and an image quality evaluation test (2), and low in the mechanical strength of the outermost surface layer of a photoreceptor, that is, it is found that there is a practical problem.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

a photosensitive layer formed on the conductive substrate; and an outermost surface layer that is a layer made of a cured material of a composition including at least one compound represented by the following formula (I) and at least one compound having charge transportability and an azo group:

(I)

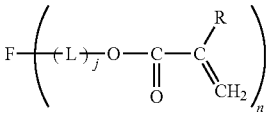

wherein in formula (I), F represents an n-valent organic group having a hole transporting property, R represents a hydrogen atom or an alkyl group, L represents a divalent organic group, n represents an integer of 1 or more, and j represents 0 or 1, wherein the compound that has charge transportability and an azo group is a compound represented by the following formula (A):

(A)

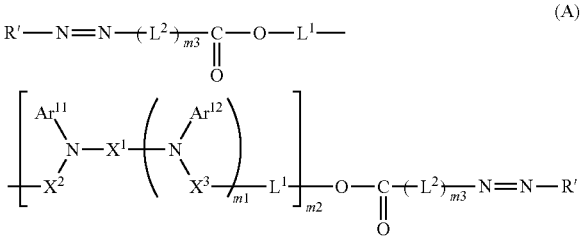

wherein in formula (A), $Ar^{11}$ and $Ar^{12}$ each independently represent a substituted or unsubstituted aryl group; $X^1$ represents a divalent hydrocarbon group having an aromatic cyclic structure or a divalent heteroatom-containing hydrocarbon group having an aromatic cyclic structure; $X^2$ and $X^3$ each independently represent a substituted or unsubstituted arylene group; $L^1$ and $L^2$ each independently represent a divalent hydrocarbon group that may contain a branched or cyclic structure or a divalent heteroatom-containing hydrocarbon group that may contain a branched or cyclic structure; m1 and m3 each independently represent 0 or 1; m2 represents a number of 1 or more; and R' represents a monovalent hydrocarbon group or a monovalent heteroatom-containing hydrocarbon group.

2. The electrophotographic photoreceptor of claim 1, wherein R in formula (I) is a methyl group.

3. The electrophotographic photoreceptor of claim 1, wherein n in formula (I) is an integer of 2 or more.

4. The electrophotographic photoreceptor of claim 1, wherein formula (I) is represented by the following formula (II):

(II)

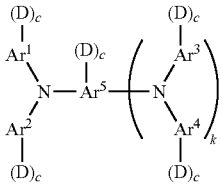

wherein in formula (II), $Ar^1$ to $Ar^4$ each independently represent a substituted or unsubstituted aryl group; $Ar^5$ represents a substituted or unsubstituted aryl group or a substituted or unsubstituted arylene group; D represents $-(L)_j-O-CO-C(R)=CH_2$; L represents a divalent organic group; j represents 0 or 1; five cs each independently represent 0 or 1; k represents 0 or 1; the total number of Ds is 1 or more; and R represents a hydrogen atom or a straight or branched alkyl group having from 1 to 5 carbon atoms.

5. The electrophotographic photoreceptor of claim 4, wherein the total number of Ds in formula (II) is 4 or more.

6. The electrophotographic photoreceptor of claim 4, wherein R in formula (II) is a methyl group.

7. The electrophotographic photoreceptor of claim 1, wherein a total content of compounds represented by formula (I) is about 30% by weight or more relative to the composition that constitutes the outermost surface layer.

8. The electrophotographic photoreceptor of claim 1, wherein $Ar^{11}$ and $Ar^{12}$ in formula (A) are each independently a substituted or unsubstituted aryl group having from 6 to 16 carbon atoms.

9. The electrophotographic photoreceptor of claim 1, wherein $L^1$ in formula (A) represents a combination of an ester bond, and an alkylene group and/or a phenylene group.

10. The electrophotographic photoreceptor of claim 1, wherein $L^2$ in formula (A) contains an alkylene group or a cyano group and has from 1 to 20 carbon atoms.

11. The electrophotographic photoreceptor of claim 1, wherein R' in formula (A) contains an alkylene group, an ester group, a cyano group or a carboxyl group.

12. The electrophotographic photoreceptor of claim 1, wherein the compound represented by formula (A) is contained in an amount of from about 2% by weight to about 200% by weight relative to a reactive compound in the composition.

13. A process cartridge comprising:

the electrophotographic photoreceptor of claim 1; and at least one unit selected from the group consisting of a charging unit for charging the electrophotographic photoreceptor, a developing unit for developing an electrostatic latent image formed on the electrophotographic photoreceptor with a toner, and a toner removing unit for removing toner remaining on a surface of the electrophotographic photoreceptor.

14. An image forming apparatus comprising:

the electrophotographic photoreceptor of claim 1;

a charging unit for charging the electrophotographic photoreceptor;

an electrostatic latent image forming unit for forming an electrostatic latent image on the charged electrophotographic photoreceptor;

a developing unit for developing the electrostatic latent image formed on the electrophotographic photoreceptor with a toner to form a toner image; and a transfer unit that transfers the toner image to a transfer body.

* * * * *